US005413727A

United States Patent [19]

Drapier et al.

[11] Patent Number: 5,413,727

[45] Date of Patent: May 9, 1995

[54] THIXOTROPIC AQUEOUS COMPOSITIONS CONTAINING LONG CHAIN SATURATED FATTY ACID STABILIZERS

[75] Inventors: Julien Drapier, Seraing, Belgium; Nagaraj S. Dixit, Plainsboro, N.J.

[73] Assignee: Colgate Palmolive Co., Piscataway, N.J.

[21] Appl. No.: 789,578

[22] Filed: Nov. 8, 1991

Related U.S. Application Data

[63] Continuation-in-part of Ser. No. 679,992, Mar. 29, 1991, Ser. No. 572,312, Aug. 24, 1990, abandoned, Ser. No. 493,003, Mar. 13, 1990, abandoned, Ser. No. 353,712, May 18, 1989, Pat. No. 5,064,553, Ser. No. 313,277, Feb. 21, 1989, abandoned, Ser. No. 328,716, Mar. 27, 1989, abandoned, Ser. No. 527,238, May 21, 1990, Pat. No. 5,098,590, and Ser. No. 708,323, May 30, 1991, abandoned, said Ser. No. 679,992, is a continuation-in-part of Ser. No. 527,689, May 21, 1990, abandoned, which is a continuation of Ser. No. 248,007, Sep. 23, 1988, abandoned, which is a continuation of Ser. No. 894,155, Aug. 7, 1986, Pat. No. 4,801,395, said Ser. No. 572,312, is a continuation of Ser. No. 427,912, Oct. 24, 1989, abandoned, which is a continuation of Ser. No. 204,476, Jun. 9, 1988, abandoned, which is a continuation of Ser. No. 903,924, Sep. 5, 1986, Pat. No. 4,752,409, which is a continuation-in-part of Ser. No. 744,754, Jun. 14, 1985, abandoned, said Ser. No. 313,277, is a continuation-in-part of Ser. No. 87,937, Aug. 21, 1987, abandoned, said Ser. No. 328,716, is a continuation-in-part of Ser. No. 87,937, Aug. 21, 1987, said Ser. No. 527,238, is a continuation of Ser. No. 303,700, Jan. 27, 1989, abandoned, which is a continuation of Ser. No. 152,277, Feb. 4, 1988, abandoned.

[51] Int. Cl.[6] ..... C11D 1/04; C11D 3/12; C11D 3/37; C11D 3/04

[52] U.S. Cl. ..... 252/97; 252/103; 252/174.14; 252/174.24; 252/174.25; 252/135; 252/156; 252/109

[58] Field of Search ..... 252/95, 97, 99, 135, 252/140, 174.14, 174.19, 174.24, 174.23, 174.25, 156, 160, 173, 108, 109, 103, DIG. 14

[56] References Cited

U.S. PATENT DOCUMENTS

| | | | |
|---|---|---|---|
| 3,956,158 | 5/1976 | Donaldson | 252/102 |
| 4,226,736 | 10/1980 | Bush et al. | 252/135 |
| 4,240,919 | 12/1980 | Chapman | 252/95 |
| 4,752,409 | 7/1988 | Drapier et al. | 252/94 |
| 4,801,395 | 1/1989 | Chazard et al. | 252/99 |
| 4,824,590 | 4/1989 | Roselle | 252/90 |

FOREIGN PATENT DOCUMENTS

| | | |
|---|---|---|
| 2116199 | 9/1983 | United Kingdom . |
| 2140450 | 11/1984 | United Kingdom . |

*Primary Examiner*—Paul Lieberman
*Assistant Examiner*—E. M. Higgins
*Attorney, Agent, or Firm*—Richard E. Nanfeldt; Robert C. Sullivan; Murray Grill

[57] ABSTRACT

The physical stability of liquid gel-like compositions based on thixotropic thickener is greatly improved by incorporating in the composition small amounts of long chain fatty acids and salts thereof. The aqueous compositions containing inorganic builder salts and other functional inorganic salts, chlorine bleach, bleach stable detergent, at least one thixotropic thickener and a fatty acid or a metal salt of the fatty acid as a physical stabilizer exhibit a significant increase in apparent viscosity and remain stable against phase separation for an extended period of time. The thixotropic properties can be retained or improved using smaller levels of the thixotropic thickener than in the absence of the physical stabilizer. The stability, chlorine-bleach loss and cleaning ability of the compositions is further improved, when the composition pH is at least 11.2, when added to an aqueous wash both at a concentration of about 10 grams per liter. Use as liquid gel-like automatic dishwasher compositions are described.

7 Claims, 20 Drawing Sheets

THIXOTROPIC AQUEOUS COMPOSITIONS CONTAINING LONG CHAIN SATURATED FATTY ACID STABILIZERS

CROSS-REFERENCE TO RELATED APPLICATIONS

This application is a continuation in part of prior application U.S. Ser. No. 07/679,992 filed Mar. 29, 1991, pending, which in turn is a continuation in part of prior application U.S. Ser. No. 527,689 filed May 21, 1990, now abandoned, which in turn is a continuation application of U.S. Ser. No. 248,007 filed Sep. 23, 1988, now abandoned, which in turn is a continuation application of U.S. Ser. No. 894,155 filed Aug. 7, 1986, now U.S. Pat. No. 4,801,395; and is also a continuation in part of prior application U.S. Ser. No. 572,312 filed Aug. 24, 1990, now abandoned, which in turn is a continuation of U.S. Ser. No. 427,912 filed Oct. 24, 1989, now abandoned, which is a continuation of Ser. No. 204,476 filed Jun. 9, 1988, now abandoned, which is a continuation of U.S. Ser. No. 903,924 filed Sep. 5, 1986, now U.S. Pat. No. 4,752,409, which is a continuation in part of U.S. Ser. No. 744,754 filed Jun. 14, 1985, now abandoned and is also a continuation in part application of U.S. Ser. No. 493,003 filed Mar. 13, 1990, now abandoned, and is also a continuation in part application of U.S. Ser. No. 353,712 filed May 18, 1989, now U.S. Pat. No. 5,064,553, and is also a continuation in part application of U.S. Ser. No. 313,277 filed Feb. 21, 1989, now abandoned, which in turn is a continuation in part application of U.S. Ser. No. 087,937, filed Aug. 21, 1987, now abandoned, and is also a continuation in part application of U.S. Ser. No. 328,716 filed Mar. 27, 1989, now abandoned, which in turn is a continuation in part application of U.S. Ser. No. 087,937 filed Aug. 21, 1987, now abandoned, and is also a continuation in part of prior application U.S. Ser. No. 527,238, filed May 21, 1990, now U.S. Pat. No. 5,098,590, which is a continuation of Ser. No. 303,700, filed Jan. 27, 1989, now abandoned, which is a continuation of Ser. No. 152,277, filed Feb. 4, 1988, now abandoned and is also a continuation in part of U.S. Ser. No. 07/708,323 filed May 30, 1991, now abandoned.

FIELD OF INVENTION

The present invention relates to thixotropic aqueous suspensions with improved physical stability. More specifically, the invention relates to the use of long chain fatty acids and salts thereof as physical stabilizers for polymeric thixotropic aqueous compositions.

The present invention specifically relates to automatic dishwashing detergent compositions having thixotropic properties, improved chemical and physical stability, and with increased apparent viscosity, and which are readily dispersible in the washing medium to provide effective cleaning of dishware, glassware, china and the like.

BACKGROUND OF THE INVENTION

Commercially available household-machine dishwasher detergents provided in powder form have several disadvantages, e.g. non-uniform composition; costly operations necessary in their manufacture; tendency to cake in storage at high humidities, resulting in the formation of lumps which are difficult to disperse; dustiness, a source of particular irritation to users who suffer allergies; and tendency to cake in the dishwasher machine dispenser.

Recent research and development activity has focused on the gel or "thixotropic" form of such compositions. Dishwasher products so provided are primarily objectionable in that they are insufficiently viscous to remain "anchored" in the dispenser cup of the dishwasher, and moreover yield spotty residues on dishware, glassware, china and the like. Ideally, thixotropic cleansing compositions should be highly viscous in a quiescent state, Bingham plastic in nature, and have relatively high yield values. When subjected to shear stresses, however, such as being shaken in a container or squeezed through an orifice, they should quickly fluidize and upon cessation of the applied shear stress, quickly revert to the high viscosity/Bingham plastic state. Stability is likewise of primary importance, i.e. there should be no significant evidence of phase separation or leaking after long standing.

U.S. Pat. No. 4,752,409 and U.S. Pat. No. 4,801,395, which are assigned to applicants' assignee and of which the present application is a continuation in part, are directed to thixotropic aqueous suspension dishwashing detergent compositions containing long chain fatty acids and metal salts of long chain fatty acids such as aluminum stearate and sodium stearate as physical stabilizing agents. These compositions show improvement in the physical stability of the detergent composition and improvement against phase separation over those containing compositions that do not contain the aluminum stearate. Although polymeric thickeners are disclosed, they are not exemplified in the specifications even though they are well known in the art.

The provision of automatic-dishwasher compositions in gel form having the afore-described properties, other than for the improvements described in the above mentioned Patent, has thus far proven problematical, particularly in home dishwasher machines. For effective use, it is generally recommended that the automatic dishwashing detergent, hereinafter also designated ADD, contain (1) sodium tripolyphosphate (NaTPP) to soften or tie up hard-water minerals and to emulsify and/or peptide soil; (2) sodium silicate to supply the alkalinity necessary for effective detergency and to provide protection for fine china glaze and pattern; (3) sodium carbonate, generally considered to be optional, to enhance alkalinity; (4) a chlorine-releasing agent to aid in the elimination of soil specks which lead to water spotting; and (5) defoamer/surfactant to reduce foam, thereby enhancing machine efficiency and supplying requisite detergency. See, for example, SDA Detergents in Depth, "Formulations Aspects of Machine Dishwashing," Thomas Oberle (1974). Cleansers approximating to the afore-described compositions are mostly liquids or powders. Combining such ingredients in a gel form effective for home-machine use has proved difficult. Generally, such compositions omit hypochlorite bleach, since it tends to react with other chemically active ingredients, particularly surfactant. Thus, U.S. Pat. No 4,115,308 discloses thixotropic automatic dishwasher pastes containing a suspending agent, e.g. CMC, synthetic clays or the like; inorganic salts including silicates, phosphates and polyphosphates; a small amount of surfactant and a suds depressor. Bleach is not disclosed. U.S. Pat. No. 4,147,650 is somewhat similar, optionally including Cl-(hypochlorite) bleach but no organic surfactant or foam depressant. The product is described, moreover, as a detergent slurry with no apparent thixotropic properties.

U.S. Pat. No. 3,985,668 describes abrasive scouring cleansers of gel-like consistency containing (1) suspending agent, preferably the Smectite and attapulgite types of clay at a relatively high concentration of preferably 3–5% by weight; (2) abrasive, e.g. silica sand or perlite, and (3) filler comprising light density powdered polymers, expanded perlite and the like, which has a buoyancy and thus stabilizing effect on the composition in addition to serving as a bulking agent, thereby replacing water otherwise available for undesired supernatant layer formation due to leaking and phase de-stabilization. The foregoing are the essential ingredients. Optional ingredients include hypochlorite bleach, bleach stable surfactant and buffer, e.g. silicates, carbonates, and monophosphate. Builders, such as NaTPP, can be included as further optional ingredients to supply or supplement building function not provided by the buffer, the amount of such builder not exceeding 5% of the total composition, according to the patent. Maintenance of the desired (greater than) pH 10 levels is achieved by the buffer/builder components. High pH is said to minimized decomposition of chlorine bleach and undesired interaction between surfactant and bleach. Foam killer is not disclosed.

In U.K. Patent GB No. 2,116,199B and GB No. 2,140,450B, both of which are assigned to Colgate-Palmolive, liquid ADD compositions are disclosed which have properties desirably characterizing thixotropic, gel-type structure and which include each of the various ingredients necessary for effective detergency with an automatic dishwasher. The normally gel-like aqueous automatic dishwasher detergent composition having thixotropic properties includes the following ingredients, on a weight basis:

(a) 5 to 35% alkali metal tripolyphosphate;
(b) 2.5 to 20% sodium silicate;
(c) 0 to 9% alkali metal carbonate;
(d) 0.1 to 5% chlorine bleach stable, water dispersible organic detergent active material;
(e) 0 to 5% chlorine bleach stable foam depressant;
(f) chlorine bleach compound in an amount to provide about 0.2 to 4% of available chlorine;
(g) thixotropic thickener in an amount sufficient to provide the composition with thixotropy index of about 2.5 to 10;
(h) sodium hydroxide, as necessary, to adjust pH; and
(i) balance water.

Add compositions so formulated are low-foaming; are readily soluble in the washing medium and most effective at pH values best conducive to improved cleaning performance, viz, pH 10.5–14. The compositions are normally of gel consistency, i.e. a highly viscous, opaque jelly-like material having Bingham plastic character and thus relatively high yield values. Accordingly, a definite shear force is necessary to initiate or increase flow, such as would obtain within the agitated dispenser cup of an energized automatic dishwasher. Under such conditions, the composition is quickly fluidized and easily dispersed. When the shear force is discontinued, the fluid composition quickly reverts to a high viscosity Bingham plastic state closely approximating its prior consistency.

SUMMARY OF THE INVENTION

Figure 1:
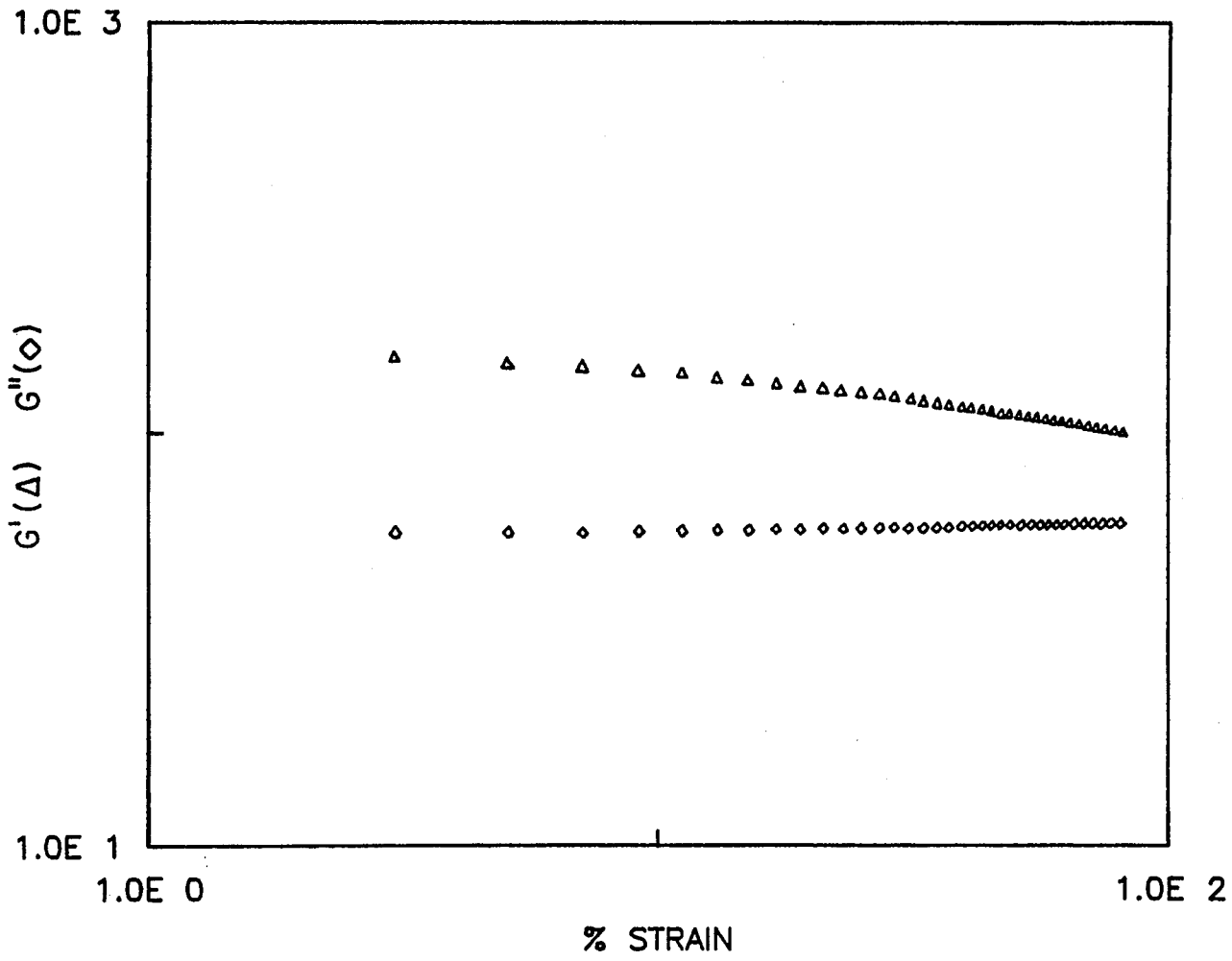
FIGS. 1–19 are rheograms, plotting elastic modules G′ and viscous modulus G″ as a function of applied strain, for the compositions of Example 25, Formulations A, C, D, G, J, H, I and K; Example 26, A and B; Example 27, L and M and comparative Example 27, respectively and Formulations A–F of Example 28.

The present invention relates to thixotropic aqueous suspensions with improved physical stability. More specifically, the invention relates to the use of long chain fatty acids and salts thereof as physical stabilizers for polymeric thixotropic aqueous compositions as well as inorganic thixotropic aqueous compositions as well as mixtures thereof which compositions can contain either phosphate builder systems or non-phosphate builder systems.

The present invention specifically relates to automatic dishwashing detergent compositions having thixotropic properties, improved chemical and physical stability, and with increased apparent viscosity, and which are readily dispersible in the washing medium to provide effective cleaning of dishware, glassware, china and the like.

Accordingly, it is an objective of the invention to provide anti-settling additives for thixotropic aqueous compositions.

It is another object of the invention to provide liquid ADD compositions having thixotropic properties with improved physical stability and rheological properties by using fatty acids and salts thereof as well as those being formed in situ in the compositions from the fatty acids.

It is still another object of the invention to provide thixotropic liquid ADD compositions having reduced levels of inorganic thixotropic thickener without adversely effecting the generally high viscosities at low shear rates and lower viscosities at high shear rates which are characteristic of the desired thixotropic properties, wherein a minor amount of a fatty acid or salt thereof is incorporated into the aqueous suspension to increase the apparent viscosity of the formulation and to inhibit the settling of the suspended particles and to prevent phase separation.

In particular, the linear viscoelastic aqueous liquid automatic dishwasher detergent compositions of this invention will, at least in the preferred embodiments, satisfy each of the following stability criteria over the aging temperature-time schedule shown by the following Table A:

TABLE I

| Aging Temperature (°F.) | Duration (weeks) Minimum | Preferred |
|---|---|---|
| 140 | 1 | 2 |
| 120 | 6 | 8 |
| 100 | 13 | 16 |
| Ambient | 24 | 24 |

More specifically, the compositions are considered stable if each of the following stability criteria is satisfied for at least the minimum number of weeks for each aging temperature shown in Table I:

no visible phase separation (i.e. no solid/liquid separation)

no significant change (e.g. less than 10%) in viscosities, yield stress or other dynamic-mechanical properties no crystal growth, if not irreversible, under repeated heating-cooling cycles over a temperature range of at least 7° F. to 140° F.

no decolorization or significant color change

In addition to the above stability criteria, the compositions of this invention are further characterized by their low bottle residue. Specifically, for the preferred cross-linked polyacrylic acid thickened compositions of this invention, bottle residues, under the usual use conditions, will be no more than about 6 to 8%, preferably no more than about 4 to 5%, of the original bottle contents, on a weight basis.

According to another aspect the present invention there is provided a novel aqueous liquid automatic dishwasher detergent composition employing a polymeric thixotropic thickener or a mixture of a polymeric thixotropic thickener and an inorganic thixotropic thickener. The composition is characterized by its linear viscoelastic behavior, substantially indefinite stability against phase separation or settling of dissolved or suspended particles, low levels of bottle residue, relatively high bulk density, freedom from fish eyes, absence of crystal formulation and growth resistance to cup leakage, substantial absence of unbound or free water as compared to clay based formulations having high amounts of free water and a 3 dimensional structure of the polymeric formulations as compared to the two dimensional structures of clay formulations. This unique combination of properties is achieved by virtue of the incorporation into the aqueous mixture of dishwashing detergent surfactant, alkali metal detergent builder salt(s) and chlorine bleach compound, a small but effective amount of at least one high molecular weight cross-linked polyacrylic acid type thickening agent, a physical stabilizing amount of a long chain fatty acid or salt thereof, and optionally, a source of potassium ions to provide a potassium/sodium weight ratio in the range of from about 1:1 to about 45:1, such that substantially all of the detergent builder salts and other normally solid detergent additives present in the composition are present dissolved in the aqueous phase. The compositions are further characterized by a bulk density of at least about 1.32 g/cc, such that the density of the polymeric phase and the density of the aqueous (continuous) phase are approximately the same.

A still further object of the instant invention is to provide a non-phosphate composition containing an inorganic thixotropic thickener which can optionally include a polymeric thixotropic thickener.

These and other objects of the invention which will become more readily understood from the following detailed description of the invention and preferred embodiments thereof are achieved by incorporating in a normally gel-like aqueous liquid composition a small amount of a physical stabilizer which is a long chain fatty acid or salt thereof which increases the apparent viscosity of the formulation and inhibits settling of the suspended particles.

DETAILED DESCRIPTION OF THE INVENTION

The compositions of this invention are aqueous liquids containing various cleansing active ingredients, detergent adjuvants, structuring and thickening agents and stabilizing components, although some ingredients may serve more than one of these functions.

In accordance with this particular aspect, the present invention provides a normally gel-like aqueous automatic dishwasher detergent composition having thixotropic properties which include, on a weight basis:

(a) 5 to 35% of at least one inorganic phosphate builder salt such as an alkali metal tripolyphosphate;
(b) 2.5 to 20% sodium silicate;
(c) 0 to 9% alkali metal carbonate;
(d) 0 to 5% organic detergent active material;
(e) 0 to 5% chlorine bleach stable foam depressant;
(f) chlorine bleach compound in an amount to provide about 0.2 to 4% of available chlorine;
(g) thixotropic thickener, preferably an inorganic or organic thixotropic thickener, in an amount sufficient to provide the composition with thixotropy index of about 2.5 to 10; and
(h) 0 to 8% alkali metal hydroxide;
(i) a long chain fatty acid or salt thereof in an amount effective to increase apparent viscosity and the physical stability of the composition; and
(j) balance water, Most preferably, the total amount of (b) sodium silicate, (c) alkali metal carbonate and (d) alkali metal hydroxide providing a pH sufficiently high such that when the composition is diluted in an aqueous wash bath to provide a concentration of 10 grams per liter the pH of the aqueous wash bath becomes at least 11.2.

Also related to this specific aspect, the invention provides a method for cleaning dishware in an automatic dishwashing machine with an aqueous wash bath containing an effective amount of the liquid automatic dishwasher detergent (LADD) composition as described above. According to this aspect of the invention, the LADD composition can be readily poured into the dispensing cup of the automatic dishwashing machine and will thicken to its normal gel-like or pasty state to remain securely within the dispensing cup until shear forces are again applied thereto, such as by the water spray from the dishwashing machine.

The advantageous characteristics of the polymeric compositions of this invention made with a polymeric thickening agent, including physical stability, low bottle residue, high cleaning performance, e.g. low spotting and filming, dirt residue removal, and so on, and superior aesthetics, are believed to be attributed to several interrelated factors such as low solids, i.e. undissolved particulate content, product density and linear viscoelastic rheology. These factors are, in turn, dependent on several critical compositional components of the formulations, namely, (1) the inclusion of a thickening effective amount of at least one polymeric thickening agent having high water absorption capacity, exemplified by high molecular weight cross-linked polyacrylic acid, (2) inclusion of a physical stabilizing amount of a long chain fatty acid or salt thereof, (3) optionally, potassium ion to sodium ion weight ratio K/Na in the range of from about 1:1 to 45:1, especially from 1:1 to 3:1, and (4) a product bulk density of at least about 1.32 g/cc, such that the bulk density and liquid phase density are about the same, (5) maintaining the pH of the neutralized polymeric thickener at a pH of at least 11, preferably at least 11.5, and (6) that all the water in the composition is substantially bound to the polymeric thickening agent.

Accordingly, in one aspect the present invention provides an improved linear viscoelastic aqueous liquid automatic dishwasher detergent polymeric composition comprising water, up to about 2% by weight of long chain fatty acid or salt thereof, from about 0.1 to 5% by weight of low-foaming chlorine bleach stable, water dispersible automatic dishwasher non-soap organic detergent, from about 10 to 35 by weight of alkali metal detergent builder salt, from about 3 to 20% by weight of a chlorine bleach compound, and at least one cross-linked polycarboxylate thickening agent having a molecular weight of at least about 500,000. The compositions preferably have a bulk density of from about 1.28 $g/cm^3$ to about 1.42 $g/cm^3$. The aqueous phase may also include both sodium and potassium ions at a K/Na weight ratio of from about 1/1 to about 45/1.

In one of the preferred embodiment, the linear viscoelastic aqueous liquid automatic dishwasher polymeric detergent comprises, approximately, by weight, (a) 10 to 35% metal tripolyphosphate detergent builder such as sodium tripolyphosphate or potassium tripolyphosphate and mixtures thereof;
(b) 0 to 15% alkali metal silicate;
(c) 0 to 6% alkali metal hydroxide;
(d) 0.1 to 3% chlorine bleach stable, water-dispersible organic detergent active material;
(e) 0 to 1.5% chlorine bleach stable foam depressant;
(f) chlorine bleach compound in an amount to provide about 0.2 to 4% of available chlorine;
(g) 0.4 to 1.5% of at least one hydrophilic cross-linked water insoluble polycarboxylate thickening agent having a molecular weight of from 500,000 to 4,000,000 to provide said linear viscoelastic property;
(h) 0.08 to 0.4% of long chain fatty acid or a metal salt of a long chain fatty acid;
(i) 0 to 10% of a non-cross-linked polyacrylic acid having a molecular weight in the range of from about 800 to 200,000; and
(j) water which is substantially bound.

In another aspect of the invention, a novel method for preparing the aqueous linear viscoelastic composition is provided. According to this aspect, the method comprises the steps of I. (a) fully hydrating the cross-linked polycarboxylate thickener by slowly adding the thickener to heated water while moderately agitating the mixture,
(b) slowly adding a neutralizing amount of caustic soda to the mixture from (a) while continuing agitation to obtain a dispersion of the neutralized thickener;

II. (c) forming an aqueous mixture of surface active agents;
(d) heating the mixture in (c) to a temperature higher than that of the heated water in (a) and mixing until a homogeneous smooth premix is obtained;

III. (e) uniformly mixing alkali metal builder salts with the dispersion (b),
(f) uniformly mixing the heated premix (d) with the mixture (e),
(g) cooling the mixture (f) to a temperature above the temperature of the heated water in step (a), and
(h) adding bleach to the mixture (g).

In a preferred embodiment of the invention process, the pH of the aqueous slurry of the cross-linked polycarboxylate thickener after the neutralization in step (b) and in each succeeding step is maintained at a value of at least 11. Although for the reasons subsequently discussed excessive air bubbles are not often desirable in the invention compositions containing polymeric thickening agent, depending on the amounts of dissolved solids and liquid phase densities, incorporation of small amounts of finely divided air bubbles, generally up to about 10% by volume, preferably up to about 4% by volume, more preferably up to about 2% by volume, can be incorporated to adjust the bulk density to approximate liquid phase density. The incorporated air bubbles should be finely divided, such as up to about 100 microns in diameter, preferably from about 20 to about 40 microns in diameter, to assure maximum stability. Although air is the preferred gaseous medium for adjusting densities to improve physical stability of the composition other inert gases can also be used, such as nitrogen, carbon dioxide, helium, oxygen, etc.

The amount of water contained in these compositions should, of course, be neither so high as to produce unduly low viscosity and fluidity, nor so low as to produce unduly high viscosity and low flowability, linear viscoelastic properties in either case being diminished or destroyed by increasing tan 1. Such amount is readily determined by routine experimentation in any particular instance, generally ranging from 30 to 75 weight percent, preferably about 35 to 65 weight percent. The water should also be preferably deionized or softened.

The manner of formulating the invention compositions made with polymeric thickening agent is also important. As discussed above, the order of mixing the ingredients as well as the manner in which the mixing is performed will generally have a significant effect on the properties of the composition, and in particular on product density (by incorporation and stabilization of more or less air) and physical stability (e.g. phase separation). Thus, according to the preferred practice of this invention the compositions are prepared by first forming a dispersion of the polyacrylic acid-type thickener in water under moderate to high shear conditions, neutralizing the dissolved polymer to cause gelation, and then introducing, while continuing mixing, the detergent builder salts, alkali metal silicates, chlorine bleach compound and remaining detergent additives, including any previously unused alkali metal hydroxide, if any, other than the surface-active compounds. All of the additional ingredients can be added simultaneously or sequentially. Preferably, the ingredients are added sequentially, although it is not necessary to complete the addition of one ingredient before beginning to add the next ingredient. Furthermore, one or more of these ingredients can be divided into portions and added at different times. These mixing steps should also be performed under moderate to high shear rates to achieve complete and uniform mixing. These mixing steps may be carried out at room temperature, although the polymer thickener neutralization (gelation) is usually exothermic. The composition may be allowed to age, if necessary, to cause dissolved or dispersed air to dissipate out of the composition.

The remaining surface active ingredients, including the anti-foaming agent, organic detergent compound, and fatty acid or fatty acid salt stabilizer is post-added to the previously formed mixture in the form of an aqueous emulsion (using from about 1 to 10%, preferably from about 2 to 4% of the total water added to the composition other than water added as carrier for other ingredients or water of hydration) which is pre-heated to a temperature in the range of from about Tm+5 to Tm+20, preferably from about Tm to Tm−10, where Tm is the melting point temperature of the fatty acid. For the preferred stearic acid stabilizer the heating temperature is in the range of 50° to 70° C. However, if care is taken to avoid excessive air bubble incorporation during the gelation step or during the mixing of the detergent builder salts and other additives, for example, by operating under vacuum, or using low shearing conditions, or special mixing operations, etc., the order of addition of the surface active ingredients should be less important.

In accordance with an especially preferred embodiment, the thickened linear viscoelastic aqueous automatic dishwasher detergent composition containing polymeric thickening agent of this invention includes, on a weight basis:

(a) 10 to 35%, preferably 15 to 30%, alkali metal polyphosphate detergent builder;
(b) 5 to 15, preferably 8 to 12%, alkali metal silicate;
(c) 1 to 6%, preferably 1.2 to 4%, alkali metal hydroxide;
(d) 0.1 to 3%, preferably 0.5 to 2%, chlorine bleach stable, water-dispersible, low-foaming organic detergent active material, preferably non-soap anionic detergent;
(e) 0 to 1.5%, preferably 0.1 to 0.5%, chlorine bleach stable foam depressant;
(f) Chlorine bleach compound in an amount to provide about 0.2 to 4%, preferably 0.8 to 1.6%, of available chlorine;
(g) at least one high molecular weight hydrophilic cross-linked polyacrylic acid thickening agent in an amount to provide a linear viscoelasticity to the formulation, preferably from about 0.4 to 1.5%, more preferably from about 0.4 to 1.0%;
(h) a long chain fatty acid or a metal salt of a long chain fatty acid in an amount effective to increase the physical stability of the compositions, preferably from 0.08 to 0.4%, more preferably from 0.1 to 0.3%; and
(i) balance water, preferably from about 30 to 75%, more preferably from about 35 to 65%; and wherein in (a) the alkali metal polyphosphate includes optionally, a mixture of from about 5 to 30%, preferably from about 12 to 22% of tetrapotassium pyrophosphate, and from 0 to about 20%, preferably from about 3 to 18% of sodium tripolyphosphate, and wherein in the entire composition the optional ratio, by weight, of potassium ions to sodium ions is from about 1.05/1 to 3/1, preferably from 1.1/1 to 2.5/1, the compositions having an amount of air incorporated therein such that the bulk density of the composition is from about 1.32 to 1.42 g/cc$^3$, preferably from about 1.35 to 1.40 g/cc$^3$. A density of about 1.42 g/cc$^3$. is essentially equivalent to zero air content.

The compositions will be supplied to the consumer in suitable dispenser containers preferably formed of molded plastic, especially polyolefin plastic, and most preferably polyethylene, for which the invention compositions appear to have particularly favorable slip characteristics. In addition to their linear viscoelastic character, the compositions of this invention may also be characterized as pseudoplastic gels nonthixotropic as measured by dynamic rheological measurements (frequency sweep measurements) which is especially true in the case of compositions not containing fatty acid stabilizer. However, the instant polymeric compositions do have a thixotropic index (TI) of 2.5 to 10 as measured by a ratio of Brookfield viscosities at 30 rpm and 3 rpm, which are typically near the borderline between liquid and solid viscoelastic gel, depending, for example, on the amount of the polymeric thickener. The invention compositions can be readily poured from their containers without any shaking or squeezing, although squeezable containers are often convenient and accepted by the consumer for gel-like products.

A still further attribute of the polymeric compositions made with a polymeric thickening agent contributing to the overall product stability and low bottle residue is the high water absorption capacity of the cross-linked polyacrylic acid-type thickening agent. As a result of this high water absorption capacity virtually all of the aqueous vehicle component is held tightly bound to the polymer matrix. Therefore, there is no or substantially no free water present in the invention compositions. This absence of free water (as well as the cohesiveness of the composition) is manifested by the observation that when the composition is poured from a bottle onto a piece of water absorbent filter paper virtually no water is absorbed onto the filter paper and, furthermore, the mass of the linear viscoelastic material poured onto the filter paper will retain its shape and structure until it is again subjected to a stress or strain. As a result of the absence of unbound or free water, there is virtually no phase separation-between the aqueous phase and the polymeric matrix or dissolved solid particles. This characteristic is manifested by the fact that when the subject compositions are subjected to centrifugation, e.g. at 1000 rpm for 30 minutes, there is no phase separation and the composition remains homogeneous.

However, it has also been discovered that linear viscoelasticity and K/Na ratios in the above-mentioned range do not, by themselves, assure long term physical stability (as determined by phase separation). In order to maximize physical (phase) stability, the density of the composition should be controlled such that the bulk density of the liquid phase is approximately the same as the bulk density of the entire composition, including the polymeric thickening agent. This control and equalization of the densities is achieved, according to the invention, by providing the composition with a bulk density of at least 1.32 g/cc$^3$, preferably at least 1.35 g/cc$^3$, up to about 1.42 g/cc$^3$.

Furthermore, to achieve these relatively high bulk densities, it is important to minimize the amount of air incorporated into the composition (a density of about 1.42 g/cc is essentially equivalent to zero air content). Generally, LADD effectiveness is directly related to (a) available chlorine levels; (b) alkalinity; (c) solubility in washing medium; and (d) foam inhibition. It is preferred herein that the pH of the LADD composition be at least about 11.5. The presence of carbonate is also often needed herein, since it acts as a buffer helping to maintain the desired pH level. Excess carbonate is to be avoided, however, since it may cause the formation of needle-like crystals of carbonate, thereby impairing the stability, if not reversible, as well as impairing the dispensibility of the product from, for example, squeeze tube bottles. The alkali metal hydroxide such as caustic soda (NaOH) services the further function of neutralizing the phosphoric or phosphonic acid ester foam depressant when present. About 0.5 to 6 wt % of NaOH and about 2 to 9 wt % of sodium carbonate in the LADD composition are typical, although it should be noted that sufficient alkalinity may be provided by the alkali metal tripolyphosphate and sodium silicate.

In accordance with an especially preferred embodiment, the present invention provides a phosphate free aqueous automatic dishwasher detergent composition which is a solution and includes, approximately on a weight basis:

(a) 5 to 20% of a low molecular weight non-cross-linked polyacrylate polymer such as SOKALAN PA-30CL;
(b) 15 to 45% alkali metal silicate;
(c) 2 to 10.0% alkali metal carbonate;
(d) about 0 to about 10% alkali metal hydroxide;
(e) 0 to 5% chlorine bleach stable organic detergent active material;
(f) 0 to 1.5% stable foam depressant;
(g) chlorine bleach compound in an amount to provide about 0.2 to about 4% of available chlorine;
(h) 0.05 to 1.0%, more preferably 0.02 to 1.0% of a polyvalent or transition metal salt of a long chain fatty acid in an amount effective to increase the viscosity of the composition;
(i) 0 to 0.6% of a fatty acid;
(j) 0.1 to 5.0% of an inorganic thixotropic thickener;
(k) 0 to 1% of a polymeric thixotropic thickener; and
(l) 0 to 10% phosphonates;
(m) 0 to 10% of entrained air bubbles;
(n) the balance being water, wherein the ingredients (a) through (h) are dissolved in water and the total amount of (b) sodium silicate, (c) alkali metal carbonate and (d) alkali metal hydroxide provides a pH sufficiently high such that when the composition is diluted in an aqueous wash bath to provide a concentration of 10 grams per liter the pH of the aqueous wash bath becomes at least 11.2.

The alkali metal silicate such as sodium silicate or sodium disilicate, which provides alkalinity and protection of hard surfaces, such as fine china glaze and pattern, is employed in the phosphate free composition in an amount ranging from about 15 to 45 weight percent, preferably about 20 to 40 weight percent. The sodium silicate or sodium disilicate is generally added in the form of an aqueous solution, preferably having $Na_2O$:-$SiO_2$ ratio of about 1:1.3 to 1:2.8, especially preferably 1:2.0 to 1:2.6. At this point, it should be mentioned, especially NaOH and sodium hypochlorite, are also often added in the form of a preliminary prepared aqueous dispersion or solution.

The phosphate free liquid automatic dishwashing detergent composition contains about 2 to about 10% by weight of an alkali metal carbonate selected from the group consisting essentially of lithium carbonate, potassium carbonate and sodium carbonate and mixtures thereof, more preferably about 2 to about 8% by weight, and most preferably about 2 to about 5% by weight. Alkali metal gluconates and nitrolacetic acid salts can be used in conjunction with the alkali metal carbonates.

In conjunction with the sodium carbonate in the phosphate free composition is used a low molecular weight non-crosslinked polyacrylate polymer such as SOKALAN PA-30CL which is a chlorine resistant polyacrylate builder and is available from BASF under the tradename of SOKALAN PA-30CL. The use of the SOKALAN PA-30CL which is low molecular weight non-crosslinked polyacrylate in the instant composition is critical because of its effective resistance against degradation by the chlorine contained in the composition. Previously used low molecular polyacrylates such as Sokalan TM CP45 sold by BASF and Norasol LMW 45ND are not resistant to chlorine degradation and when used in a composition containing chlorine. They are not as effective as is the SOKALAN PA-30CL. Another improved chlorine resistant polyacrylate builder is Norasol QR1014 having a molecular weight of about 10,000.

Foam inhibition is important to increase dishwasher machine efficiency and minimize destabilizing effects which might occur due to the presence of excess foam within the washer during use. Foam may be sufficiently reduced by suitable selection of the type and/or amount of detergent active material, the main foam-producing component. The degree of foam is also somewhat dependent on the hardness of the wash water in the machine whereby suitable adjustment of the proportions of the inorganic or organic builder salt which has a water softening effect may aid in providing the desired degree of foam inhibition. However, it is generally preferred to include a chlorine bleach stable foam depressant or inhibitor. Particularly effective are the alkyl phosphoric acid esters of the formula:

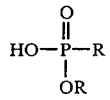

and especially the alkyl acid phosphate esters of the formula:

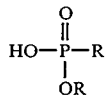

In the above formulas, one or both R groups in each type of ester may represent independently a $C_{12}$–$C_{20}$ alkyl or ethoxylated alkyl group. The ethoxylated derivative of each type of ester, for example, the condensation products of one mole of ester with from 1 to 10 moles, preferably 2 to 6 moles, more preferably 3 or 4 moles, ethylene oxide can also be used. Some examples of the foregoing are commercially available, such as the products SAP from Hooker and LPKN-158 from Knapsack. Mixtures of the two types, or any other chlorine bleach stable types, or mixtures of mono- and diesters of the same type, may be employed. Especially preferred is a mixture of mono- and di- $C_{16}$–$C_{18}$ alkyl acid or ethoxylated alkyl phosphate esters such as monostearyl/distearyl acid phosphate 1.2/1, and the 3 to 4 mole ethylene oxide condensates thereof. When employed, proportions of 0 to 1.5 weight percent, preferably 0.1 to 1.0 weight percent, of foam depressant in the phosphate free composition is typical. Other defoamers which may be used include, for example, the known silicones, such as available from Dow Chemicals. In addition, it is an advantageous feature of this invention that many of the stabilizing salts, such as the stearate salts, for example, sodium stearate, are also effective as foam killers.

Although any chlorine bleach compound may be employed in the phosphate free compositions of this invention, such as dichloroisocyanurate, dichlorodimethyl handantoin, or chlorinated TSP, alkali metal or alkaline earth metal, e.g. potassium, lithium, magnesium and especially sodium, hypochlorite is preferred. The composition should contain sufficient chlorine bleach compound to provide about 0.75 to about 2.0% by weight of available chlorine, as determined, for example, by acidification of 100 parts of the composition with excess hydrochloric acid. A solution containing about 0.15 to 15.5% by weight of sodium hypochlorite (13% of available chlorine) contains or provides roughly the same percentage of available chlorine. About 0.8 to 1.6% by weight of available chlorine is especially preferred.

Detergent active material which may be, useful herein in the phosphate free compositions must be stable in the presence of chlorine bleach, especially hypochlorite bleach, and those of the organic anionic, amine oxide, phosphine oxide, sulphoxide or betaine water. Dispersible surfactant types are preferred; the first mentioned anionics being most preferred. They are used in amounts ranging from about 0 to 5%, preferably about 0.1 to 5.0%. Particularly preferred surfactants herein are the linear or branched alkali metal mono- and/or di-($C_8$–$C_{14}$) alkyl diphenyl oxide disulphonated, commercially available for example as DOWFAX TM 3B-2 and DOWFAX TM 2A-1. Alkyl ether esters ($C_{12}$–$C_{14}$ 3EO $SO_3$-$N_a$+) are also useful surfactants. In addition, the surfactant should be compatible with the other ingredients of the composition. Other suitable surfactants include the primary alkylsulphates, alkylsulphonates, alkylarylsulphonates and sec.-alkylsulphates. Examples include sodium $C_{10}$–$C_{18}$ alkylsulphates such as sodium dodecylsulphate and sodium tallow alcoholsulphate; sodium $C_{10}$–$C_{18}$ alkanesulphonates such as sodium hexadecyl-1-sulphonate and sodium $C_{12}$–$C_{18}$ alkylbenzenesulphonates such as sodium dodecylbenzenesulphonates. The corresponding potassium salts may also be employed.

As other suitable surfactants or detergents, the amine oxide surfactants are typically of the structure $R_2R_1N\rightarrow O$, in which each R represents a lower alkyl group, for instance, methyl, and $R_1$ represents a long chain alkyl group having from 8 to 22 carbon atoms, for instance a lauryl, myristyl, palmityl or cetyl group. Instead of an amine oxide, a corresponding surfactant phosphine oxide $R_3R_2R_1PO$ or sulphoxide $RR_1SO$ can be employed. Betaine surfactants are typically of the structure $R_2R_1N\leftarrow R''COO$—, in which each R represents a lower alkylene group having from 1 to 5 carbon atoms. Specific examples of these surfactants include lauryl-dimethylamine oxide, myristyl-dimethylamine oxide, the corresponding phosphine oxides and sulphoxides, and the corresponding betaines, including dodecyldimethylammonium acetate, tetradecyldiethylammonium pentanoate, hexadecyldimethylammonium hexanoate and the like. For biodegradability, the alkyl groups in these surfactants should be linear, and such compounds are preferred.

Surfactants of the foregoing type, all well-known in the art, are described, for example, in U.S. Pat. Nos. 3,985,668 and 4,271,030.

The preferred polyvalent or transition metal salts of the long chain fatty acids are the higher aliphatic fatty acids having from about 8 to 20 carbon atoms, more preferably from about 10 to 20 carbon atoms, and especially preferably from about 12 to 18 carbon atoms, inclusive of the carbon atom of the carboxyl group of the fatty acid. The aliphatic radical may be saturated or unsaturated and may be straight or branched. Straight chain saturated fatty acids are preferred. Mixtures of fatty acids may be used, such as those derived from natural sources such as tallow fatty acid, coco fatty acid, soya fatty acid, etc., or from synthetic sources available from industrial manufacturing processes such as mixtures of stearic acid and palmitic acid.

Thus, examples of the fatty acids from which the polyvalent or transition metal salt stabilizers can be formed include, for example, decanoic acid, dodecanoic acid, palmitic acid, myristic acid, stearic acid, isostearic, oleic acid, eicosanoic acid, tallow acid, coco fatty acid, soya fatty acid, mixtures of these acids, etc. Stearic acid and mixed fatty acids are preferred. The preferred metals are the alkali metals of Group IIIA, wherein aluminum is especially preferred.

The amount of the polyvalent or transition metal fatty acid salt thickener to achieve the desired enhancement of viscosity will depend on such factors as the nature of the fatty acid salt, the nature and amount of the detergent active compound, inorganic salts and other LADD ingredients, as well the synergistic reaction between, the fatty acid and the polyacrylate builder.

Other conventional ingredients may be included in these phosphate free compositions in small amounts, generally less than about 3 weight percent, such as perfume, preservatives, dyestuffs and pigments and the like, all of course being stable to chlorine bleach compound and high alkalinity (properties of all components). Especially preferred for coloring are the chlorinated phthalocyanines and polysulphides of aluminosilicate which provide, respectively, pleasing green and blue tints.

The inorganic thixotropic thickeners used in the phosphate free compositions are identical to those previously described inorganic thixotropic thickeners which can be used in the phosphate containing compositions. The inorganic thixotropic thickeners used it the phosphate free systems are used at a concentration level of about 0.1 to 5.0 weight percent and more preferably at a concentration of about 0.2 to 3.0 weight percent. The polymeric thixotropic thickeners which can be optionally used in conjunction with the inorganic thixotropic thickeners in the phosphate free compositions are identical to those previously described polymeric thixotropic thickeners which can be used in the phosphate containing compositions. The polymeric thixotropic thickeners used in the phosphate free systems are used at a concentration level of 0 to about 1 weight percent and more preferably about 0.01 to 0.5 weight percent.

The inorganic builder salt such as sodium tripolyphosphate (NaTPP) or potassium tripolyphosphate (KTPP) is employed in the phosphate containing LADD composition in a range of about 8 to 35 wt %, preferably about 20 to 30 wt %, should preferably be free of heavy metals which tends to decompose or inactivate the preferred sodium hypochlorite and other chlorine bleach compounds. The NaTPP may be anhydrous or hydrated, including the stable hexahydrate with a degree of hydration of 6 corresponding to about 18% by weight of water or more. Especially preferred LADD compositions are obtained, for example, when using a 0.5:1 to 2:1 weight ratio of anhydrous to hexahydrated NaTPP, values of about 1:1 being particularly preferred potassium tripolyphosphate can be employed alone or in combination with the sodium tripolyphosphate as an inorganic builder salt. Other useful builder salts are potassium-hexametaphosphate, potassium pyrophosphate, sodium citrate and sodium carbonate which can be used alone or in combination with sodium tripolyphosphate and/or potassium tripolyphosphate. Examples of preferred phosphate builders are Thermophos NW and Thermophos N Hexahydrate sold by Knapsack.

In addition to or in place of part or all of the NaTPP detergency builder, other phosphorus or non-phosphorus inorganic or organic detergency builder salts can also be used in the composition. Examples of suitable detergency builders-sequestrants include, for instance, trisodium nitrilotriacetate, tetrasodiumethylenediamine tetraacetate, sodium citrate, and the corresponding potassium salts. Tetrapotassium or tetrasodium pyrophosphate can also be used. However, sodium tripolyphosphate is highly preferred where phosphorus-containing detergents are permitted.

In one embodiment with the present invention, the detergent builder salts can comprise mixtures of at least potassium tripolyphosphate (KTPP) and sodium tripolyphosphate (NaTPP) (especially hexahydrate). Typical ratios of KTPP to NaTPP are from about 1.4:1 to 10:1, especially from about 2:1 to 8:1. The total amount of detergent builder salts is preferably from about 10 to 35% by weight, more preferably from about 15 to 35%, especially from about 18 to 30% by weight of the composition.

Also contributing to the physical stability and low bottle residue of the invention compositions made with polymeric thickening agent is the optional use of high potassium to sodium ion ratios in the range of 1:1 to 45:1, preferably 1:1 to 4:1, especially preferably from 1.05:1 to 3:1, for example 1.1:1, 1.2:1, 1.5:1, 2:1 or 2.5:1. At these ratios the solubility of the solid salt components, such as detergent builder salts, bleach, alkali metal silicates, and the like, is substantially increased since the presence of the potassium ($K^+$) ions requires less water of hydration than the sodium ($Na^+$) ions, such that more water is available to dissolve these salt compounds. Therefore, all or nearly all of the normally solid components are present dissolved in the aqueous phase. Since there is none or only a very low percentage, i.e. less than 5%, preferably less than 3% by weight, of suspended solids present in the formulation there is no or only reduced tendency for undissolved particles to settle out of the compositions causing, for example, formation of hard masses of particles, which could result in high bottle residues (i.e. loss of product). Furthermore, any undissolved solids tend to be present in extremely small particle sizes, usually colloidal or sub-colloidal, such as 1 micron or less, thereby further reducing the tendency for the undissolved particles to settle.

The compositions of this invention optionally include sufficient amount of potassium ions and sodium ions to provide a weight ratio of K/Na of at least 1:1, preferably from 1:1 to 45:1, especially from about 1:1 to 3:1, more preferably from 1.05:1 to 3:1, such as 1.5:1, or 2:1. When the K/Na ratio is less than 1 there is insufficient solubility of the normally solid ingredients to form a highly translucent product whereas when the K/Na ratio is more than 45, especially when it is greater than about 3, the product has a tendency to become too liquid and phase separation could begin to occur. When the K/Na ratios become much larger than 45, such as in an all or mostly potassium formulation, the polymer thickener could lose its absorption capacity and could begin to salt out of the aqueous phase.

The potassium and sodium ions can be made present in the compositions as the alkali metal cation of the detergent builder salt(s), or alkali metal silicate or alkali metal hydroxide components of the compositions. The alkali metal cation may also be present in the compositions as a component of anionic detergent, bleach or other ionizable salt compound additive, e.g. alkali metal carbonate. In determining the K/Na weight ratios all of these sources should be taken into consideration.

Specific examples of detergent builder salts include the polyphosphates, such as alkali metal pyrophosphate, alkali metal tripolyphosphate, alkali metal metaphosphate, and the like, for example, sodium or potassium tripolyphosphate (hydrated or anhydrous), tetrasodium or tetrapotassium pyrophosphate, sodium or potassium hexa-metaphosphate, trisodium or tripotassium orthophosphate and the like, sodium or potassium carbonate, sodium or potassium citrate, sodium or potassium nitrilotriacetate, and the like. The phosphate builders, where not precluded due to local regulations, are preferred and mixtures of tetrapotassium pyrophosphate (TKPP) and sodium tripolyphosphate (NaTPP) (especially the hexadydrate) are especially preferred. Typical ratios of NaTPP to TKPP are from about 2:1 to 1:8, especially from about 1:1.1 to 1:6. The total amount of detergent builder salts is preferably from about 5 to 35% by weight, more preferably from about 15 to 35%, especially from about 18 to 30% by weight of the composition.

Foam inhibition is important to increase dishwasher machine efficiency and minimize destabilizing effects which might occur due to the presence of excess foam within the washer during use. Foam may be sufficiently reduced by suitable selection of the type and/or amount of detergent active material, the main foam-producing component. The degree of foam is also somewhat dependent on the hardness of the wash water in the machine whereby suitable adjustment of the proportions of NaTPP which has a water softening effect may aid in providing the desired degree of foam inhibition. However, there may optimally be included a chlorine bleach stable foam depressant or inhibitor where a low foam LADD is desired. Particularly effective are the alkyl phosphoric acid esters of the formula

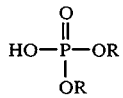

available, for example, from Hooker (SAP), Atochem Inc. (formerly PCUK) and Knapsack (LPKn-158), in which one or both R groups may represent independently a $C_{12-20}$ alkyl or ethoxylated alkyl group. Mixtures of the two types, or any other chlorine bleach stable types, or mixtures of mono-and di-esters of the same type may be employed. Especially preferred is a mixture of mono and di-$C_{16-18}$ alkyl acid phosphate esters such as monostearyl/distearyl acid phosphates 1.2/1 (Knapsack) or 4/1 (UGINE KULH-PLAN). When employed, proportions of 0.1 to 0.5 wt %, of foam depressant in the composition is typical, the weight ratio of detergent active component (d) to foam depressant (e) generally ranging from about 10:1 to 1:1 and preferably about 5:1 to 1:1. In addition, it is an advantageous feature of this invention that many of the stabilizing long chain fatty acids, such as stearic acid and behenic acid also act as foam killer depressants.

Although any chlorine bleach compound may be optionally employed in the compositions of this invention, such as chlorinated TSP, alkali metal, e.g. potassium, lithium, magnesium and especially sodium, hypochlorite is preferred. The composition should contain sufficient chlorine bleach compound to provide about 0.15 to 2.0% by weight of available chlorine, as determined for example, by acidification of 100 parts of the composition with excess of hydrochloric acid. A solution containing about 0.15 to 2.0% by weight of sodium hypochlorite contains or provides roughly the same percentage of available chlorine. About 0.8 to 1.6% by weight of available chlorine is especially preferred. For example, sodium hypochlorite (NaOCl) solution of from about 11 to about 14% available chlorine in amounts of about 3 to 20%, preferably about 7 to 12%, can be advantageously used.

The alkali metal silicate such as potassium silicate or sodium silicate, which provides alkalinity and protection of hard surfaces, such as fine china glaze and pattern, is employed in an amount ranging from about 2.5 to 30 wt %, preferably about 5 to 25 wt %, in the composition. The sodium silicate is generally added in the form of an aqueous solution, preferably having an $Na_2O:SiO_2$ ratio of about 1:2 to 1:2:8.

In accordance with the present invention the types and amounts of the alkaline components are chosen so that when the composition is added to an aqueous wash bath to provide a concentration of 10 grams of composition per liter of wash bath the pH of the wash bath becomes at least 11.2, preferably at least 11.5, such as from 11.5 to 13.5, preferably at least 11.5 to 12.5. By operating at these high than normal alkalinity levels the cleaning performance is improved and at the same time the rheological properties, and particularly, physical stability, are also improved because of the increased alkalinity reserve of the composition due to the increase concentration of the basic components in the composition. Furthermore, in the preferred embodiment in which a chlorine bleach compound is included in the LADD composition, the additional benefit of reduction of loss of active chlorine is also obtained.

Detergent active material useful herein must be stable in the presence of chlorine bleach, especially hypochlorite bleach, and those of the organic aromatic anionic, organic aliphatic anionic, amine oxide, phosphine oxide, sulphoxide or betaine water dispersible surfactant types can be used, the first mentioned anionics being most preferred. They are used in amounts ranging from about 0 to 5%, preferably about 0.3 to 2.0%. Particularly preferred surfactants herein are the alkali metal di-($C_{8-14}$) alkyl diphenyl oxide disulfonates commercially available for example as DOWFAX (Registered Trademark) 3B-2 and DOWFAX 2A-1. In addition, the surfactant should be compatible with the other ingredients of the composition. Other suitable surfactants include the primary alkylsulphates, alkylsulphonates, alkylarylsulphonates and sec.-alkylsulphates. Examples include sodium $C_{10}$–$C_{18}$ alkanesulphonates such as sodium dodecylsulphate and sodium tallow alcoholsulphate; sodium $C_{10}$–$C_{18}$ hexadecyl-1-sulphonate and sodium $C_{12}$–$C_{18}$ alkanesulphonates such as sodium alkylbenzenesulphonates and sodium dodecylbenzenesulphonates. Sodium benzoate may also be used. The corresponding potassium salts may also be employed.

As other suitable surfactants or detergents, the amine oxide surfactants are typically of the structure $R_2R_1N$—R'COO—, in which each R represents a lower alkylene group having from 1 to 5 carbon atoms. Specific examples of these surfactants are lauryl-dimethylamine oxide, myristyldimethylamine oxide, the corresponding phosphine oxides and sulphoxides, and the corresponding betaines, including dodecyldimethylammonium acetate, tetradecyldiethylammonium pentanoate, hexadecyldimethylammonium hexanoate and the like. For biodegradability, the alkyl groups in these surfactants should be linear, an such compounds are preferred. Surfactants of the foregoing type, all well known in the art, are described, for example, in U.S. Pat. Nos. 3,985,668 and 4,271,030.

Thixotropic thickeners, i.e. thickeners or suspending agents which provide an aqueous medium with thixotropic properties, are known in the art and may be organic or inorganic water soluble, water dispersible or colloid-forming, and monomeric or polymeric as for example polycarboxylate thickener polymers exemplified in prior art U.S. Pat. No. 4,226,736 and U.S. Pat. No. 3,996,152 and should of course be stable in these compositions, e.g. stable to high alkalinity and chlorine bleach compounds, such as sodium hypochlorite. Those especially preferred generally comprise the inorganic, colloid-forming clays of smectite and or attapulgite types. These materials were generally used in amounts of about 1.0 to 10, preferably 1.2 to 5 wt %, to confer the desired thixotropic properties and Bingham plastic character in the assignee's prior disclosed LADD formulations of the aforementioned GB No. 2,116,199A and GB No. 2,140,450A. It is one of the advantages of the clay LADD formulations of the present invention that the desired thixotropic properties and Bingham plastic character can be obtained in the presence of the fatty acid stabilizers with lesser amounts of the thixotropic thickeners. For example, amounts of the inorganic colloid-forming clays of the smectite and/or attapulgite types in the range of from about 0.1 to 3%, preferably 0.1 to 2.5%, especially 0.1 to 2%, are generally sufficient to achieve the desired thixotropic properties and Bingham plastic character when used in combination with the physical stabilizer.

Smectite clays include montmorillonite (bentonite), hectorite, attapulgite, smectite, saponite, and the like. Monmorillonite clays are preferred and are available under tradenames such as Thixogel (Registered Trademark) No. 1 and Gelwhite (Registered Trademark) GP, H, etc., from Georgia Kaolin Company; ECCAGUM (Registered Trademark) GP, H, etc., from Luthern Clay Products; and Vasagel AP (Registered Trademark) from Sud Chemie. Attapulgite clays include the materials commercially available under the tradename Attagel (Registered Trademark), i.e. Attagel 40, Attagel 50 and Attagel 150 from Engelhard Minerals and Chemicals Corporation. Mixtures of smectite and attapulgite types in weight ratios of 4:1 to 1:5 are also useful herein. Thickening or suspending agents of the foregoing types are well known in the art, being described, for example, in U.S. Pat. No. 3,985,668 referred to above.

Abrasives or polishing agents should be avoided in the LADD compositions as they may mar the surface of fine dishware, crystal and the like.

The polymeric thixotropic thickeners of the instant invention can be used in conjunction with the clay thixotropic thickeners but are preferably used alone. The polymeric thixotropic thickener is preferably a polycarboxylate polymer having a molecular weight of about 500,000 to about 4,000,000, but the polymeric thickener can be a water soluble or water dispersible sulfonated polystyrene polymer or a hydrophobic/hydrophilic copolymer such as copolymer of polyacrylic acid and as dialkylacrylamide. The polycarboxylate polymers are disclosed in U.S. Pat. No. 2,798,053, issued on Jul. 2, 1957, which is hereby incorporated by reference.

Exemplary of the polycarboxylate type thickening agents are cross-linked polyacrylic acid-type thickening agents sold by B. F. Goodrich under their Carbopol trademark, including both the 900 series resins, especially Carbopol 941, which is the most ion-insensitive of this class of polymers, and Carbopol 940 and Carbopol 934, and the 600 series resins, especially Carbopol 614. It is also contemplated within the scope of this invention that mixtures of Carbopol resins can be used. The Carbopol 600 and 900 series resins are hydrophilic high molecular weight, cross-linked linear acrylic acid polymers having an average equivalent weight of 76, and the general structure illustrated by the following formulas:

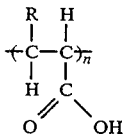

wherein R can be hydrogen or an alkyl chain. Carbopol 941 has a molecular weight of about 1,250,000; Carbopol 940 has a molecular weight of approximately 3,000,000. The Carbopol 900 series resins are essentially linear copolymers which are highly branch chained and highly cross-linked with polyalkenyl polyether, e.g. about 1% of a polyalkyl ether of sucrose having an average of about 5.8 allyl groups for each molecule of sucrose. The preparation of this class of cross-linked carboxylic polymers is described in U.S. Pat. No. 2,798,053, the disclosure of which is incorporated by reference. Further detailed information on the Carbopol 900 series resins is available from B. F. Goodrich, see, for example, the B. F. Goodrich catalog GC-67, Carbopol (Registered Trademark) Water Soluble Resins.

In general, these thickening resins are preferably copolymers of a water dispersible copolymer of an alpha-beta monoethylenically unsaturated lower aliphatic carboxylic acid cross-linked with a polyether of a polyol selected from oligo saccharides, reduced derivatives thereof in which the carbonyl group is converted to an alcohol group and pentaerythritol, the hydroxyl groups of the polyol which are modified being etherified with allyl groups, there being preferably at least two such allyl groups per molecule. Other useful contemplated polymeric thickening agents are water soluble ionic polymers such as sulfonated polymers and complexes thereof with an amine containing copolymer.

More recently, B. F. Goodrich has introduced the Carbopol (Registered Trademark) 600 series resin. These are high molecular weight, non-linear moderate branched chain polyacrylic acid cross-linked with polyalkenyl ether. In addition to the non-linear or branched nature of these resins, they are also believed to be more highly cross-linked than the 900 series resins and have molecular weights between about 1,000,000 and 4,000,000.

Most especially useful of the Carbopol 600 series resins is Carbopol 614 which is the most chlorine bleach stable of this class of thickening resins. Carbopol (Registered Trademark) 614 is also highly stable in the high alkalinity environment of the preferred liquid automatic dishwasher detergent compositions and is also highly stable to any anticipated storage temperature conditions from below freezing to elevated temperatures as high as 120° F., preferably 140° F., and especially 160° F., for periods of as long as several days to several weeks or months or longer.

While the most favorable results have now been achieved with Carbopol 614 moderate branched chain polyacrylic resin, other branched cross-linked polycarboxylate-type thickening agents can also be used in the compositions of this invention. As used herein "polycarboxylate-type" refers to water-soluble carboxyvinyl polymers of alpha, beta monoethylenically unsaturated lower aliphatic carboxylic acids, which may be linear or non-linear, and are exemplified by homopolymers of acrylic acid or methacrylic acid or water-dispersible or water-soluble salts, esters or amides thereof, or water-soluble copolymers of these acids or their salts, esters or amides with each other or with one or more other ethylenically unsaturated monomers, such as, for example, styrene, maleic acid, maleic anhydride, 2-hydroxethylacrylate, acrylonitrile, vinyl acetate, ethylene, propylene, and the like, and which have molecular weights of from about 500,000 to 10,000,000 and are cross-linked or interpolymerized with a multi-vinyl or multi-allylic functionalized cross-linking agent, especially with a polyhydric compound. It is fully contemplated within the scope of this invention that mixtures of the Carbopol 900 Series and the Carbopol 600 Series can be employed in the formulations.

These homopolymers or copolymers are characterized by their high molecular weight, in the range of from about 500,000, especially from about 1,000,000 to 4,000,000, and by their water solubility, generally at least to an extent of up to about 5% by weight, or more, in water at 25° C.

The thickening agents are used in their cross-linked form, wherein the cross-linking may be accomplished by means known in the polymer arts, as by irradiation, or, preferably, by the incorporation into the monomer mixture to be polymerized of known chemical cross-linking monomer mixture to be polymerized of known chemical cross-linking monomeric agents, typically polyunsaturated (e.g. diethylenically unsaturated) monomers, such as, for example, divinylbenzene, divinylether of diethylene glycol, N,N'-methylenebisacrylamide, polyalkenylpolyethers (such as described above), and the like. Typically, amounts of cross-linking agent to be incorporated in the final polymer may range from about 0.01 to about 5 percent, preferably from about 0.05 to about 2 percent, and especially, preferably form about 0.1 to about 1.5 percent, by weight of cross-linking agent to weight of total polymer. Generally, those skilled in the art will recognize that the degree of cross-linking should be sufficient to impart some coiling of the otherwise generally linear or non-linear polymeric compound while maintaining the cross-linked polymer at least water dispersible and highly water-swellable in an ionic aqueous medium.

It is also understood that the water-swelling of the polymer which provides the desired thickening and viscous properties generally depends on one or two mechanisms, namely, conversion of the acid group containing polymers to the corresponding salts, e.g. sodium, generating negative charges along the polymer backbone, thereby causing the coiled molecules to expand and thicken the aqueous solution; or by formation of hydrogen bonds, for example, between the carboxyl groups of the polymer and hydroxyl donor. The former mechanism is especially important in the present invention, and therefore, the preferred polyacrylic acid-type thickening agents will contain free carboxylic acid (COOH) groups along the polymer backbone. Also, it will be understood that the degree of cross-linking should not be so high as to render the cross-linked polymer completely insoluble or non-dispersible in water or inhibit or prevent the uncoiling of the polymer molecules in the presence of the ionic aqueous system.

The amount of at least one high molecular weight, cross-linked polymeric acid or other high molecular weight, hydrophilic cross-linked polycarboxylate thickening agent used to impart the desired rheological property of linear viscoelasticity will generally be in the range of from about 0.1 to 3.0%, preferably from about 0.1 to 2.5%, by weight, based on the weight of the composition, although the amount will depend on the particular cross-linking agent, ionic strength of the composition, hydroxyl donors and the like.

The polymeric thickening agents contribute to the linear viscoelastic rheology of the invention compositions. As used herein, "linear viscoelastic "or" linear viscoelasticity" means that the elastic (storage) moduli (G') and the viscous (loss) moduli (G") are both substantially independent of strain, at least in an applied strain range of from 0–50%, and preferably over an applied strain range of from 0 to 80%. More specifically, a composition is considered to be linear viscoelastic for purposes of this invention, if over the strain range of 0–50% the elastic moduli G' has a minimum value of 100 dynes/sq.cm., preferably at least 250 dynes/sq.cm., and varies less than about 500 dynes/sq.cm., preferably less than 300 dynes/sq.cm., especially preferably less than 100 dynes/sq.cm. Preferably, the minimum value of G' and maximum variation of G' applies over the strain range of 0 to 80%. Typically, the variation in loss moduli G" will be less than that of G'. As a further characteristic of the preferred linear viscoelastic compositions the ratio of G"/G' (tanδ) is less than 1, preferably less than 0.8, but more than 0.05, preferably more than 0.2, at least over the strain range of 0 to 50%, and preferably over the strain range of 0 to 80%. It should be noted in this regard that % strain is shear strain×100.

By way of further explanation, the elastic (storage modulus G' is a measure of the energy stored and retrieved when a strain is applied to the composition while viscous (loss) modulus G" is a measure of the amount of energy dissipated as heat when strain is applied. Therefore, a value of tanδ, $$0.05 < \tan\delta < 1,$$

preferably $$0.2 < \tan\delta < 0.8$$

means that the compositions will retain sufficient energy when a stress or strain is applied, at least over the extent expected to be encountered for products of this type, for example, when poured from or shaken in the bottle, or stored in the dishwasher detergent dispenser cup of an automatic dishwashing machine, to return to its previous condition when the stress or strain is removed. The compositions with tan values in these ranges, therefore, will also have a high cohesive property, namely, when a shear or strain is applied to a portion of the composition to cause it to flow, the surrounding portions will follow. As a result of this cohesiveness of the subject linear viscoelastic compositions, the compositions will readily flow uniformly and homogeneously from a bottle when the bottle is tilted, thereby contributing to the physical (phase) stability of the formulation and the low bottle residue (low product loss in the bottle) which characterizes the invention compositions. The linear viscoelastic property also contributes to improved physical stability against phase separation of any undissolved suspended particles by providing a resistance to movement of the particles due to the strain exerted by a particle on the surrounding fluid medium.

In conjunction with the polycarboxylate polymeric thixotropic thickener in either phosphate or nonphosphate composition can be used a low molecular weight polymeric thixotropic thickener such as polyacrylic acid polymers and salts thereof. The polyacrylic acid polymers and salts thereof that can be used comprise water soluble low molecular weight polymers having the formula:

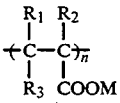

wherein the $R_1$, $R_2$ and $R_3$ can be the same or different and can be hydrogen, $C_1$–$C_4$ lower alkyl, or combinations thereof. The value of n is 5 to 1000, preferably, 10 to 500, and more preferably 20 to 100. M represents hydrogen, or an alkali metal such as sodium or potassium. The preferred substituent for M is sodium.

The preferred $R_1$, $R_2$ and $R_3$ groups are hydrogen, methyl, ethyl and propyl. Preferred acrylic acid monomer is one where $R_1$ to $R_3$ are hydrogen, e.g. acrylic acid, or where $R_1$ and $R_3$ are hydrogen and $R_2$ is methyl, e.g. methyl acrylic acid monomer.

The degree of polymerization, i.e. the value of n, is generally determined by the limit compatible with the solubility of the polymer in water. The terminal or end groups of the polymer are not critical and can be H, OH, $CH_3$ or a low molecular weight hydrocarbon.

The low molecular, non-crosslinked polyacrylic acid polymers and salts thereof can have a molecular weight of 500 or 1,000 to 200,000, preferably 1,500 to 50,000 and especially preferably 2,000 to 10,000.

Specific polyacrylic acid polymers which can be used include the Acrysol LMW acrylic acid polymers from Rohm and Haas, such as the Acrysol LMW,45N, a neutralized sodium salt, which has a molecular weight of about 4,500 and Acrysol LMW-20NX, a neutralized sodium salt, which has a molecular weight of about 2,000. Other polyacrylic acid polymers or salts thereof that can be used are: Alcosperse 149, molecular weight 2000, Alcosperse 123, molecular weight 4500, Alcosperse 107, molecular weight 3000, Alcosperse 124, molecular weight 2000, and Alcosperse 602N molecular weight 4500, all of which are available from Alco Chemical Corp. The low molecular weight acrylic acid polymers can, for example, have a molecular weight of about 1,000 to 10,000. Another polyacrylic acid polymer that can be used is Alcosperse 110 (from Alco) which is a sodium salt of an organic polycarboxylate and which has a molecular weight of about 100,000.

The above non-crosslinked polyacrylic acid polymers and salts thereof can be made using procedures known in the art, see for example U.S. Pat. No. 4,203,858, herein incorporated by reference.

Generally, the amounts of the non-crosslinked polyacrylic acid polymer or salt anti-spotting agent that can be used are in the range of from about 0 to 12%, preferably from about 0.5 to 4%, especially preferably about 0.75 to 3%.

The amount of water contained in these compositions should, of course, be neither so high as to produce unduly low viscosity and high fluidity, nor so low as to produce unduly high viscosity and low flowability, thixotropic properties in either case being diminished or destroyed. Such amount is readily determined by routine experimentation in any particular instance, generally ranging from about 30 to 75 wt %, preferably about 35 to 65 wt %. The water should also be preferably deionized or softened.

The LADD products of the prior U.K. patent application GB No. 2,116,199A and GB No. 2,140,450 exhibit improved rheological properties as evaluated by testing product viscosity as a function of shear rate. The compositions exhibited higher viscosity at a low shear rate and lower viscosity at a high shear rate, the data indicating efficient fluidization and gelation well within the shear rates extant within the standard dishwasher machine. In practical terms, this means improved pouring and processing characteristics as well as less leaking in the machine dispenser-cup, compared to prior liquor or gel ADD products. For applied shear rates corresponding to 3 to 30 rpm, viscosities (Brookfield) correspondingly ranged from about 10,000 to 50,000 cps to about 3,000 to 7,000 cps, as measured at room temperature by means of an LVT Brookfield viscometer after 3 minutes using a No. 4 spindle. A shear rate of 7.4 $sec^{-1}$ corresponds to a spindle rpm of about 3. An approximate ten-fold increase in shear rate produces about a 3- to 9-fold reduction in viscosity.

With prior ADD gels, the corresponding reduction in viscosity was only about two-fold. Moreover, with such compositions, the initial viscosity taken at about 3 rpm was only about 2,500 to 2,700 cps. The compositions of the assignee's prior invention thus exhibit threshold fluidizations at lower shear rates and of significantly greater extent in terms of incremental increases in shear rate versus incremental decrease in viscosity. This property of the LADD products of the prior invention is summarized in terms of a thixotropic index (TI) which is the ratio of the apparent viscosity at 3 rpm and at 30 rpm. The prior compositions have a TI of from 2 to 10. The LADD compositions tested exhibited substantial and quick return to prior quiescent state consistency when the shear force was discontinued.

The present invention is based upon the discovery that the physical stability, i.e. resistance to phase separation, settling, etc., of the U.K. patent applications GB No. 2,116,199A and GB No. 2,140,450 and the U.S. Pat. No. 4,752,409 liquid aqueous ADD compositions can be significantly improved or not adversely affected while at the same time significantly increasing the apparent viscosity and improving the physical stability of the formulations and at lower cost, by adding to the composition a small amount of a fatty acid anion moiety such as a (RCOO—) wherein R is about $C_8$ to about $C_{24}$ such as a salt of a long chain fatty acid or a long chain fatty acid which can form an alkali metal salt of the fatty acid in situ in the composition.

As an example of the improvement in rheological properties, it has been found that the viscosities at low shear rates, e.g. with a #4 spindle at a spindle rpm of about 3, apparent viscosities may often be increased from two- to three-fold with the incorporation of as little as 0.2% or less, e.g. 0.16%, of the fatty acid stabilizer. At the same time, the physical stability may be improved to such an extent that even after a long time, the compositions containing the fatty acid stabilizers do not undergo any visible phase separation.

The preferred long chain fatty acids are the higher aliphatic fatty acids having from about 8 to about 24 carbon atoms, more preferably from about 10 to 24 carbon atoms, and especially preferably from about 12 to 22 carbon atoms, inclusive of the carbon atom of the carboxyl group of the fatty acid. The aliphatic radical may be saturated or unsaturated and may be straight or branched and may contain substituted functional groups affixed to the aliphatic chain. Straight chain saturated fatty acids are preferred. Mixtures of fatty acids may be used, such as those derived from natural sources, such as tallow fatty acid, coco fatty acid, soya fatty acid, etc., or from synthetic sources available from industrial manufacturing processes.

Thus, examples of the fatty acids which can be used as stabilizers include, for example, decanoic acid, dodecanoic acid, palmitic acid, myristic acid, stearic acid, behenic acid, oleic acid, eicosanoic acid, tallow fatty acid, coco fatty acid, soya fatty acid, mixtures of these acids, etc. Behenic acid, stearic acid and mixed fatty acids are preferred.

Salts such as metal or ammonium of the fatty acids can be used and are added directly to the composition or in the alternative are formed in situ from the fatty acid reacting with basic materials in the composition. Examples of alkali metal salts are lithium stearate, sodium stearate and/or potassium stearate. The alkali metal salts can be used alone in the phosphate compositions or in combination with a fatty acid or in combination with a polyvalent metal salt of the fatty acid, wherein the polyvalent metal salt of the fatty acid can be used alone or in combination with the fatty acid.

When the free acid form of the fatty acid is used directly it will generally associate with the potassium and sodium ions in the aqueous phase to form the corresponding alkali metal fatty acid soap. However, the fatty acid salts may be directly added to the composition as sodium salt or potassium salt, or as a polyvalent metal salt, although the alkali metal salts of the fatty acids are preferred fatty acid salts.

The preferred polyvalent metals are the di- and trivalent metals of Groups IIA, IIB and IIIA, such as magnesium, calcium, aluminum and zinc, although other polyvalent metals including those of Groups IIIB, IVA, VA, IB, IVB, VB, VIB, VIIB and VIII of the Periodic Table of the Elements can also be used. Specific examples of such other polyvalent metals include Ti, Zr, V, Nb, Mn, Fe, Co, Ni, Cd, Sn, Sb, Bi, etc. Generally, the metals may be present in the divalent to pentavalent state. Preferably, the metal salts are used in their higher oxidation states. Naturally, for use in automatic dishwashers, as well as any other applications where the invention composition will or may come into contact with articles used for the handling, storage or serving of food products or which otherwise may come into contact with or be consumed by people or animals, the metal salt should be selected by taking into consideration the toxicity of the metal. For this purpose, the alkali metal and calcium and magnesium salts as well as stearic and behenic acid are especially higher preferred as generally safe food additives. Another distinct advantage of the use of the fatty acids as stabilizers is their lower cost as compared to the fatty acid metal salts.

The amount of the fatty acid or fatty acid salt stabilizer to achieve the desired enhancement of physical stability will depend on such factors as the nature of the fatty acid or its salt, the nature and amount of the thickening agent, detergent active compound, inorganic salts, other ingredients, as well as the anticipated storage and shipping conditions.

Naturally, for LADD compositions, as well as any other applications where the invention composition will or may come into contact with articles used for the handling, storage or serving of food products or which otherwise come into contact with or be consumed by people or animals, the use of the fatty acids as the stabilizing agent are of particular advantage because of their known low toxicity. For this purpose, the stearic acid and behenic acid are especially preferred as generally safe food additives. Another distinct advantage of the use of the fatty acids as stabilizers is their lower cost as compared to the fatty acid metal salts.

Many of these fatty acids are commercially available. For example, the stearic acid and behenic acid are readily available.

Mixed fatty acids, such as the naturally occurring acids, e.g. coco acid, as well as mixed fatty acids resulting from the commercial manufacturing process are also advantageously used as an inexpensive but effective source of long chain fatty acids.

Generally, for compositions made with clay thickening agents however, amounts of the fatty acid stabilizing agents in the range of from about 0.02 to 1%, preferably from about 0.06 to 0.8%, especially preferably from about 0.08 to 0.4%, provide the increase in apparent viscosity and the long term stability and absence of phase separation upon standing or during transport at both low and elevated temperatures as are required for a commercially acceptable product.

Generally, however, amounts of the fatty acid or fatty acid salt stabilizing agents used in compositions made with polymeric thickening agents in the range of from about 0.02 to 2%, preferably 0.04 to 1%, more preferably from about 0.06 to 0.8%, especially preferably from about 0.08 to 0.4%, provide a long term stability and absence of phase separation upon standing or during transport at both low and elevated temperatures as are required for a commercially acceptable product.

Depending on the amounts, proportions and types of fatty acid physical stabilizers and polyacrylic acid-type thickening agents, the addition of the fatty acid or salt not only increases physical stability but also provides a simultaneous increase in apparent viscosity. Amounts of fatty acid or salt to polymeric thickening agent in the range of from about 0.08–0.4 weight percent fatty acid salt and from about 0.4–1.5 weight percent polymeric thickening agent are usually sufficient to provide these simultaneous benefits and, therefore, the use of these ingredients in these amounts is most preferred.

Besides the fatty acid compounds carboxylic containing compounds such as polycarboxylic acids selected from the group consisting of adipic acid, azelaic acid and dimers and trimers of $C_{18}$ to $C_{20}$ unsaturated fatty acids such as Empol 1010, Empol 1018, Empol 1022, Empol 1024, Empol 1040, Empol 1041 and Empol 1052 can be readily employed.

The polycarboxylic acids that can be used in accordance with the present invention are the dimers and trimers of fatty acids, preferably the unsaturated fatty acids. The $C_8$ to $C_{22}$ fatty acids can be used. The dimers and trimers are preferably from the $C_{16}$–$C_{20}$ unsaturated fatty acids. The most preferred dimer and trimer acids are prepared from $C_{18}$ unsaturated fatty acids, e.g. oleic acid and linoleic acid.

The monovalent metal salts and the polyvalent metal salts of the dimers and trimers of the fatty acids, preferably the unsaturated fatty acids, can also be used in the present invention. The ammonium salts of the dimers and trimers of the unsaturated fatty acids can also be used in the present invention.

A particular preferred group of polycarboxylic acids are the dimers and trimers of $C_{18}$ unsaturated fatty acids that are available from Emery Industries, Division of National Distillers & Chemical Corp. These materials are available under the following trade names:

| Dimers | Trimers | Polybasic Acid |
|---|---|---|
| Empol 1010 | Empol 1040 | Empol 1052 |
| Empol 1018 | Empol 1041 | |
| Empol 1022 | | |
| Empol 1024 | | |

The Empol 1040 and Empol 1052 are of particular interest. The Empol 1040 Trimer Acid typically contains 80% polybasic acids, 18% dibasic acid and 2% monobasic acid. The Empol 1052 Polybasic Acid contains 63% tribasic, tetrabasic and higher acids with about 34% dibasic acid.

In addition to the dimer and trimer acids, the adipic and azelaic polycarboxylic acids and their mono metal and ammonium salts and polyvalent metal salts can also be used as stabilizing agents in the present invention.

When the polycarboxylic acid is used in the LADD composition, it is neutralized "in situ" in the LADD composition to form the metal salt of the polycarboxylic acid.

The monovalent metal salts that can be used are the Group IA metals of the Periodic Table Of The Elements, and in particular the alkali metal salts. The Group IA monovalent metals that are included are Li, Na, K, Rb, Cs and Fr. The preferred monovalent alkali metals are Na and K.

The chlorine bleach compounds are, however, not to be used with the ammonium fatty acid salt stabilizers, since they are not compatible with chlorine bleach compounds. In the formulations in which the ammonium fatty acid stabilizers are used, the chlorine bleach can be omitted or an oxidizing enzyme can be substituted for the chlorine bleach.

The enzymes can be used in amounts of about 0.5 to 3%, preferably about 0.5 to 2.0% and more preferably about 0.5 to 1.5%.

The preferred polyvalent metals are the polyvalent metals of Groups IIA, IIB and IIIA, such as magnesium, calcium, aluminum and zinc, although other polyvalent metals, including those of Groups IIIB, IVA, VA, VIA, VIIA, IB, IVB, VB, VIB, VIIB, and VIII of the Periodic Table Of The Elements can also be used. Specific examples of such other polyvalent metals include Ti, Zr, V, Nb, Mn, Fe, Co, Ni, Cd, Sn, Sb, Bi, etc. Generally, the metals may be present in the divalent to pentavalent state. Preferably, the metal salts are used in their higher oxidation states. The use of the polycarboxylic acids and metal salts thereof as the stabilizing agent are of particular advantage because of their known low toxicity. For this purpose, the polycarboxylic acids per se, e.g. dimers and trimers of $C_{18}$ unsaturated fatty acid, the monovalent Na and K and the $NH_4$ salts and the polyvalent Ca and Mg metal salts thereof are especially preferred as generally safe because of their known low toxicity and/or known use as food additives. Another distinct advantage of the use of the polycarboxylic acids and metal salts thereof as stabilizers is their lower cost as compared to the polyvalent fatty acid metal salts.

Many of the polycarboxylic acids and metal salts thereof are commercially available. For example, the dimers and trimers of the $C_{18}$ unsaturated fatty acids, and adipic and azelaic acids are readily available.

The amount of the polycarboxylic acids and metal salts thereof stabilizers used to achieve the desired enhancement of physical stability and apparent viscosity increase will depend on such factors as the nature of the polycarboxylic acids and metal salts thereof, the nature and amount of the thixotropic agent, detergent active compound, inorganic salts, especially TPP, other LADD ingredients, as well as the anticipated storage and shipping conditions.

Generally, however, amounts of the polycarboxylic acids or metal salts thereof stabilizing agents in the range of from about 0.001 to 1.0%, for example 0.01 to 1.0%, preferably from about 0.01 to 0.2%, especially preferably from about 0.05 to 0.2%, provide the increase in apparent viscosity and the long term stability and absence of phase separation upon standing or during transport at both low and elevated temperatures as are required for a commercially acceptable product.

The redox enzymes, also known as oxidoreductase enzymes, can be used in the present invention. These enzymes catalyze chemical reductions and oxidations and are involved in the chemical breakdown of foods remaining on the dishware and utensils that are to be cleaned. Suitable enzymes that can be used are glucose oxidase, catalase and lipoxidase enzymes.

There can also be used in the formulations of the present invention proteolytic and amylolytic enzymes and mixtures thereof. The proteolytic enzymes suitable for use include liquid, powder or slurry enzyme preparations. Suitable liquid enzyme preparations include "Alcalase" and "Esperase" sold by Novo Industrie, Copenhagen, Denmark. Liquid protease and liquid amylase enzymes can be used. Suitable alpha-amylase liquid enzyme preparations are those sold by Novo Industries and Gist-Brocades under the trade names "Termamyl" and "Maxamyl", respectively.

From the examples to be given below, it will be seen that, depending on the amounts, proportions and types of physical stabilizers and thixotropic agents, the addition of the fatty acids or polycarboxylic acid in the case of clay compositions not only increases physical stability but also provides a simultaneous increase in apparent viscosity. Ratios of fatty acid to thixotropic agent in the range of from about 0.08 to 0.4 weight percent fatty acid and from about 0.1 to 2.5 weight percent thixotropic agent are usually sufficient to provide these simultaneous benefits and, therefore, the use of these ingredients in these rations is most preferred.

One preferred method for mixing the ingredients of the LADD phosphate formulations or non phosphate containing compositions containing a clay thickening agent involves first forming a mixture of the water, foam suppressor (when employed), detergent, physical stabilizer or salt thereof such as aluminum stearate and optionally stearic acid and thixotropic agent, e.g. clay. These ingredients are mixed together under high shear conditions, preferably starting at room temperature, to form a uniform dispersion and passed through an in-line homogenizer. To this premixed portion the remaining ingredients are introduced under mixing conditions. For instance, the required amount of the premix is introduced into a mixer and thereafter the remaining ingredients are added, with mixing, either sequentially or simultaneously. Preferably, the ingredients are added sequentially, although it is not necessary to complete the addition of all of one ingredient before beginning to add the next ingredient. Furthermore, one or more of the ingredients can be divided into portions and added at different times. Good results have been obtained by adding the remaining ingredients in the following sequence: sodium hydroxide, alkali metal carbonate, sodium silicate, alkali metal tripolyphosphate (hydrated), alkali metal tripolyphosphate (anhydrous or up to 5% water), bleach (preferably, sodium hypochlorite) and sodium hydroxide. The final composition is passed through an in-line homogenizer.

The compositions containing the polymeric thixotropic thickeners can be made forming a solution of the polymeric thixotropic thickener either at room temperature or at elevated temperatures. An aqueous premix dispersion of the surfactant, foam depressant and fatty acid or salt thereof is formed. The solution of the polymeric thixotropic thickener and the premix dispersion are mixed together to which is added with stirring at room temperature or at elevated temperatures the following ingredients in sequential order: alkali metal hydroxide, alkali metal carbonate, alkali metal silicate, alkali metal phosphates and bleach. The density of the formed composition is about 1.28 grams/ml to about 1.42 grams/ml, wherein the density of the composition can be varied by the amount of air incorporated into the composition during the shear mixing process. The composition has a Brookfield viscosity at room temperature after 24 hours after 3 minutes with a #4 spindle at a spindle rpm of 3 of about 4,000 cps to about 60,000 cps.

In order to achieve the desired benefit from the fatty acid or fatty acid salt stabilizer for compositions made with polymeric thickening agent without stabilization of excess incorporated air bubbles and consequent excessive lowering of the product bulk density, the fatty acid or salt should be post-added to the formulation, preferably together with the other surface active ingredients, including detergent active compound and antifoaming agent, when present. These surface active ingredients are preferably added as an emulsion in water wherein the emulsified oily or fatty materials are finely and homogeneously dispersed throughout the aqueous phase. To achieve the desired fine emulsification of the fatty acid or fatty acid salt and other surface active ingredients, it is usually necessary to heat the emulsion (or preheat the water) to an elevated temperature. For example, for stearic acid having a melting point of 68°–69° C., a temperature in the range of between 50° C. and 70° C. will be used. For lauric acid (m.p.=47° C.) an elevated temperature of about 35° to 50° C. can be used. Apparently, at these elevated temperatures the fatty acid or salt and other surface active ingredients can be more readily and uniformly dispersed (emulsified) in the form of fine droplets throughout the composition.

In contrast, as will be shown in the examples which follow, for the polymeric compositions if the fatty acid is simply post-added at ambient temperature, the composition is not linear viscoelastic as defined above and the stability of the composition is clearly inferior.

In addition to the detergent active surfactant, foam inhibitor, alkali metal silicate corrosion inhibitor, and detergent builder salts, which all contribute to the cleaning performance, it is also known that the effectiveness of the liquid automatic dishwasher detergent compositions is related to the alkalinity, and particularly to moderate to high alkalinity levels. Accordingly, the compositions of this invention will have pH values of at least about 9.5, preferably at least about 11 to as high as 14, generally up to about 13 or more, and, when added to the aqueous wash bath at a typical concentration level of about 10 grams per liter, will provide a pH in the wash bath of at least about 9, preferably at least about 10, such as 10.5, 11, 11.5 or 12 or more.

The alkalinity will be achieved, in part, by the alkali metal ions contributed by the alkali metal detergent builder salts, e.g. sodium tripolyphosphate, tetrapotassium pyrophosphate, and alkali metal silicate, however, it is usually necessary to include alkali metal hydroxide, e.g. NaOH or KOH, to achieve the desired high alkalinity. Amounts of alkali metal hydroxide in the range (on an active basis) of from about 0.5 to 8%, preferably from 1 to 6%, more preferably from about 1.2 to 4%, by weight of the composition will be sufficient to achieve the desired pH level and/or to adjust the K/Na weight ratio.

Other alkali metal salts, such as alkali metal carbonate may also be present in the phosphate compositions in minor amounts, for example from 0 to 10%, preferably 0 to 6%, by weight of the composition.

Other conventional ingredients may be included in these compositions in small amounts, generally less than about 3 weight percent, such as perfume, hydrotropic agents such as the sodium benzene sulphonate, toluene sulphonates, xylene sulphonate and cumene sulphonate, preservatives, dyestuffs and pigments and the like, all of course being stable to chlorine bleach compound and high alkalinity (properties of all the components). Especially preferred for coloring are the chlorinated phthalocyanines and polysulphides of aluminosilicate which provide, respectively, pleasing green and blue tints. $TiO_2$ may be employed for whitening or neutralizing off-shades.

In accordance with an especially preferred embodiment, the thickened linear viscoelastic aqueous automatic dishwasher detergent composition of this invention includes, on a weight basis:

(a) 10 to 35%, preferably 10 to 20%, detergent builder such as potassium tripolyphosphate, or sodium tripolyphosphate and mixtures thereof;
(b) 0 to 15%, preferably 8 to 12%, alkali metal silicate;
(c) 0 to 6%, preferably 1.0 to 4%, alkali metal hydroxide;
(d) 0 to 3%, preferably 0.1 to 3%, chlorine bleach stable, water-dispersible, low-foaming organic detergent active material, preferably non-soap anionic detergent;
(e) 0 to 1.5%, preferably 0.05 to 1.5% chlorine bleach stable foam depressant;
(f) chlorine bleach compound in an amount to provide about 0.2 to 4%, preferably 0.8 to 1.6%, of available chlorine;
(g) a non-linear, water-dispersible polyacrylic acid thickening agent comprising at least one high molecular weight crosslinked hydrophilic polycarboxylate having a molecular weight of from 750,000 to 4,000,000, preferably 800,000 to 3,000,000, in an amount to provide a linear viscoelasticity to the formulation, preferably from about 0.2 to 2%, especially preferably from about 0.4 to 1.5%, more preferably from about 0.4 to 1.0%
(h) a long chain fatty acid or a metal salt of a long chain fatty acid in an amount effective to increase the physical stability of the compositions, preferably from 0.08 to 0.4%, more preferably from 0.1 to 0.3% and
(i) 0 to 10%, preferably 1 to 8%, especially 2 to 6% of a non-crosslinked polyacrylic acid having a molecular weight in the range of from about 800 to 200,000, preferably 1000 to 150,000, especially 2,000 to 100,000; and
(j) balance water, preferably from about 30 to 75%, more preferably from about 35 to 65%, wherein the water is bound to the polymeric thickening agent. The compositions may also have an amount of air incorporated therein such that the bulk density of the composition is from about 1.28 to 1.42 g/cc, preferably from about 1.32 to 1.42 g/cc, more preferably from about 1.35 to 1.40 g/cc.

In accordance with another especially preferred embodiment, the present invention provides a thickened aqueous automatic dishwasher detergent composition which includes, on a weight basis:

(a) 5 to 35% alkali metal tripolyphosphate;
(b) 2.5 to 30% alkali metal silicate;
(c) 0 to 9% alkali metal carbonate;
(d) 2 to 10% alkali metal hydroxide;
(e) 0.1 to 5% chlorine bleach stable, water dispersible organic detergent active material;
(f) 0 to 5% chlorine bleach stable foam depressant;
(g) chlorine bleach compound in an amount to provide about 0.2 to 4% of available chlorine;
(h) 0.1 to 10% of inorganic colloid-forming clay;
(i) a metal salt of a long chain fatty acid in an amount effective to increase the physical stability of the composition; and
(j) balance water;

the total amount of (b) sodium silicate, (c) alkali metal carbonate and (d) alkali metal hydroxide providing a pH sufficiently high such that when the composition is diluted in an aqueous wash bath to provide a concentration of 10 grams per liter the pH of the aqueous wash bath becomes at least 11.2. When the composition is added to an aqueous wash bath to provide a concentration of 10 grams of composition per liter of wash bath the pH of the wash bath becomes at least 11.2, preferably at least 11.5, such as from 11.5 to 13.5, preferably 11.5 to 12.5. By operating at these higher than normal alkalinity levels the cleaning performance is improved and at the same time the rheological properties, and particularly, physical stability, are also improved. Furthermore, in the preferred embodiment in which a chlorine bleach compound is included in the LADD composition, the additional benefit of reduction of loss of active chlorine is also obtained.

Therefore, in accordance with an especially preferred embodiment of this invention, the high alkalinity is achieved in a phosphate free, clay-thickened, fatty acid salt stabilized, chlorine-bleach containing liquid automatic dishwasher detergent composition wherein the alkaline compounds include, on an active basis, based on the total composition, from about 3 to 25 weight percent alkali metal silicate, from about 1.0 to 4.5 weight percent alkali metal hydroxide 0 to 22 wt. % of a low molecular weight non-crosslinked polyacrylic polymer, and from 0 to about 8 weight percent alkali metal carbonate, with the provision that the total amount of alkali metal hydroxide and alkali metal carbonate is no more than about 9 weight percent and the total amount of alkali metal silicate and alkali metal carbonate is not more than about 30 weight percent, the pH of the composition being at least 12.8, and the pH of 1 liter of aqueous wash bath containing 10 grams of the composition being at least 11.5.

Although the alkali metal of the alkaline compounds: silicate, carbonate and hydroxide, is preferably sodium, the corresponding potassium compounds, or mixtures of sodium and potassium compounds, or mixtures of sodium and potassium compounds can also be used.

A preferred example of the present invention provides for a composition comprising the following ingredients on a weight basis unless specified otherwise:

(a) 5 to 35% of at least one alkali metal tripolyphosphate;
(b) 0 to 20% sodium silicate;
(c) 0 to 9% alkali metal carbonate;
(d) 0 to 5% chlorine bleach stable, water dispersible organic detergent active material;
(e) 0 to 5% chlorine bleach stable foam depressant;
(f) chlorine bleach compound in an amount to provide about 0.2 to 4% of available chlorine;
(g) thixotropic thickener in an amount sufficient to provide the composition with a thixotropy index of about 2.0 to 25, more preferably 2.0 to 10;
(h) alkali metal hydroxide, as necessary, to adjust the pH to a sufficient level;
(i) a long chain fatty acid or its salt as a physical stabilizer in an amount effective to increase the physical stability of the composition;
(j) optionally, a fragrance in an amount effective to provide a scent and to avoid destruction of the desired thixotropy and physical stability of the composition;
(k) water in the amount effective to avoid destruction of the desired thixotropic properties; and
(l) optionally, air in an amount ranging from about 2% to 10% by volume, effective to provide the composition with a bulk specific gravity of about 1.20 to about 1.35.

According to the process of the present invention, a phase stable, thixotropic liquid automatic dishwashing detergent composition is produced by optionally, entraining air into the composition so as to effect an equilibration of the specific gravities of the bulk and liquid phases of the composition.

It has been found that concentrated dispersions which contain both liquid and solid phases, such as the liquid automatic dishwashing detergent compositions, can be stabilized by dispersing an appropriate amount of air in the form of micron size bubbles throughout the liquid phase of the composition. It has also been found that the air can be dispersed and stabilized as bubbles throughout the liquid phase by employing a stabilizing system categorized generally as, physical stabilizers, foam depressants or defoamers and surfactants. While not wishing to be bound by any theory to explain how the stabilizing system and air interact in the liquid automatic dishwashing detergent compositions, it is believed that these three components interact at the air/-liquid interface such that the hydrophobic groups of the three components are oriented towards the air bubbles while the hydrophilic groups are oriented towards the aqueous phase. The hydrophilic groups, in turn, interact with the solid particles of the suspension either through hydrogen bonding or through electrostatic interaction. In other words, the liquid/air interface consists of the three components of the stabilizing system and solid particulates giving rise to a liquid crystalline type structure for the interphase.

According to the preferred process of present invention, a three-part stabilizing system produces a highly stable liquid automatic dishwashing detergent composition by stabilizing the micron size air bubbles throughout the composition such that the bulk specific gravity of the liquid automatic dishwashing detergent composition is about equal to the specific gravity of the liquid phase only, in the liquid automatic dishwashing detergent composition. It is at this condition that the liquid automatic dishwashing detergent composition exhibits high stability, i.e., there is little or no tendency for phase separation due to density variations in the composition.

In order to effectively disperse the air throughout the liquid automatic dishwasher detergent composition it has been discovered that the size of the entrained air bubbles must be greater than the size of any dispersed solid particles. The bubble size generally may vary from about 5 to about 80 microns and preferably from about 20 to about 60 microns. Air bubble size can be controlled, generally, by varying the blade tip speed of the dispersers or agitators during the mixing operations. It has also been found that air entrainment from about 2 to about 10% by volume produces phase stable compositions, the preferred range being from about 4.0 to about 9.0% by volume, the most preferred range being from about 6.5 to about 8.5% by volume.

As best seen in the drawing, the process of the present invention for a clay containing composition can be performed in a blending system incorporating predispersion vessel 2, premix vessel 4, main batch vessel 6, homogenizers 8, 10, 19 and 21 heat exchanger 12, in-line mixer 14 and storage tank 16.

A predispersion mix comprising the stabilizing system is prepared in a predispersion vessel 2 then fed to the premix vessel 4 through line 18 and homogenizer 19 via pump 20 where it is added to a thixotropic thickener to prepare a thickener premix. The thickener premix is then fed to the main batch vessel 6 through line 22 and homogenizer 21 via pump 24 wherein the remaining components of the liquid automatic detergent composition are added.

The detergent composition from vessel 6 is then fed through homogenizers 8 and 10 and thereafter cooled in the exchanger 12. If a scented dishwasher detergent composition is desired, the cooled product is fed through an in-line static mixer 14 where a fragrance is added. The liquid dishwasher detergent composition is then fed to tank 16 where it is stored.

In one of the preferred process of the present invention, a liquid detergent predispersion mix is first prepared including the selected physical stabilizer, foam inhibitor and surfactant components of the liquid automatic dishwasher detergent composition as well as a portion of the total liquid automatic dishwasher detergent water content. Depending on the selection of stabilizing components, one or more of the components may initially be solid, requiring either the addition of heat to form a melt or the addition of water to form a solution or emulsion. The amount of water added to the predispersion mix should be limited so as to maintain a highly viscous mix. The predispersion mix is subjected to mixing, preferably high-shear mixing, for about 5 minutes during which time the predispersion mix temperature may exceed 100° F. High-shear mixing, as used herein, is defined in terms of shear rates and is dependent on a number of variables, the most important being the configuration of the mixing vessel and the impeller tip speed. For example, the pre-dispersion mix is preferably high-shear mixed in a Myers HSD TM using an 8 inch impeller at an impeller speed of about 4500 ft/min. The "high shear" rate at this condition is approximated to be of the order of 100 $sec^{-1}$.

The predispersion mixing step may be accomplished in other conventional milling or high-shear mixing equipment for example, roller mills, colloid mills and Premier mills.

The predispersion mixing step is followed by a second mixing step during which a thixotropic thickener, e.g., clay, and an additional portion of the total liquid automatic dishwasher detergent water content is added to the predispersion mix to form a thickener premix. The thickener premix is preferably subjected to low shear mixing for about 20 minutes during which time the thickener is hydrated, deagglomerated and dispersed throughout the thickener premix. Low-shear mixing, as used herein, is also defined in terms of shear rates and as discussed above with respect to high-shear is a function of a number of variables including mixing vessel configuration and impeller tip speed. Equipment suitable for low-shear mixing of the thickener premix includes conventional paddle blade mixers wherein average shear rates are on the order of about 10 $sec^{-1}$.

The amount of water added to each of the first two mixing steps is somewhat arbitrary within the limits of the total water content of the final liquid automatic dishwasher detergent composition. However, it has been found that the amount of water added to the predispersion mix should not be so high as to produce an unduly low viscosity and high fluidity mixture since such a condition would adversely affect the mixing, particularly under high-shear mixing conditions.

The second mixing step is followed by a main batch mixing step during which the thickener premix, the balance of the total liquid automatic dishwashing detergent water content and other desired liquid automatic dishwashing detergent ingredients are mixed preferably under high-shear conditions, to form a main batch composition. During this mixing step the remaining liquid automatic dishwashing detergent ingredients are preferably added. Shear rates on the order of 100 $sec^{-1}$ are achieved during this mixing step. The remaining liquid automatic dishwashing detergent ingredients which may be added include the following: sodium hydroxide, sodium carbonate, silicates, alkali metal tripolyphosphates, chlorine bleach compounds, and other suitable ingredients which comprise the desired liquid automatic dishwashing detergent composition.

Equipment suitable for the high-shear mixing operation include roller mills, colloid mills, Premier mills and Myers HSD, among others.

The main batch composition from the high-shear mixing step is then subjected to a series of coarse and fine homogenizing steps until the solid and liquid phases of the liquid automatic dishwashing detergent composition are thoroughly homogenized. The homogenizing steps are carried out under high-shear conditions wherein shear rates on the order of about $10^4 sec^{-1}$ are achieved. The homogenizing steps are complete when the bulk specific gravity of the liquid automatic dishwashing detergent composition is about equal to the specific gravity of the liquid automatic dishwashing detergent liquid phase only. Homogenization of the liquid automatic dishwashing detergent composition may be accomplished in conventional homogenizers, such as high speed Dispax TM, available from IKA-Works, Inc.

According to the invention, the liquid automatic dishwashing detergent composition is preferably subjected to mixing at a sufficient rate which ensures air entrainment in an amount of about 2% to about 10% by volume, preferably 4 to 9% and most preferably 6.5 to 8.5% by volume in the dishwasher composition. In the preferred embodiment of the invention, the air is entrained in the composition during the light-shear mixing of the dishwasher detergent ingredients. However, according to the invention, air may be introduced to the composition at any point in the process by conventional means to produce a phase stable composition.

The presence of a bulk specific gravity about equal to the liquid phase specific gravity is indicative of air entrainment and high product stability. Generally, it has been found that specific gravities within the range of 1.20 to 1.35 provide a phase stable liquid automatic dishwashing detergent composition, the preferred specific gravity being within the range from about 1.26 to about 1.32.

In an alternate embodiment of the present invention, the liquid and solid components of the thixotropic detergent composition, as described above, are added sequentially to a high-shear mixer while continuously mixing, until all desired ingredients are included. Thereafter, the detergent composition is subjected to high-shear mixing for about 15 minutes to produce a homogeneous air entrained thixotropic detergent composition. The high-shear mixing step is complete when the bulk specific gravity of the composition is about equal to the liquid phase specific gravity.

While the process of the invention has been described in terms of preferred ingredients and amounts, it would be understood to those skilled in the art that a highly stable thixotropic detergent composition could be achieved in the absence of one or more of the ingredients by appropriate adjustment of the remaining ingredients. For example, it may be possible to formulate a phase stable composition in the absence of a foam depressant by minimizing the surfactant level and increasing the amount of physical stabilizer in the composition.

The liquid ADD compositions of this invention are readily employed in known manner for washing dishes, other kitchen utensils and the like in an automatic dishwasher, provided with a suitable detergent dispenser, in an aqueous wash bath containing an effective amount of the composition.

The invention also provides a method for cleaning dishware in an automatic dishwashing machine with an aqueous wash bath containing an effective amount of the liquid linear viscoelastic automatic dishwasher detergent composition as described above. The composition can be readily poured from the polyethylene container with little or no squeezing or shaking into the dispensing cup of the automatic dishwashing machine and will be sufficiently viscous and cohesive to remain securely within the dispensing cup until shear forces are again applied thereto, such as by the water spray from the dishwashing machine.

The invention may be put into practice in various ways and a number of specific embodiments will be described to illustrate the invention with reference to the accompanying examples.

All amounts and proportions referred to herein are by weight of the composition unless otherwise indicated.

DETAILED DESCRIPTION OF THE PREFERRED EMBODIMENTS OF THE INVENTION

EXAMPLE 1

In order to demonstrate the effect of the fatty acid stabilizer a liquid ADD formulation is prepared as follows:

| Percent | Percent |
|---|---|
| Deionized water | 41.10 |
| Caustic soda solution (50% NaOH) | 2.20 |
| Sodium carbonate, anhydrous | 5.00 |
| Sodium silicate, 47.5% solution of $Na_2O:SiO_2$ ratio of 1:2.4 | 15.74 |
| Sodium TPP (substantially anhydrous - i.e. 0.5%, especially 3%, moisture) (Thermphos NW) | 12.00 |
| Sodium TPP (hexahydrate) (Thermphos N hexa) | 12.00 |

The mixture is cooled at 25°-30° C. and agitation maintained throughout, and the following ingredients at room temperature are added thereto:

| | Percent |
|---|---|
| Sodium hypochlorite solution (11% available chlorine) | 9.00 |
| Monostearyl phosphate | 0.16 |
| DOWFAX 3B-2 (45% Na monodecyl/didecyl diphenyl oxide disulphonate aqueous solution) | 0.80 |
| Physical stabilizer (fatty acid or fatty acid salt) | X |
| Pharmagel H | 2.00 |

There are three formulations prepared in which X=0%, X=0.10% calcium stearate and X=0.16% behenic acid.

The monostearyl phosphate foam depressant (when employed) and Dowfax 3B-2 detergent compound fatty acid stabilizer are added to the mixture just before the Pharmagel H thickener.

The Run 1 is a control formulation which includes the monostearyl phosphate anti-foam agent, but which does not contain a fatty acid stabilizer.

The Run 2 is a formulation of Run 1 to which has been added to a calcium stearate stabilizing agent of application Ser. No. 744,754.

The Run 3 is a formulation of the present invention in which behenic acid ($CH_3(CH_2)_{20}COOH$ is used as the stabilizing agent and the monostearyl phosphate anti-foam agent is optionally omitted.

Each of the resulting liquid ADD formulation as shown in the Table are measured for apparent viscosity at 3 and 30 rpm. The results obtained are also shown in Table.

From the data reported in the Table the following conclusions are reached:

The incorporation of 0.1% calcium stearate in a 2.0% Pharmagel H containing formula Run 3 (invention) leads to a significant increase in the apparent viscosity as compared to both the control Runs 1 and 2.

| RUN | FORMULATION | BROOK LVT VISCOSITY (KCPS) (1) 3 RPM | 30 RPM |
|---|---|---|---|
| 1 | $H_2O$ = 41.10%<br>Monostearyl Phosphate = 0.16%<br>Stabilizer = 0%<br>Pharmagel H = 2.0% | 18 | 4.9 |
| 2 | $H_2O$ = 41.0%<br>Monostearyl Phosphate = 0.16%<br>Ca Stearate = 0.1%<br>Pharmagel H = 2.0% | 24 | 3.8 |
| 3 | $H_2O$ = 41.0%<br>Monostearyl Phosphate = 0%<br>Behenic Acid = 0.16%<br>Pharmagel H = 2.0% | 87 | 10.2 |

(1) Measured with spindle 4 after three minutes at 3 and 30 rpm on 24 hour old samples.

EXAMPLE 2

The following gel-like thixotropic liquid ADD is prepared following the same general procedure as in Example 1.

| Ingredient | Amount (A.I.) Wt % |
|---|---|
| Sodium silicate (47.5% solution of $Na_2O:SiO_2$ ratio of 1:2.4) | 7.48 |
| Monostearyl phosphate | 0.16 |
| Dowfax 3B-2 | 0.36 |
| Thermphos NW | 12.0 |
| Thermphos N hexa | 12.0 |
| Behenic Acid | 0.1 |
| Sodium carbonate, anhydrous | 5.0 |
| Caustic soda solution (50% NaOH) | 3.1 |
| Pharmagel H | 1.5 |
| Sodium hypochlorite solution (11%) | 1.0 |
| Water | balance |

Minor amounts of perfume, color, etc. can also be added to formulation.

EXAMPLE 3

The following gel-like thixotropic liquid ADD was prepared following the same general procedure as in Example 1.

| Ingredient | Amount (A.I.) Wt % |
|---|---|
| Sodium silicate (47.5% solution of $Na_2O:SiO_2$ ratio of 1:2.4) | 7.48 |
| Monostearyl phosphate | 0.16 |
| Dowfax 3B-2 | 0.36 |
| Thermphos NW | 12.0 |
| Thermphos N hexa hydrate | 12.0 |
| Stearic Acid | 0.2 |
| Sodium carbonate, anhydrous | 5.0 |
| Caustic soda solution (50% NaOH) | 3.1 |
| Pharmagel H | 1.0 |
| Sodium hypochlorite solution (11%) | 1.0 |
| Water | balance |

Minor amounts of perfume, color, etc. can also be added to formulation.

EXAMPLES 4-9

The following general procedure was used to prepare thixotropic polymeric compositions.

Step 1: The Carbopol polymer in the acid form was dispersed in distilled water at ambient temperature using Premier blade mixer under medium shear condition. The complete dispersion of polymer was evaluated by visual inspection i.e. absence of Macroscopic gel particles or fish eyes. The above dispersion was neutralized slowly by adding 50% NaOH, with constant mixing. The neutralization step is exothermic and temperature increases in the range from 110° F.–130° F. The neutralization resulted in liquid translucent gel phase.

Step 2: Preparation of Predispersion:

An emulsion consisting formula level of Dowfax 3B2, Stearic Acid or sodium stearate and LPKN158 was prepared by the following procedure.

To a 250 ml. pyrex beaker was added small quantity of water and these above components were added, and the resulting heterogeneous mixture was heated to a temperature above 160° F. until an opaque emulsion was obtained. This emulsion mixture is viscous and solidifies when cooled at ambient temperature.

Step 3: The predispersion obtained in step 2 was added to the gel of Step 1 with constant shearing. The temperature of the gel and predispersion were about 110° F. and 140° F. temperature. Excessive shear was usually avoided to minimize air incorporation in the resulting Gel.

To the above formed gel phase, the following ingredients were added with stirring sequentially i.e. color, soda ash, silicate, phosphates, followed by bleach. When the low molecular weight polymer Acrysol LWN45-N or the silicone defoamer were incorporated in the formula, they were added after bleach addition. In some cases the batch was cooled to 80° F. prior the addition of bleach.

EXAMPLE 4

| | 4-A | 4-B | 4-C | 4-E | 4-F |
|---|---|---|---|---|---|
| LPKn-158 | 0.16 | 0.16 | 0.16 | 0.16 | 0.16 |
| Dowfax 3B2 (45%) | 0.6 | 0.6 | 0.6 | 0.6 | 0.6 |
| Sodium Stearate | 0.03 | 0.03 | — | — | 0.03 |
| NaOH (50%) | 2.4 | 2.4 | 2.4 | 2.4 | 2.4 |
| Sodium Silicate (47.5%) | 13.74 | 13.74 | 13.74 | 13.74 | 25 |
| $Na_2CO_3$ | 7 | 7 | 7 | 7 | 7 |
| Thermphos NH | 12 | — | — | — | — |
| Thermphos NW | 12 | 24 | 24 | 24 | 24 |
| NaOCL 11% | 7.62 | 7.62 | 7.62 | 7.62 | 7.62 |
| Carbopol 940 | 0.1 | 0.1 | 0.2 | 0.2 | 0.01 |
| Water | balance | balance | balance | balance | balance |
| Viscosity standing cps[1] | 5320 | 11420 | 14320 | 9100 | 14,580 |
| Viscosity shaken cps | 4220 | 11660 | 17360 | 10560 | 10,900 |

[1]Standing means 1–2 days in a plastic bottle or container

EXAMPLE 5

| | 5-A | 5-B | 5-C | 5-D | 5-E |
|---|---|---|---|---|---|
| LPKn-158 | 0.16 | 0.16 | 0.16 | 0.16 | 0.16 |
| Dowfax 3B2 (45%) | 0.8 | 0.8 | 0.8 | 0.8 | 0.8 |
| Stearic Acid[2] | 0.1 | 0.1 | 0.1 | 0.1 | 0.1 |
| NaOH (50%) | 2.4 | 2.4 | 2.4 | 2.4 | 2.4 |
| $Na_2Co_3$ | 4 | 4 | 4 | 4 | 4 |
| Sodium Silicate (47.5%) | 24 | 24 | 24 | 24 | 24 |
| TTP Hexa-hydrate (FMC Chemical Co.) | 12 | — | — | — | — |
| TTP Oxy-anhydrous (Oxy Chemical Co.) | 12 | 22 | 22 | 22 | 22 |
| Zeolite | 1.0 | 1.0 | — | 1.0 | 1.0 |
| NaOCL 11% | 7 | 7 | 7 | 7 | 7 |
| Acrysol LMW45N | 2 | 2 | 2 | 2 | 2 |
| Carbopol 940 | 0.1 | 0.2 | 0.2 | 0.2 | 0.2 |
| Potassium Carbonate | — | — | — | — | 5 |
| Water | balance | balance | balance | balance | balance |
| Density g/ml | 1.30 | 1.29 | 1.31 | 1.17 | 1.22 |
| Viscosity standing cps | 10,400 | 16,100 | 14,100 | 8,400 | 9,450 |

| | 5-F | 5-G | 5-H | 5-I | 5-J |
|---|---|---|---|---|---|
| LPKn-158 | 0.16 | 0.16 | 0.16 | 0.16 | 0.16 |
| Dowfax 3B2 (45%) | 0.8 | 0.8 | 0.8 | 0.8 | 0.8 |
| Stearic $Acid_2$ | 0.1 | 0.1 | 0.1 | 0.1 | 0.1 |
| NaOH (50%) | 2.4 | 2.4 | 2.4 | 2.4 | 2.4 |
| $Na_2CO_3$ | — | 5 | 5 | 5 | 5 |
| Sodium Silicate (47.5%) | 24 | 24 | 24 | 24 | 24 |
| TTP Hexa-hydrate (FM Chemical Co.) | — | 24 | 24 | 24 | 24 |
| TTP Oxy-anhydrous (Oxy Chemical Co.) | 22 | — | — | — | — |
| Zeolite | 1.0 | 1.0 | 1.0 | 1.0 | 1.0 |
| NaOCI (11%) | 7 | 7 | 7 | 7 | 7 |
| Acrysol LMW45N | 2 | — | 2 | 2 | 2 |
| Carbopol 940 | 0.2 | 0.2 | 0.3 | 0.5 | 0.1 |
| Potassium Carbonate | — | — | — | — | — |
| Water | balance | balance | balance | balance | balance |
| Density g/ml | 1.22 | 1.24 | 1.25 | 1.22 | 1.30 |
| Viscosity standing cps | 7,750 | 5,900 | 7,750 | 13,700 | 3,480 |

[2]Triple pressed stearic acid

EXAMPLE 6

| | 6-A | 6-B | 6-C | 6-D | 6-E |
|---|---|---|---|---|---|
| Carbopol 941 | 1.0 | 1.0 | 0.5 | 0.75 | 0.75 |
| NaOH (50%) | 2.4 | 2.4 | 2.4 | 2.4 | 2.4 |

-continued

| | 6-A | 6-B | 6-C | 6-D | 6-E |
|---|---|---|---|---|---|
| LPKN-158 | 0.16 | 0.16 | 0.16 | 0.16 | 0.16 |
| Stearic Acid | 0.1 | 0.1 | 0.1 | 0.1 | 0.1 |
| Dowfax 3B2 (45%) | 0.8 | 0.8 | 0.8 | 0.8 | 0.8 |
| Sodium Silicate (47.5%) | 1 | 6.8 | 21 | 21 | 21 |
| TKPP (tetrapotassium pyrophosphate) | 10 | 15 | 15 | 15 | 20 |
| TTP Hexahydrate | 17 | 12 | 12 | 12 | 7 |
| Acrysol LMW 45N | — | 2 | 2 | 2 | 2 |
| Potassium Silicate | 6.78 | — | — | — | — |
| NaOCl (11%) | 9.10 | 9.10 | 9.10 | 9.10 | 7.5 |
| Water | balance | balance | balance | balance | balance |
| Viscosity standing cps | 8,100 | 10,400 | 6,200 | 8,000 | 10,000 |
| Density g/ml | — | 1.31 | — | 1.29 | — |

EXAMPLE 7

| | 7-A | 7-B | 7-C | 7-D | 7-E | 7-F |
|---|---|---|---|---|---|---|
| Sodium Silicate (47.5% solution of $Na_2O$—$SiO_2$ ratio of 1:2.4) | 17.24 | 24 | 20 | 30 | 30 | 30 |
| LPKN-158 | 0.16 | 0.16 | 0.16 | 0.16 | 0.16 | 0.16 |
| Dowfax 3B-2 (45%) | 0.8 | 0.8 | 0.8 | 0.6 | 0.6 | 0.8 |
| Therm-phos NW | 12.0 | 12 | 10.5 | — | — | — |
| Therm-phos N Hexa-hydrate | 12.0 | 12 | 10.5 | — | — | |
| Stearic Acid | 0.1 | 0.1 | 0.05 | 0.1 | 0.1 | 0.1 |
| $Na_2Co_3$ | 5.0 | 5.0 | 4 | 4 | 4 | 4 |
| NaOH (50%) | 2.4 | 2.4 | 2.4 | 2.4 | 2.4 | 2.4 |
| Carbopol 940 | 0.3 | 0.1 | 0.2 | 1.0 | 1.0 | 0.8 |
| Acrysol LMW 45N | — | — | 2.0 | 2.5 | 2.5 | — |
| NaOCl 11% | 7.0 | 7.0 | 7 | 7 | 7 | 7 |
| Antifoam T-H (Silicone Defoamer) | — | 0.05 | 0.05 | — | — | — |
| Water | 43 | 36.39 | 42.3 | 24.2 | 29.2 | 31.7 |
| Density g/ml | 1.35 | 1.39 | 1.34 | 1.29 | 1.17 | 1.22 |
| Viscosity cps | thick | — | 7,800 | 7,950 | 10,100 | 9,900 |

EXAMPLE 8

| | 8A | 8B | 8C | 8D |
|---|---|---|---|---|
| Distilled Water | 41.08% | 41.03% | 40.9-3% | 40.83% |
| Carbopol 940 | 0.05 | 0.10 | 0.20 | 0.30 |
| Carbopol 941 | — | — | — | — |
| Sodium Hydroxide (50%) | 2.40 | 2.40 | 2.40 | 2.40 |
| LPKN (158%) | 3.20 | 3.20 | 3.20 | 3.20 |
| Dowfax 3B2 (45%) | 0.80 | 0.80 | 0.80 | 0.80 |
| Stearic Acid | 0.10 | 0.10 | 0.10 | 0.10 |
| Soda Ash | 5.00 | 5.00 | 5.00 | 5.00 |
| PO Silicate | 17.24 | 17.24 | 17.24 | 17.24 |
| FMC Hexahydrate TPP | — | — | — | — |
| Oxy Anhydrous TPP | 21.00 | 21.00 | 21.00 | 21.00 |
| TKPP | — | — | — | — |
| NaOCl (14.03%) | 7.13 | 7.13 | 7.13 | 7.13 |
| Acrysol LWM 45-N | 2.00 | 2.00 | 2.00 | 2.00 |
| Density g/ml | 1.29 | 1.29 | 1.27 | 1.25 |
| Viscosity cps | 6950 | 8050 | 10200 | 13800 |
| Foam Test avg. rpm | X | X | X | 25.0 |
| Cup Leakage (%) | 30.2 | 24.5 | 38.6 | 19.6 |

| | 8E | 8F | 8G |
|---|---|---|---|
| Distilled Water | 40.7-3% | 33.65% | 33.65% |
| Carbopol 940 | 0.40 | — | — |
| Carbopol 941 | — | 0.75 | 0.75 |
| Sodium Hydroxide (50%) | 2.40 | 2.40 | 2.40 |
| LPKN (158%) | 3.20 | 3.20 | 3.20 |
| Dowfax 3B2 (45%) | 0.80 | 0.80 | 0.80 |
| Stearic Acid | 0.10 | 0.10 | 0.10 |
| Soda Ash | 5.00 | — | — |
| PO Silicate | 17.24 | 21.00 | 21.00 |
| FMC Hexahydrate TPP | — | 12.00 | 7.00 |
| Oxy Anhydrous TPP | 21.00 | — | — |
| TKPP | — | 15.00 | 20.00 |
| Bleach (14.03%) | 7.13 | 9.10 | 9.10 |
| Acrysol LWM 45-N | 2.00 | 2.00 | 2.00 |
| Density g/ml | 1.24 | 1.29 | 1.27 |
| Viscosity cps | 16200 | 8000 | 7350 |
| Foam Test avg. rpm | 23.6 | X | X |
| Cup Leakage (%) | 19.2 | 12.1 | 14.1 |

EXAMPLE 9

| | 9A | 9B | 9C | 9D |
|---|---|---|---|---|
| Distilled Water | 26.9076 | 26.9676 | 27.0076 | 27.0076 |
| Carbopol 940 | 0.10 | 0.20 | 0.10 | — |
| Caustic | 6.38 | 6.38 | 6.38 | 6.38 |
| Graphtol Green Dye | 0.0024 | 0.0024 | 0.0024 | 0.0024 |
| LPKn-158 | 0.16 | — | 0.16 | 0.16 |
| Stearic Acid | 0.12 | 0.12 | — | 0.12 |
| Dowfax 3B2 (45%) | 1.00 | 1.00 | 1.00 | 1.00 |
| Distilled Water | 3.50 | 3.50 | 3.50 | 3.50 |
| Sodium Carbonate | 4.00 | 4.00 | 4.00 | 4.00 |
| Sodium Silicate (47.5%) | 20.83 | 20.83 | 20.83 | 20.83 |
| TPP Anhydrous | 22.00 | 22.00 | 22.00 | 22.00 |
| NaOCl (11%) | 14.80 | 14.80 | 14.80 | 14.80 |
| Dow Corning 1400 | 0.20 | 0.20 | 0.20 | 0.20 |
| Density g/ml | 1.32 | 1.36 | 1.37 | 1.23 |
| Viscosity cps | 15600 | Off Scale | 8350 | 9200 |
| Chlorine level (%) | 1.623 | 1.628 | 1.641 | 1.638 |
| Chlorine level (%) | 1.457 | 1.439 | 1.493 | 1.638 |
| Aged 1 month - RT | Slight top sep | (1 m) top sep | Slight top sep | Stable |
| Chlorine level | 0.992 | 0.987 | 1.025 | 0.987 |

-continued

| (%) | | | | |
|---|---|---|---|---|
| Aged 1 month - 100° F. | (1 ml) top sep | Stable | Top sep | Sit Bottom |
| Bottle Residue | | | | |
| Doses Left At - | | | | |
| 7% level | 1.24 | 1.24 | 0.87 | 1.21 |
| 15% level | 2.20 | 2.41 | 1.07 | 1.54 |
| 20% level | 2.51 | 2.59 | 1.21 | 1.48 |

| | 9E | 9F | 9G |
|---|---|---|---|
| Distilled Water | 26.9576 | 27.2376 | 27.1876 |
| Carbopol 940 | 0.05 | 0.05 | 0.10 |
| Caustic | 6.38 | 6.38 | 6.38 |
| Graphtol Green Dye | 0.0024 | 0.0024 | 0.0024 |
| LPKn-158 | 0.16 | — | — |
| Stearic Acid | 0.12 | — | — |
| Dowfax 3B2 (45%) | 1.00 | 1.00 | 1.00 |
| Distilled Water | 3.50 | 3.50 | 3.50 |
| Sodium Carbonate | 4.00 | 4.00 | 4.00 |
| Sodium Silicate (47.5%) | 20.83 | 20.83 | 20.83 |
| TPP Anhydrous | 22.00 | 22.00 | 22.00 |
| NaOCl (11%) | 14.80 | 14.80 | 14.80 |
| Dow Corning 1400 | 0.20 | 0.20 | 0.20 |
| Density g/ml | 1.26 | 1.29 | 1.34 |
| Viscosity cps | 12200 | 5800 | 6800 |
| Chlorine level (%) | 1.991 | 1.986 | 1.999 |
| Chlorine level (%) | 1.790 | 1.810 | 1.840 |
| Aged 1 month - RT | Stable | Bottom sep | Top sep |
| Chlorine level (%) | 1.190 | 1.320 | 1.280 |
| Aged 1 month - 100° F. | Stable | Bottom sep | Top sep |
| Bottle Residue | | | |
| Doses Left At - | | | |
| 7% level | 2.09 | 0.91 | 1.03 |
| 15% level | 2.31 | 0.89 | 1.27 |
| 20% level | 2.10 | 0.94 | 1.31 |

EXAMPLE 10

Thixotropic aqueous stearate formulation (10A–10I) were prepared by adding Graphtol green to water and Carbopol was then sprinkled or sived into heated water (100°–110° F.) while stirring slowly so that there was no vortex generated and no lumping formed during stirring. Sufficient stirring was allowed so that the Carbopol polymer was completely swelled or hydrated. Sodium hydroxide was slowly added to the hydrated polymer while stirring and allowed to neutralize the polymer mixture. Liquid silicate was then added, followed by slow addition of phosphates slowly while stirring and mixing. Sodium polyacrylate liquid was then added. LPKN 158 and stearic acid melted in Dowfax and water was added to the mixture and stirred for about 5 minutes to uniformly mix all the ingredients. The batch was cooled to ambient temperature and sodium hypochlorite added and then stirred for 5 minutes.

EXAMPLE 10

| | 10A | 10B | 10C |
|---|---|---|---|
| Deionized Water | 41.427 | 41.427 | 41.427 |
| Graphtol Green | 0.003 | 0.003 | 0.003 |
| Carbopol 614 | 0.800 | 0.800 | 0.800 |
| Sodium Hydroxide (50%) | 4.500 | 4.500 | 4.500 |
| Sodium Silicate (47.5%) | 20.830 | 20.830 | 20.830 |
| Sodium TPP-Anhydrous-Estimate | 13.000 | 13.000 | 13.000 |
| Potassium TPP-Anhydrous-Estimate | 3.000 | 5.000 | 7.000 |
| Sodium Polyacrylate - LMW 45N (45%) | 4.440 | 4.440 | 4.440 |
| Dowfax 3B2 (45%) | 0.600 | 0.600 | 0.600 |
| LPKn 158 - Defoamer | 0.200 | 0.200 | 0.200 |
| Stearic Acid - Hystrene 5016 | 0.100 | 0.100 | 0.100 |

-continued

| | | | |
|---|---|---|---|
| Sodium Hypochlorite (12%) | 11.100 | 11.100 | 11.100 |
| Total Formula Amounts | 100.000 | 100.000 | 100.000 |
| Physical Properties | | | |
| Density | 1.24 | 1.3 | 1.29 |
| pH (1% Solution) | | | |
| Viscosity, 1 WK - Ambient | 7200 | 7225 | 6700 |
| Aged, 1 Month - Ambient Temp. | 7880 | 7000 | 6420 |
| Aged, 1 Month - 100° F. Temp. | 8140 | 7000 | 6720 |
| Stability (Separation), 1 Month - Ambient Temp. | OK (0) | OK (0) | OK (0) |
| 1 Month - 100° F. Temp. | OK (0) | OK (0) | OK (0) |
| Available Chlorine %, Initial | 1.16 | 1.21 | 1.19 |
| Aged, 1 Month - Ambient Temp. | 1.09 | 1.12 | 1.07 |
| Aged, 1 Month - 100° F. Temp. | 0.95 | 1 | 0.98 |
| Aged, 4 Months - Ambient Temp. | | | |
| Laboratory Performance | | | |
| Cup Leakage (Current PADD), % | 53 (36) | 53 (36) | 64 (36) |
| Rel. Foam Generation (PADD CONTROL), to Soft Water | 25 (48) | 36 (48) | 19 (48) |
| Egg Cleaning % (PADD Control), 300 ppm, 120° F. | 7 (7) | 6 (7) | 14 (7) |
| Oatmeal Cleaning, % (PADD CONTROL), 300 ppm, 120° F. | 78 (49) | 25 (49) | 76 (49) |
| Filming Rating (PADD Control), 300 ppm, 120° F. | 2.4 (2.8) | 1.6 (2.8) | 2.6 (2.8) |
| Spotting Rating (PADD Control), 300 ppm, 120° F. | 2.4 (3.0) | 2.6 (3.0) | 1.6 (3.0) |

| | 10D | 10E | 10F |
|---|---|---|---|
| Deionized Water | 37.427 | 37.427 | 37.427 |
| Graphtol Green | 0.003 | 0.003 | 0.003 |
| Carbopol 614 | 0.800 | 0.800 | 0.800 |
| Sodium Hydroxide (50%) | 4.500 | 4.500 | 4.500 |
| Sodium Silicate (47.5%) | 20.830 | 20.830 | 20.830 |
| Sodium TPP-Anhydrous | 15.000 | 13.000 | 11.000 |
| Potassium TPP-Anhydrous | 5.000 | 7.000 | 9.000 |
| Sodium Polyacrylate LMW 45N (45%) | 4.440 | 4.440 | 4.440 |
| Dowfax 3B2 (45%) | 0.600 | 0.600 | 0.600 |
| LPKN 158 - Defoamer | 0.200 | 0.200 | 0.200 |
| Stearic Acid - Hystrene 5016 | 0.100 | 0.100 | 0.100 |
| Sodium Hypochlorite (12%) | 11.100 | 11.100 | 11.100 |
| Density | 1.09 | 1.26 | 1.25 |
| pH (1% solution) | | | |
| Viscosity, 1 WK - Ambient | 10450 | 9275 | 8050 |
| Aged, 1 Month - Ambient Temp. | 11060 | 9260 | 8480 |
| Aged, 1 Month - 100° F. Temp. | 10720 | 9520 | 9420 |
| Stability (Separation), 1 Month - Ambient Temp. | OK (0) | OK (0) | OK (0) |
| 1 Month - 100° F. Temp. | OK (0) | OK (0) | OK (0) |
| Available Chlorine %, Initial | 1.24 | 1.19 | 1.17 |
| Aged, 1 Month - Ambient Temp. | 1.22 | 1.07 | 1.03 |
| Aged, 1 Month - 100° F. Temp. | 0.97 | 1.1 | 0.94 |
| Aged, 4 Months - Ambient Temp. | | | |
| Cup Leakage (Current PADD), % | 41 (36) | 52 (36) | 55 (36) |
| Rel. Foam Generation (PADD Control) to Soft Water | 22 (46) | 25 (48) | 22 (48) |
| Egg Cleaning, % (PADD Control), 300 ppm, 120° F. | 9 (7) | 7 (7) | 7 (7) |
| Oatmeal Cleaning, % | 82 (49) | 82 (49) | 86 (49) |

-continued

| | | | |
|---|---|---|---|
| (PADD Control), 300 ppm, 120° F. | | | |
| Filming Rating (PADD Control), 300 ppm, 120° F. | 1.8 (2.8) | 2.3 (2.8) | 2.4 (2.8) |
| Spotting Rating (PADD Control), 300 ppm, 120° F. | 1.3 (3.0) | 1.6 (3.0) | 1.5 (3.0) |

| | 10G | 10H | 10I |
|---|---|---|---|
| Deionized Water | 41.867 | 41.867 | 41.867 |
| Graphtol Green | 0.003 | 0.003 | 0.003 |
| Carbopol 614 | 0.800 | 0.800 | 0.800 |
| Sodium Hydroxide (50%) | 4.500 | 4.500 | 4.500 |
| Sodium Silicate (47.5%) | 20.830 | 20.830 | 20.830 |
| Sodium TPP-Anhydrous | 15.000 | 13.000 | 11.000 |
| Potassium TPP-Anhydrous Estimate | 5.000 | 7.000 | 9.000 |
| Sodium Polyacrylate - LMW 45N (45%) | 0.000 | 0.000 | 0.000 |
| Dowfax 3B2 (45%) | 0.600 | 0.600 | 0.600 |
| LPKn 158 - Defoamer | 0.200 | 0.200 | 0.200 |
| Stearic Acid - Hystrene 5016 | 0.100 | 0.100 | 0.100 |
| Sodium Hypochlorite (12%) | 11.100 | 11.100 | 11.100 |
| Density | 1.26 | 1.27 | 1.29 |
| pH (1% Solution) | | | |
| Viscosity, 1 WK - Ambient | 9050 | 7350 | 7100 |
| Aged, 1 Month - Ambient Temp. | 9420 | 8820 | 7600 |
| Aged, 1 Month - 100° F. Temp. | 9300 | 8140 | 7900 |
| Stability (Separation), 1 Month - Ambient Temp. | OK (0) | OK (0) | OK (0) |
| 1 Month - 100° F. Temp. | OK (0) | OK (0) | OK (0) |
| Available Chlorine %, Initial | 1.18 | 1.42 | 1.17 |
| Aged, 1 Month - Ambient Temp. | 1.1 | 1.14 | 1.09 |
| Aged, 1 Month - 100° F. Temp. | 1.07 | 0.99 | 0.96 |
| Aged, 4 Months - Ambient Temp. | | | |
| Cup Leakage (Current PADD), % | 52 (36) | 57 (36) | 60 (36) |
| Rel. Foam Generation (PADD Control) to Soft Water | 31 (48) | 33 (48) | 33 (48) |
| Egg Cleaning, % (PADD Control), 300 ppm, 120° F. | 18 (7) | 15 (7) | 11 (7) |
| Oatmeal Cleaning, % (PADD Control), 300 ppm, 120° F. | 34 (49) | 43 (49) | 72 (49) |
| Filming Rating (PADD Control), 300 ppm, 120° F. | 3.3 (2.8) | 3 (2.8) | 3 (2.8) |
| Spotting Rating (PADD Control), 300 ppm, 120° F. | 1.5 (3.0) | 2.6 (3.0) | 2.8 (3.0) |

EXAMPLE 11

Thixotropic aqueous stearate formulations (11A–11F) were prepared according to the procedure of Example 10.

| | 11A | 11B | 11C |
|---|---|---|---|
| Deionized Water | 39.327 | 39.327 | 39.327 |
| Graphtol Green | 0.003 | 0.003 | 0.003 |
| Carbopol 614 | 1.000 | 1.000 | 1.000 |
| Sodium Hydroxide (50%) | 6.380 | 6.380 | 6.380 |
| Sodium Silicate (47.5%) | 20.830 | 20.830 | 20.830 |
| Sodium TPP-Anhydrous | 12.000 | 10.000 | 8.000 |
| Potassium TPP-Anhydrous | 4.000 | 6.000 | 8.000 |
| Sodium Polyacrylate - LMW 45N (45%) | 4.440 | 4.440 | 4.440 |
| Dowfax 3B2 (45%) | 0.600 | 0.600 | 0.600 |
| LPKN 158 - Defoamer | 0.200 | 0.200 | 0.200 |
| Stearic Acid - Hystrene 5016 | 0.120 | 0.120 | 0.120 |
| Sodium Hypochlorite (12%) | 11.100 | 11.100 | 11.100 |
| Density | 1.2 | 1.32 | 1.29 |

-continued

| | | | |
|---|---|---|---|
| pH (1% Solution) | 11.54 | 11.54 | 11.48 |
| Viscosity, 1 WK - Ambient | 7550 | 6150 | 6450 |
| Aged, 1 Month - Ambient Temp. | 9200 | 8950 | 13400 |
| Aged, 1 Month - 100° F. Temp. | 9300 | 9000 | 11900 |
| Stability (Separation), 1 Month - Ambient Temp. | OK (0) | OK (0) | OK (0) |
| 1 Month - 100° F. Temp. | OK (0) | OK (0) | OK (0) |
| Available Chlorine %, Initial | 1.19 | 1.22 | 1.19 |
| Aged, 1 Month - Ambient Temp. | 1.17 | 1.18 | 1.15 |
| Aged, 1 Month - 100° F. Temp. | 1.05 | 1.03 | 1.04 |
| Aged, 4 Months - Ambient Temp. | | | |
| Cup Leakage (Current PADD), % | 32 (28) | 35 (28) | 20 (28) |
| Rel. Foam Generation (PADD Control) to Soft Water | | | |
| Egg Cleaning, % (PADD Control), 300 ppm, 120° F. | 29 (10) | 21 (10) | 17 (10) |
| Oatmeal Cleaning, % (PADD Control), 300 ppm, 120° F. | 73 (68) | 77 (68) | 56 (68) |
| Filming Rating (PADD Control), 300 ppm, 120° F. | 2 (2.8) | 2 (2.8) | 1.1 (2.8) |
| Spotting Rating (PADD Control), 300 ppm, 120° F. | 2.1 (2.5) | 2.3 (2.5) | 2 (2.5) |

| | 11D | 11E | 11F |
|---|---|---|---|
| Deionized Water | 35.347 | 35.347 | 35.347 |
| Graphtol Green | 0.003 | 0.003 | 0.003 |
| Carbopol 614 | 1.000 | 1.000 | 1.000 |
| Sodium Hydroxide (50%) | 6.380 | 6.380 | 6.380 |
| Sodium Silicate (47.5%) | 20.830 | 20.830 | 20.830 |
| Sodium TPP-Anhydrous | 15.000 | 12.500 | 10.000 |
| Potassium TPP-Anhydrous-Estimate | 5.000 | 7.500 | 10.000 |
| Sodium Polyacrylate - LMW 45N (45%) | 4.440 | 4.440 | 4.440 |
| Dowfax 3B2 (45%) | 0.600 | 0.600 | 0.600 |
| LPKN 158 - Defoamer | 0.200 | 0.200 | 0.200 |
| Stearic Acid - Hystrene 5016 | 0.100 | 0.100 | 0.100 |
| Sodium Hypochlorite (12%) | 11.100 | 11.100 | 11.100 |
| Density | 1.3 | 1.34 | 1.33 |
| pH (1% Solution) | 11.43 | 11.54 | 11.57 |
| Viscosity, 1 WK - Ambient | 6950 | 4760 | 6100 |
| Aged, 1 Month - Ambient Temp. | 12400 | 10700 | 11200 |
| Aged, 1 Month - 100° F. Temp. | 11200 | 10600 | 14200 |
| Stability (Separation), 1 Month - Ambient Temp. | OK (0) | OK (0) | OK (0) |
| 1 Month - 100° F. Temp. | OK (0) | OK (0) | OK (0) |
| Available Chlorine %, Initial | 1.05 | 1.19 | 1.08 |
| Aged, 1 Month - Ambient Temp. | 1.01 | 1.12 | 1.21 |
| Aged, 1 Month - 100° F. Temp. | 0.93 | 0.92 | 0.92 |
| Aged, 4 Months - Ambient Temp. | | | |
| Cup Leakage (Current PADD), % | 20 (28) | 29 (28) | 24 (28) |
| Rel. Foam Generation (PADD Control) to Soft Water | | | |
| Egg Cleaning, % (PADD Control), 300 ppm, 120° F. | 23 (10) | 25 (10) | 23 (10) |
| Oatmeal Cleaning, % (PADD Control), 300 ppm, 120° F. | 64 (68) | 75 (68) | 30 (68) |
| Filming Rating (PADD Control), 300 ppm, 120° F. | 1.5 (2.8) | 1.6 (2.8) | 1.8 (2.8) |
| Spotting Rating (PADD Control), 300 ppm, 120° F. | 1.8 (2.5) | 2.1 (2.5) | 2.8 (2.5) |

EXAMPLE 12

Thixotropic aqueous stearate formulations (12A–12F) were prepared according to the procedure of Example 10.

| | 12A | 12B | 12C |
|---|---|---|---|
| Deionized Water | 32.68 | 32.68 | 32.68 |
| Graphtol Green | 0.00 | 0.00 | 10.00 |
| Carbapol 614 | 0.00 | 0.00 | 0.00 |
| Carbopol 940 | 0.50 | 0.00 | 0.50 |
| Sodium Hydroxide (50%) | 6.38 | 6.38 | 6.38 |
| Sodium Silicate (47.5%) | 20.83 | 20.83 | 20.83 |
| Sodium TPP-Anhydrous | 22.45 | 22.45 | 22.45 |

-continued

| | | | |
|---|---|---|---|
| Sodium Polyacrylate - LMW 45N (45%) | 5.00 | 5.00 | 5.00 |
| Dowfax 3B2 (45%) | 0.80 | 0.80 | 0.80 |
| LPKN 158 - Defoamer | 0.16 | 0.16 | 0.16 |
| Stearic Acid - Witco | 0.10 | 0.10 | 0.10 |
| Fragrance - BBA | 0.00 | 0.00 | 0.05 |
| Highlights | | | |
| Sodium Hypochlorite (12%) | 11.10 | 11.10 | 11.10 |
| Solids Content, % | 39.55 | 39.55 | 39.50 |
| Density | 1.37 | 1.36 | 1.34 |
| pH (1% Solution) | 11.60 | 11.59 | 11.59 |
| Viscosity, 1 WK, - Ambient | 14800.00 | 15000.00 | 13800.00 |
| Aged, 1 Month - Ambient Temp. | 14300.00 | 14000.00 | 13900.00 |
| Aged, 1 Month - 100° F. Temp. | 12900.00 | 12000.00 | 12700.00 |
| Aged, 2 Months - Ambient Temp. | 14400.00 | 11700.00 | 11600.00 |
| Aged, 2 Months - 100° F. Temp. | 13400.00 | 11300.00 | 13200.00 |
| Aged, 4 Months - Ambient Temp. | 12000.00 | 11200.00 | 11000.00 |
| Aged, 4 Months - 100° F. Temp. | 10000.00 | 8700.00 | 8950.00 |
| Stability (Separation), 4 Months - Ambient Temp. | OK (0) | OK (0) | OK (0) |
| 4 Months - 100° F. Temp. | OK (0) | OK (0) | OK (Few Drops) |
| Available Chlorine %, Initial | 1.32 | 1.33 | 1.30 |
| Aged, 1 Month - Ambient Temp. | 1.24 | 1.26 | 1.19 |
| Aged, 2 Months - Ambient Temp. | 1.20 | 1.20 | 1.10 |
| Aged, 4 Months - Ambient Temp. | 0.96 | 1.05 | 0.92 |
| Bottle Residue (PADD Control) % | | | |
| Aged, 1 Month - Method A | 5.7 (6.2) | 7.1 (6.2) | 5.1 (6.2) |
| Aged, 1 Month - Method B | 2.7 (5.5) | 3.4 (5.5) | 2.5 (5.5) |
| Aged, 2 Months - Method A | 10.9 (9.4) | 12.4 (9.4) | 8.0 (9.4) |
| Aged, 2 Months - Method B | 4.8 (7.5) | 6.5 (4.5) | 5.5 (7.5) |
| Aged, 4 Months - Method A | 4.8 (16.4) | 4.8 (16.4) | 4.9 (16.4) |
| Aged, 4 Months - Method B | 2.6 (9.1) | 3.3 (9.1) | 2.3 (9.1) |
| Av. Bottle Res. Redu. (4 Month) 68% (A), 69% (B) | | | |
| Cup Leakage (Current PADD), % | 18 (24) | 15 (24) | 20 (24) |
| Rel. Foam Generation (PADD Control) to Soft Water | 29.00 | 24.00 | 19.00 |
| Egg Cleaning, % (PADD Control), 300 ppm, 120° F. | 36 (16) | 33 (16) | 39 (16) |
| Oatmeal Cleaning, % (PADD Control), 300 ppm, 120° F. | 90 (90) | 90 (90) | 90 (90) |
| Filming Rating (PADD Control), 300 ppm, 120° F. | 2 (3) | 1.9 (3) | 1.9 (3) |
| Spotting Rating (PADD Control), 300 ppm, 120° F. | 1.4 (2.6) | 1.0 (2.6) | 1.3 (2.6) |

| | 12D | 12E | 12F |
|---|---|---|---|
| Deionized Water | 32.63 | 32.58 | 32.58 |
| Graphtol Green | 0.00 | 0.00 | 0.00 |
| Carbopol 614 | 0.50 | 0.00 | 0.50 |
| Carbopol 940 | 0.00 | 0.50 | 0.00 |
| Sodium Hydroxide (50%) | 6.38 | 6.38 | 6.38 |
| Sodium Silicate (47.5%) | 20.83 | 20.83 | 20.83 |
| Sodium TPP-Anhydrous | 22.45 | 22.45 | 22.45 |
| Sodium Polyacrylate - LMW 45N (45%) | 5.00 | 5.00 | 5.00 |
| Dowfax 3B2 (45%) | 0.80 | 0.80 | 0.80 |

-continued

| | | | |
|---|---|---|---|
| LPKN 158 - Defoamer | 0.16 | 0.16 | 0.16 |
| Stearic Acid - Witco | 0.10 | 0.10 | 0.10 |
| Fragrance - BBR | 0.05 | 0.10 | 0.10 |
| Highlights | | | |
| Sodium Hypochlorite (12%) | 11.10 | 11.10 | 11.10 |
| Solids Content, % | 39.50 | 39.45 | 39.45 |
| Density | 1.37 | 1.36 | 1.31 |
| pH (1% solution) | 11.67 | 11.68 | 11.65 |
| Viscosity, 1 WK - Ambient | 13400.00 | 12800.00 | 13200.00 |
| Aged, 1 Month - Ambient Temp. | 13680.00 | 11000.00 | 12700.00 |
| Aged, 1 Month - 100° F. Temp. | 8720.00 | 10940.00 | 10570.00 |
| Aged, 2 Months - Ambient Temp. | 12000.00 | 12700.00 | 13200.00 |
| Aged, 2 Months - 100° F. Temp. | 10140.00 | 10560.00 | 10650.00 |
| Aged, 4 Months - Ambient Temp. | 11800.00 | 11200.00 | 11300.00 |
| Aged, 4 Months - 100° F. Temp. | 11800.00 | 11600.00 | 10100.00 |
| Stability (Separation), 4 Month - Ambient Temp. | OK (Few Drops) | OK (0) | OK (Few Drops) |
| 4 Months - 100° F. Temp. | OK (0) | OK (Few Drops) | OK (Top |
| Available Chlorine %, initial | 1.30 | 1.27 | 1.32 |
| Aged, 1 Month - Ambient Temp. | 1.23 | 1.24 | 1.19 |
| Aged, 2 Months - Ambient Temp. | 1.08 | 1.02 | 1.05 |
| Aged, 4 Months - Ambient Temp. | 0.96 | 0.94 | 0.94 |
| Bottle Residue (PADD control) % | | | |
| Aged, 1 Month - Method A | 9.9 (6.2) | 6.3 (6.2) | 6.9 (6.2) |
| Aged, 1 Month - Method B | 6.1 (5.5) | 2.9 (5.5) | 4.8 (5.5) |
| Aged, 2 Months - Method A | 6.2 (9.4) | 8.6 (9.4) | 5.3 (9.4) |
| Aged, 2 Months - Method B | 3.6 (7.5) | 1.8 (7.5) | 3.6 (7.5) |
| Aged, 4 Months - Method A | 5.3 (16.4) | 6.9 (16.4) | 4.8 (16.4) |
| Aged, 4 Months - Method B | 3.6 (9.1) | 2.6 (9.1) | 2.2 (9.1) |
| Av. Bottle Res. Redu. (4 Month) 68% (A), 69% (B) | | | |
| Cup Leakage (Current PADD), % | 16 (24) | 23 (24) | 21 (24) |
| Rel. Foam Generation (PADD Control) to Soft Water | — | — | — |
| Egg Cleaning, % (PADD Control), 300 ppm, 120° F. | — | — | — |
| Oatmeal Cleaning, % (PADD Control), 300 ppm, 120° F. | — | — | — |
| Filming Rating (PADD Control), 300 ppm, 120° F. | — | — | — |
| Spotting Rating (PADD Control), 300 ppm, 120° F. | — | — | — |

EXAMPLE 13

Thixotropic aqueous stearate formulations (13-A–13-I) were prepared according to the procedure of Example 10.

| | 13A | 13B | 13C |
|---|---|---|---|
| Deionized Water | 41.427 | 41.427 | 41.427 |
| Graphtol Green | 0.003 | 0.003 | 0.003 |
| Carbopol 614 | 0.800 | 0.800 | 0.800 |
| Sodium Hydroxide (50%) | 4.500 | 4.500 | 4.500 |
| Sodium Silicate (47.5%) | 20.830 | 20.830 | 20.830 |
| Sodium TPP-Anhydrous | 13.000 | 11.000 | 9.000 |

-continued

| | | | |
|---|---|---|---|
| Potassium TPP-Anhydrous | 3.000 | 5.000 | 7.000 |
| Sodium Polyacrylate - LMW 45N (45%) | 4.440 | 4.440 | 4.440 |
| Dowfax 3B2 (45%) | 0.600 | 0.600 | 0.600 |
| LPKN 158 - Defoamer | 0.200 | 0.200 | 0.200 |
| Stearic Acid - Hystrene 5016 | 0.100 | 0.100 | 0.100 |
| Sodium Hypochlorite (12%) | 11.100 | 11.100 | 11.100 |
| Solids Content, % | | | |
| Density | 1.24 | 1.3 | 1.29 |
| pH (1% Solulion) | | | |
| Viscosity, 1 WK - Ambient | 7200 | 7225 | 6700 |
| Aged, 1 Month - Ambient Temp. | 7880 | 7000 | 6420 |
| Aged, 1 Month - 100° F. Temp. | 8140 | 7000 | 6720 |
| Stability (Separation), 1 Month - Ambient Temp. | OK (0) | OK (0) | OK (0) |
| 1 Month - 100° F. Temp. | OK (0) | OK (0) | OK(0) |
| Available Chlorine %, Initial | 1.16 | 1.21 | 1.19 |
| Aged, 1 Month - Ambient Temp. | 1.09 | 1.12 | 1.07 |
| Aged, 1 Month - 100° F. Temp. | 0.95 | 1 | 0.98 |
| Av. Bottle Res. Redu. (4 Month) 68% (A), 69% (B) | | | |
| Cup Leakage (Current PADD), % | 53 (36) | 53 (36) | 64 (36) |
| Rel. Foam Generation (PADD Control) to Soft Water | 25 (48) | 36 (48) | 19 (48) |
| Egg Cleaning, % (PADD Control), 300 ppm, 120° F. | 7 (7) | 6 (7) | 14 (7) |
| Oatmeal Cleaning, % (PADD Control), 300 ppm, 120° F. | 78 (49) | 25 (49) | 76 (49) |
| Filming Rating (PADD control), 300 ppm, 120° F. | 2.4 (2.8) | 1.6 (2.8) | 2.6 (2.8) |
| Spotting Rating (PADD Control), 300 ppm, 120° F. | 2.4 (3.0) | 2.6 (3.0) | 1.6 (3.0) |

| | 13D | 13E | 13F |
|---|---|---|---|
| Deionized Water | 37.427 | 37.427 | 37.427 |
| Graphtol Green | 0.003 | 0.003 | 0.003 |
| Carbopol 614 | 0.800 | 0.800 | 0.800 |
| Sodium Hydroxide (50%) | 4.500 | 4.500 | 4.500 |
| Sodium Silicate (47.5%) | 20.830 | 20.830 | 20.830 |
| Sodium TPP-Anhydrous | 15.000 | 13.000 | 11.000 |
| Potassium TPP-Anhydrous | 5.000 | 5.000 | 5.000 |
| Sodium Polyacrylate - LMW 45N (45%) | 4.440 | 4.440 | 4.440 |
| Dowfax 3B2 (45%) | 0.600 | 0.600 | 0.600 |
| LPKN 158 - Defoamer | 0.200 | 0.200 | 0.200 |
| Stearic Acid - Hystrene 5016 | 0.100 | 0.100 | 0.100 |
| Sodium Hypochlorite (12%) | 11.100 | 11.100 | 11.100 |
| Density | 1.09 | 1.26 | 1.25 |
| Viscosity, 1 WK - Ambient | 10450 | 9275 | 8050 |
| Aged, 1 Month - Ambient Temp. | 11060 | 9260 | 8480 |
| Aged, 1 Month - 100° F. Temp. | 10720 | 9520 | 9420 |
| Stability (Separation), 1 Month - Ambient Temp. | OK (0) | OK (0) | OK (0) |
| 1 Month - 100° F. Temp. | OK (0) | OK (0) | OK (0) |
| Available Chlorine %, Initial | 1.24 | 1.19 | 1.17 |
| Aged, 1 Month - Ambient Temp. | 1.22 | 1.07 | 1.03 |
| Aged, 1 Month - 100° F. Temp. | 0.97 | 1.1 | 0.94 |
| Av. Bottle Res. Redu. (4 month) 68% (A), 69% (B) | | | |
| Cup Leakage (Current PADD), % | 41 (36) | 52 (36) | 55 (36) |
| Rel. Foam Generation (PADD Control) to Soft Water | 22 (48) | 25 (48) | 22 (48) |
| Egg Cleaning, % (PADD Control), 300 ppm, 120° F. | 9 (7) | 7 (7) | 7 (7) |
| Oatmeal Cleaning, % (PADD Control), 300 ppm, 120° F. | 82 (49) | 82 (49) | 86 (49) |
| Filming Rating (PADD Control), 300 ppm, 120° F. | 1.8 (2.8) | 2.3 (2.8) | 2.4 (2.8) |
| Spotting Rating (PADD Control), 300 ppm, 120° F. | 1.3 (3.0) | 1.6 (3.0) | 1.5 (3.0) |

| | 13G | 13H | 13I |
|---|---|---|---|
| Deionized Water | 41.867 | 41.867 | 41.867 |
| Graphtol Green | 0.003 | 0.003 | 0.003 |
| Carbopol 614 | 0.800 | 0.800 | 0.800 |
| Sodium Hydroxide (50%) | 4.500 | 4.500 | 4.500 |
| Sodium Silicate (47.5%) | 20.830 | 20.830 | 20.830 |
| Sodium TPP-Anhydrous | 15.000 | 13.000 | 11.000 |
| Potassium TPP-Anhydrous | 5.000 | 7.000 | 9.000 |
| Sodium Polyacrylate - LMW 45N (45%) | 0.000 | 0.000 | 0.000 |
| Dowfax 3B2 (45%) | 0.600 | 0.600 | 0.600 |
| LPKN 158 - Defoamer | 0.200 | 0.200 | 0.200 |
| Stearic Acid - Hystrene 5016 | 0.100 | 0.100 | 0.100 |
| Sodium Hypochlorite (12%) | 11.100 | 11.100 | 11.100 |
| Density | 1.26 | 1.27 | 1.29 |
| Viscosity, 1 WK - Ambient | 9050 | 7350 | 7100 |
| Aged, 1 Month - Ambient Temp. | 9420 | 8820 | 7600 |
| Aged, 1 Month - 100° F. Temp. | 9300 | 8140 | 7900 |
| Stability (Separation), 1 Month - Ambient Temp. | OK (0) | OK (0) | OK (0) |
| 1 Month - 100° F. Temp. | OK (0) | OK (0) | OK (0) |
| Available Chlorine %, Initial | 1.18 | 1.42 | 1.17 |
| Aged, 1 Month - Ambient Temp. | 1.1 | 1.14 | 1.09 |
| Aged, 1 Month - 100° F. Temp. | 1.07 | 0.99 | 0.96 |
| Av. Bottle Res. Redu. (4 Month) 68% (A), 69% (B) | | | |
| Cup Leakage (Current PADD), % | 52 (36) | 57 (36) | 60 (36) |
| Rel. Foam Generation (PADD Control) to Soft Water | 31 (48) | 33 (48) | 33 (48) |
| Egg Cleaning, % (PADD Control), 300 ppm, 120° F. | 18 (7) | 15 (7) | 11 (7) |
| Oatmeal Cleaning, % (PADD Control), 300 ppm, 120° F. | 34 (49) | 43 (49) | 72 (49) |
| Filming Rating (PADD Control), 300 ppm, 120° F. | 3.3 (2.8) | 3 (2.8) | 3 (2.8) |
| Spotting Rating (PADD Control), 300 ppm, 120° F. | 1.5 (3.0) | 2.6 (3.0) | 2.8 (3.0) |

EXAMPLE 14

In order to demonstrate the effect of the polycarboxylic acid stabilizer, polycarboxylic acid containing liquid ADD formulation were prepared as follows: Using a high shear mixer the following premix was made:

| Part I - Premix | Grams |
|---|---|
| Deionized water at room temperature | 442.8 |
| Glass H[1] | 10.0 |
| Adipic Acid | 10.66 |
| LPKN-158 Defoamer[2] | 341.2 |
| Dowfax 3B2[3] | 85.3 |

187.5 grams of the premix was transferred into a low shear mixer and the following ingredients were added with stirring to the 187.5 grams of the premix.

| Part II Post Added Ingredients | Grams |
|---|---|
| Deionized water | 717.8 |
| Color | 0.024 |
| NaOH 50% (solution in water) | 48.0 |
| Sodium Silicate 47.5% of $Na_2O$ Si $O_2$ Ratio of 1:2.4 | 139.8 |
| Thermphos N hexa | 240.0 |
| Thermphos NW | 240.0 |
| Sodium Hypochlorite Solution (11% available chlorine) | 152.2 |

[1]Glass H is a linear polyphosphate containing approximately 26 phosphate groups.
[2]Dowfax 3B-2 is a 45% Na monodecyl/didecyl diphenyl oxide disulphonate - aqueous solution.
[3]LPKN-158 is an anti-foam agent comprising a 2:1 molar mixture of mono,-di-($C_{16}$–$C_{18}$) alkyl esters of phosphoric acid.

The initial Brookfield viscosity of the composition using a #4 spindle at 20 rpm at room temperature was 4,340 cps. The Brookfield viscosity at 100° F. after three weeks was 4,200 cps and after three weeks at room temperature was 4,680 cps. The formulation was tested for percentage of the formulation which settled from solution after standing both at 100° F. and at room temperature for three weeks. Both samples exhibited 0.0% settling.

EXAMPLE 15

A formulation was prepared according to the procedure of Example 14 except that azelaic acid was used instead of adipic acid. The Brookfield viscosity at room temperature using a #4 spindle at 20 rpm was 5400 cps and was 4260 at 100° F. after three weeks and 5640 cps after three weeks at room temperature. The percent settling after three weeks both at room temperature and 100° F. was 0.0%.

EXAMPLE 16

In order to demonstrate the effect of the metal salt stabilizer liquid ADD formulations are prepared with varying amounts of stabilizer and thixotropic thickener,

| | |
|---|---|
| Deionized water | 41.10 + y − x |
| Caustic soda solution (50% NaOH) | 2.20 |
| Sodium carbonate, anhydrous | 5.00 |
| Sodium silicate, 47.5% solution of $Na_2O$:$SiO_2$ ratio of 1:2.4 | 15.74 |
| Sodium TPP (substantially anhydrous-i.e. 0–5%, especially 3%, moisture) (Thermphos NW) | 12.00 |
| Sodium TPP (hexahydrate) (Thermphos N hexa) | 12.00 |

-continued

The mixture is cooled at 25°–30° C. and agitation maintained throughout, and the following ingredients at room temperature are added thereto:

| | |
|---|---|
| Sodium hypochlorite solution (11% available chlorine) | 9.00 |
| Monostearylphosphate | 0.16 |
| DOWFAX 3B-2 (45% Na monodecyl/diphenyl oxide disulphonate-aqueous solution) | 0.8 |
| Physical stabilizer (fatty acid salt) | x |
| Gel White H | 2.00 − y |

The monostearyl phosphate foam depressant and Dowfax 3B-2 detergent active compound are added to the mixture just before the aluminum tristearate or zinc distearate stabilizer or right before the Gel White H thickener.

Each of the resulting liquid ADD formulations as show in the following Table are measured for density, apparent viscosity at 3 and 30 rpm, and physical stability (phase-separation) on standing and in a shipping test. The results are also shown in Table I.

From the data reported in the Table, the following conclusions are reached:

The incorporation of 0.2% Al stearate in a 1.5% Gel White H containing formula, as well as the incorporation of 0.1% Al stearate or of 0.1% zinc stearate in a 2% Gel White H containing formula leads to a simultaneous increase of the physical stability and of the apparent viscosity Runs 1 (control), 2, 6, and 9.

Similar results are observed with 0.1% calcium distearate or 0.1% Radiastar 1100 incorporated with 2% Pharmagel H (a bentonite clay) (Runs 12 (control), 13 and 14).

The incorporation of 0.1% or 0.2% Al stearate in a 1% Gel White H containing formula, of 0.2% Al stearate in a 0.5% Gel White H containing formula, and of 0.3 to 0.4% Al stearate in a 0.25% Gel White H containing formula leads to an increase of the physical stability without any drastic viscosity increase Runs 1 (control), 3, 4, 7, 10 and 11).

For the combination of 0.1% Al stearate and 0.5% Gel White H (Run 8) the apparent viscosity values remain acceptable but no significant improvement in physical stability is obtained.

The polyvalent metal salts of short chain fatty acids do not provide or in fact impair physical stability (Runs 15 and 16).

| RUN | FORMULATION | DENSITY ($g/cm^3$) | BROOK. LVT VISCOSITY (KCPS) (1) 3 RPM | 30 RPM | UNSHAKEN LIQUID SEPARATION (%) (AFTER 12 WEEKS) 4° C. IN GLASS (2) | RT IN GLASS (2) | 35° C. IN GLASS (2) | 43° C. IN GLASS (2) | RT IN PLASTIC (3) | SHIPPING TEST % (4) |
|---|---|---|---|---|---|---|---|---|---|---|
| 1 (Control) | $H_2O$ = 41.1% Stabilizer = 0+/−0.002 (X = 0) Gel White H = 2.0% (Y = 0) | 1.28 | 15 +/−5 | 4 +/−1 | 2–8 | 0–8 | 0–4 | 0 | 6–16 | 9–12 |
| 2 | $H_2O$ = 41.4% | 1.29 | 43 | 5.9 | 0 | 0 | 0 | 0 | 0 | 0 |

-continued

| RUN | FORMULATION | DENSITY (g/cm³) | BROOK. LVT VISCOSITY (KCPS) (1) 3 RPM | 30 RPM | 4° C. IN GLASS (2) | UNSHAKEN LIQUID SEPARATION (%) (AFTER 12 WEEKS) RT IN GLASS (2) | 35° C. IN GLASS (2) | 43° C. IN GLASS (2) | RT IN PLASTIC (3) | SHIPPING TEST % (4) |
|---|---|---|---|---|---|---|---|---|---|---|
| | Al Stearate = 0.2% (X = 0.2%) Gel White H = 1.5% (Y = 0.5) | | | | | | | | | |
| 3 | $H_2O$ = 41.9% | 1.30 | 26 | 6.1 | 0 | 0 | 0 | 0 | 0 | 0 |
| | Al Stearate = 0.2% (X = 0.2) Gel White H = 1% (Y = 1.0) | | | | | | | | | |
| 4 | $H_2O$ = 42.4% | 1.33 | 11 | 3.8 | <1 | 0 | 5 | 0 | 2 | 0 |
| | Al Stearate = 0.2% (X = 0.2) Gel White H = 0.5% (Y = 1.5) | | | | | | | | | |
| 5 | $H_2O$ = 42.65% | 1.35 | 4 | 1.7 | 0 | 0 | 0 | 0 | 2 | 0-13 |
| | Al Stearate = 0.2% (X = 0.2) Gel White H = 0.25% (y = 1.75) | | | | | | | | | |
| 6 | $H_2O$ = 41.0% | 1.26 | 36 | 9 | 0 | 0 | 0 | 0 | 2 | 0-13 |
| | Al Stearate = 0.1% Gel White H = 2% | | | | | | | | | |
| 7 | $H_2O$ = 42.0% | 1.30 | 17 | 5 | 0 | 0 | 0 | 0 | 0-5 | — |
| | Al Stearate = 0.1% Gel White H = 1% | +/−0.01 | +/−4 | +/−2 | | | | | | |
| 8 | $H_2O$ = 42.5% | 1.31 | 10 | 3.5 | 8 | 4 | <2 | <2 | 9 | — |
| | Al Stearate = 0.1% Gel White H = 0.5% | | | | | | | | | |
| 9 | $H_2O$ = 4.5% | 1.25 | 40 | 4.6 | 0 | 0 | 0 | 0 | 0 | — |
| | Zn di-stearate = 0.1% Gel White H = 2% | | | | | | | | | |
| 10 | $H_2O$ = 42.55% | 1.35 | 6 | 2.6 | 0 | 0 | 0 | 0 | 0 | 0 |
| | Al Stearate = 0.3% Gel White H = 0.25% | | | | | | | | | |
| 11 | $H_2O$ = 42.45% | 1.35 | 10 | 2.9 | 0 | 0 | 0 | 0 | 0 | 0 |
| | Al Stearate = 0.4% Gel White H = 0.25% | | | | | | | | | |
| 12 | $H_2O$ = 41.1% | 1.25+ | 13+ | 4+ | 2+ | 7+ | 0 | 0 | | |
| (Control) | Stabilizer = 0(x = 0) Pharmagel H = 2.0% (Bentomic clay) | 0.02 | 4 | 2 | 7 | 7 | | | 2 | 2 |
| 13 | $H_2O$ = 41.1% | 1.22 | 24 | 3.8 | 0 | 0 | 0 | 0 | 0 | 0 |
| | Ca Distearate = 0.1% Pharmagel H = 2.0% | | | | | | | | | |
| 14 | $H_2O$ = 41.1% | 1.25 | 26 | 7.5 | 0 | 0 | 0 | 0 | 0 | 0 |
| | Radiastar 1100(5) = 0.1% Pharmagel H = 2.0% | | | | | | | | | |
| 15 | $H_2O$ = 41.1% | 1.31 | 10 | 1.9 | | Unshaken liquid separation = 8% After 2 weeks at RT in glass | | | | |
| | Zinc di acetate = 0.1% Pharmagel H = 2.0% | | | | | | | | | |
| 16 | $H_2O$ = 41.1% | — | | | | phase separation after 1 day | | | | |
| | Mg diacetate = 0.1% Pharmagel H = 2.0% | | | | | | | | | |

Notes to Table I
(1) Measured with spindle 4 after 3 minutes on 24 hour old samples.
(2) In Height (RT = room temperature = 20 ± 2° C.)
(3) In weight (RT = room temperature = 20 ± 2° C.)
(4) Liquid separation measured after 6 weeks and 3000 Kms is a private car (in weight in a plastic bottle).
(5) Radiastar 1100 is an industrial grade mixture of saturated fatty acids in the form of their magnesium salts (trademarked product of Olefina).

EXAMPLE 17

Using the same composition and preparation method as in Example 16 except that in place of Gel White H as the thixotropic thickener, 2% of Attagel 50 (an attapulgite clay) or 0.4% of Bentone EW (a specifically processed Hectorite clay) was used with (Runs 2 and 4) or without (control Runs 1 and 3) aluminum tristearate. The apparent viscosities and physical stabilities were measured in the same manner as described for Example 16. The results are shown in The following Table.

From the results shown in the Table, it can be seen that small amounts of aluminum stearate are equally effective in increasing the physical stability of attapulgite clay and hectorite clay based liquid thixotropic automatic dishwasher detergent compositions, with the degree of physical stability increase again being dependent on the amounts of stabilizer and thickening agent.

| RUN | FORMULATION | DENSITY (g/cm³) | BROOK. LVT VISCOSITY (KCPS) (1) 3 RPM | 30 RPM | 4° C. IN GLASS (2) | UNSHAKEN LIQUID SEPARATION (%) (AFTER 12 WEEKS) RT IN GLASS (2) | 35° C. IN GLASS (2) | 43° C. IN GLASS (2) |
|---|---|---|---|---|---|---|---|---|
| 1 (Control) | $H_20$ = 42.7% Bentone EW = 0.4% instead of Gel White | 1.30 | liq. sep. after 1 day | | 25 | 32 | 32 | 17 |
| 2 | As above 0.1% but with Al tristearate just before Bentone $H^2O$ 42.6% | 1.33 | 5 | 2.1 | 4 | 5 | 6 | 8 |
| 3 (Control) | $H_2O$ = 41.1% Attagel 50 = 2% instead of Gel White H | 1.33 | 4 | 1.3 | 12 | 17 | 14 | 24 |
| 4 | As above 0.1% but with Al tristearate just before Attagal $H_2O$ = 41.0% | 1.36 | 6 | 1.7 | 3 | 0 | 0 | 0 |

(1) Measured with Spindle 4 after 3 minutes (24 hours after making);
(2) In height;
(3) In weight;

EXAMPLE 18

This example shows that inorganic aluminum and zinc salts, including $Al_2O_3$, $ZnSO_4$ and $Al_2(SO_4)_3$ and sodium stearate do not provide improved physical stability to the liquid thixotropic ADD compositions. Using the same formulation as in Run 6 of Example 16, 0.1% of each of $Al_2O_3$, $ZnSO_4$, $Al_2(SO_4)_3$ or sodium stearate was used in place of 0.1% aluminum stearate. The results of the measurement of apparent viscosity and physical stability are shown in the following Table.

EXAMPLE 19

The following gel-like thixotropic liquid ADD is prepared following the same general procedures as in Example 16:

| Ingredient | Amount (A.1.) wt % |
|---|---|
| pH = 13 to 13.4 | |
| $Na_2O/SiO_2$ = 1/2.4) | |
| Monostearyl phosphate | 0.16 |
| Dowfax 3B-2) | 0.36 |
| Thermphos NW | 12.0 |

| RUN | FORMULATION | DENSITY (g/cm³) | BROOK. LVT VISCOSITY (KCPS) (1) 3 RPM | 30 RPM | 4° C. IN GLASS (2) | UNSHAKEN LIQUID SEPARATION (%) (AFTER 12 WEEKS) RT IN GLASS (2) | 35° C. IN GLASS (2) | 43° C. IN GLASS (2) | RT IN PLASTIC (3) | SHIPPING TEST % (4) |
|---|---|---|---|---|---|---|---|---|---|---|
| 1 (Control) | $H_2O$ = 42.1% +/−0.002 (X = 0) Gel White H = 2.0% | 1.28 +/−5 | 15 +/−1 | 4 | 2–8 | 0–8 | 0–4 | 0 | 6–16 | 9–12 |
| 2 | $H_2O$ = 41.0% $Al_2(SO_4)_3$ = 0.1% instead of Al Stearate Gel White H = 2.0% | 1.30 | 10 | 4 | | Strong decantation after 4 weeks | | | | — |
| 3 | $H_2O$ = 41.0% $ZnSO_4$ = 0.1% instead of Al Stearate Gel White H = 2.0% | 1.32 | 8 | 2.9 | | Strong decantation after 4 weeks | | | | — |
| 4 | $H_2O$ = 41.0% $Al_2O_3$ = 0.1% instead of Al Stearate Gel White H = 2.0% | 1.29 | 15 | 4.1 | | Strong decantation after 4 weeks | | | | — |
| 5 | $H_2O$ - 41.0% addition of 0.1% $Al_2O_3$ in the first part of caustic soda Gel White H = 2.0% | 1.27 | 22 | 6.2 | | Strong decantation after 6 weeks | | | | — |
| 6 | $H_2O$ = 41.0% Stearic acid Na salt = 0.1% instead of Al Stearate Gel White H = 2.0% | 1.30 | 26 | 4.8 | 4 | 4 | 0 | 0 | 8 | — |

Notes:
(1)–(4) same as in Table 1

-continued

| Ingredient | Amount (A.1.) wt % |
|---|---|
| Thermphos N hexa | 12.0 |
| Aluminum tristearate | 0.1 |
| Sodium Carbonate, anhydrous | 5.0 |
| Caustic soda solution (50% NaOH) | 3.1 |
| Pharmagel Euroclay | 1.25 |
| Sodium silicate (47.5% sol'n MG/Al Silicate clay) | 7.48 |
| Sodium hypochlorite solution (11%) | 1.0 |
| Water | balance |

Minor amounts of perfume, color, etc. can also be added to formulation.

EXAMPLE 20

This example shows the preparation of liquid ADD formulations using a different preparation technique. The following formulation is prepared using a high shear mixer.

| Part 1 - Premix | Weight percent |
|---|---|
| Deionized water (at room temp.) | 37.75–41.75 |
| Phosphoric (defoamer) | 0.16 |
| Detergent (e.g. Dowfax 3B-2 (45% active) | 0.80 |
| Physical Stabilizer (e.g. calcium stearate) | 0.10 |
| Thixotropic agent (e.g. Gel White USP) | 1.25 |

The premix, in the required amount, is transferred into a low shear mixer. The following ingredients are then added sequentially, while stirring, to Part 1.

| Part II - Post Added Ingredients | |
|---|---|
| Sodium hydroxide (50% solution) | 1.00 |
| Sodium carbonate | 5.00 |
| Sodium silicate (47.5% solution) | 15.74 |
| Thermphos N hexa | 12.00 |
| Thermphos NW | 12.00 |
| Sodium hypochlorite (13% solution) | 9.00 |
| Sodium hydroxide (50% solution) | 1.20–5.20 |

EXAMPLE 21

In order to demonstrate the effect of the alkalinity on the fatty acid metal salt stabilized clay thickened liquid ADD formulations, compositions as shown in the following Table are prepared with varying amounts of alkaline compounds.

| | Amount (Weight/%) | | | | | | |
|---|---|---|---|---|---|---|---|
| Ingredient | Control | 1 | 2 | 3 | 4 | 5 | 6 |
| Water, deionized | 41.75 | 41.75 | 41.75 | 37.75 | 35.75 | 38.05 | 34.24 |
| Caustic soda, sol'n (50% NaOH) | 2.20 | 5.20 | 7.20 | 6.20 | 8.20 | 2.20 | 2.20 |
| $Na_2CO_3$ | 5.00 | 2.00 | — | 5.00 | 5.00 | — | — |
| $Na_2O.SiO_2$ (47.5% sol'n, $Na_2O:SiO_2$ = 1:2.4) | 15.74 | 15.74 | 15.74 | 15.74 | 15.74 | 15.74 | — |
| (57.5% sol'n, $Na_2O:SiO_2$ = 1:2.4) | — | — | — | — | — | 8.70 | — |
| (55.9% sol'n, $Na_2O:SiO_2$ = 1:2) | — | — | — | — | — | — | 28.25 |
| Sodium tripolyphosphate, anhydrous | 12.00 | 12.00 | 12.00 | 12.00 | 12.00 | 12.00 | 12.00 |
| Sodium tripolyphosphate, hexahydrate | 12.00 | 12.00 | 12.00 | 12.00 | 12.00 | 12.00 | 12.00 |
| Sodium hypochlorite 11% available chlorine) | 9.00 | 9.00 | 9.00 | 9.00 | 9.00 | 9.00 | 9.00 |
| Monostearyl phosphate | 0.16 | 0.16 | 0.16 | 0.16 | 0.16 | 0.16 | 0.16 |
| Dowfax 3B-2 (45% Na monodecyl/didecyl diphenyl oxide disulfonate-aqueous solution) | 0.80 | 0.80 | 0.80 | 0.80 | 0.80 | 0.80 | 0.80 |
| Aluminum tristearate | 0.10 | 0.10 | 0.10 | 0.10 | 0.10 | 0.10 | 0.10 |
| Pharmagel H, clay | 1.25 | 1.25 | 1.25 | 1.25 | 1.25 | 1.25 | 1.25 |
| TOTAL | 100.00 | 100.00 | 100.00 | 100.00 | 100.00 | 100.00 | 100.00 |
| ph of 10 g/liter | 10.9 | 11.4 | 11.7 | — | 11.8 | — | — |

In preparing these formulations, the monostearyl phosphate foam depressant and Dowfax 3B-2 detergent active compound are added to the mixture just before the Pharmagel H clay thickener; all of the NaOH is added after the clay. The resulting liquid ADD formulations as shown below are measured for cleaning performance; and for density, and physical stability (phase separation) on standing and in a shipping test. The results are shown as follows.

| | CLEANING PERFORMANCE | |
|---|---|---|
| Composition Run No. | Average Rating On Mixed Soils | Average Rating On Starchy Soils 2) |
| 1 | 5.71 | 3.80 |
| 2 | 5.85 | 4.00 |
| Control | 5.12 | 3.50 |
| Powder 1) | 6.11 | 4.61 |

1) Commercially available powdery ADD, pH = 12.2
2) Dishes with rice and cuttery with rice and porridge

| Composition Run No. | Density g/cm3 | Unshaken Liquid Separation Measured After 12 Weeks: Glass Bottle (% height) 4° C. | RT3) | 35° C. | 43° C. | CT Type Bottle (% in weight 4° C. | RT3) | 35° C. | 43° C. | 100 Days 1) RT3) | Shipping Test 2) % Separation (by weight) |
|---|---|---|---|---|---|---|---|---|---|---|---|
| 1 | 1.27 | | 0 | 0 | 0 | 0.2 | <0.1 | 0.4 | 0.5 | 1–0.5 | 0.7 |
| 2 | 1.27 | <2 | 0 | 0 | 0 | 1.4 | 0.3 | 3.0 | 5.0 | 1–0.5 | 0.7 |
| 3 | 1.30 | <2 | 0 | 0 | 0 | 0 | 0 | 0 | 0 | 0 | 0 |
| 4 | 1.31 | 3 | 0 | 0 | 0 | 2 | 0.2 | 0 | 0 | 0 | 1.5 |
| 5 | 1.30 | 0 | 0 | 0 | 0 | 0 | 0 | 0 | 0 | 0 | 0 |
| 6 | 1.28 | 3 | 0 | 0 | 0 | 0 | 0 | 0 | 0 | 0 | 0 |

1) Average measurement with 5 different CT bottles
2) Liquid separation measured after 6 weeks and 3000 kms in a private car in plastic bottles
3) Room temperature = 20–2° C.

EXAMPLE 22

The example 21 control composition and the compositions of Run Nos. 3 and 5 were aged at 4° C., room temperature (RT), 35° C. or 43° C. and the viscosity of each sample was measured after storage in a plastic bottle for 1, 4, 6 and 12 weeks with a Brookfield LVT viscometer using a No. 4 spindle at 3 rpm. The results are shown as follows:

| Composition Run No. | Temp (°C.) Time (weeks) | Viscosity (kcps) 4: 2 | 4 | 6 | 12 | RT: 2 | 4 | 6 | 12 | 35: 2 | 4 | 6 | 12 | 43: 2 | 4 | 6 | 12 |
|---|---|---|---|---|---|---|---|---|---|---|---|---|---|---|---|---|---|
| CONTROL | | 19 | 23 | 25 | 29 | 24 | 34 | 53 | 70 | 36 | 48 | — | 68 | — | 74 | 120 | 180 |
| 3 | | 25 | 27 | 26 | 18 | 30 | 48 | 28 | 23 | 40 | 23 | 22 | 31 | 38 | 24 | 28 | 18 |
| 5 | | 28 | 23 | 17 | 20 | 27 | 12 | 20 | 15 | 18 | 20 | 18 | 25 | 26 | 20 | 29 | 24 |

EXAMPLE 23

The Example 21 control composition and the compositions of Run Nos. 3 and 5 and a referential example in which the aluminum stearate of the control composition was omitted and the amount of clay increased to 2% were tested to measure rheological properties after standing at room temperature for 10 days, 6 weeks and 3 months. The results are shown as follows:

| Composition | Aging Time | Low Shear 3 rpm 60 (Pa) | nl (Pa.S) | High Shear 30 rpm 60 (Pa) | nl (Pa.S) | Thixotropy (Pa/S) | Apparent Viscosity 1.58 s-1 (Pa.S) | 25 s-1 (Pa.S) | 1585 (Pa.S) |
|---|---|---|---|---|---|---|---|---|---|
| Reference | 10 days | — | — | — | — | — | — | — | — |
| | 6 weeks | 6.2 | 28.9 | 34.0 | 0.014 | 766 | 21.5 | 1.65 | 0.33 |
| | 3 months | 6.3 | 21.1 | 19.0 | 0.007 | 269 | 15.6 | 0.93 | 0.19 |
| Control | 10 days | 6.9 | 35.1 | 34.0 | 0.001 | 1665 | 22.6 | 1.47 | 0.24 |
| | 6 weeks | — | — | — | — | — | — | — | — |
| | 3 months | 5.6 | 33.6 | 33.7 | 0.001 | 1450 | 22.2 | 1.42 | 0.23 |
| Run No. 3 | 10 days | 6.6 | 41.4 | 38.7 | 0.012 | 1971 | 23.0 | 1.86 | 0.34 |
| | 6 weeks | 6.8 | 37.9 | 39.2 | 0.013 | 1938 | 21.2 | 1.89 | 0.35 |
| | 3 months | 7.4 | 28.0 | 35.2 | 0.017 | 1397 | 18.1 | 1.73 | 0.35 |
| Run No. 5 | 10 days | 7.5 | 30.8 | 37.5 | 0.003 | 1665 | 21.2 | 1.66 | 0.29 |
| | 6 weeks | 7.1 | 31.8 | 34.1 | 0.008 | 1538 | 19.9 | 1.58 | — |
| | 3 months | 6.3 | 21.7 | 31.6 | 0.008 | 1215 | 16.4 | 1.43 | 0.28 |

EXAMPLE 24

Using the Example 21 control composition, and the compositions of Run Nos. 1, 3 and 5 the available chlorine levels remaining after storage at room temperature, 35° C. and 43° C. for 2, 4, 6 or 12 weeks was measured. The results are shown as follows:

| Composition | RESIDUAL CHLORINE LEVELS (% OF ORIGINAL) RT: 2 | 4 | 6 | 12 | 35° C.: 2 | 4 | 6 | 12 | 43° C.: 2 | 4 | 6 | 12 |
|---|---|---|---|---|---|---|---|---|---|---|---|---|
| Control | 96 | 94 | 90 | 77 | 85 | 80 | 75 | 55 | 66 | 51 | 35 | 18 |
| Run No. 1 | 98 | 96 | 95 | 88 | — | — | 92 | 68 | 96 | 74 | 64 | 40 |
| Run No. 3 | 91 | 92 | 89 | 74 | 84 | 78 | 72 | 52 | 57 | 55 | 30 | 22 |
| Run No. 5 | 98 | 95 | 93 | 84 | 92 | 92 | 90 | 64 | 76 | 66 | 59 | 33 |

EXAMPLE 25

The following formulations A–K were prepared as described below:

| INGREDIENT/ FORMULATION | A | B | C | D | E | F | G |
|---|---|---|---|---|---|---|---|
| DEIONIZED WATER | BALANCE | BALANCE | BALANCE | BALANCE | BALANCE | BALANCE | BALANCE |
| CARBOPOL 941 | 0.9 | 0.9 | 0.9 | 0.9 | 1 | — | 0.9 |
| NaOH (50%) | 2.4 | 2.4 | 2.4 | 2.4 | 3.5 | 3.5 | 2.4 |

-continued

Figure 2:
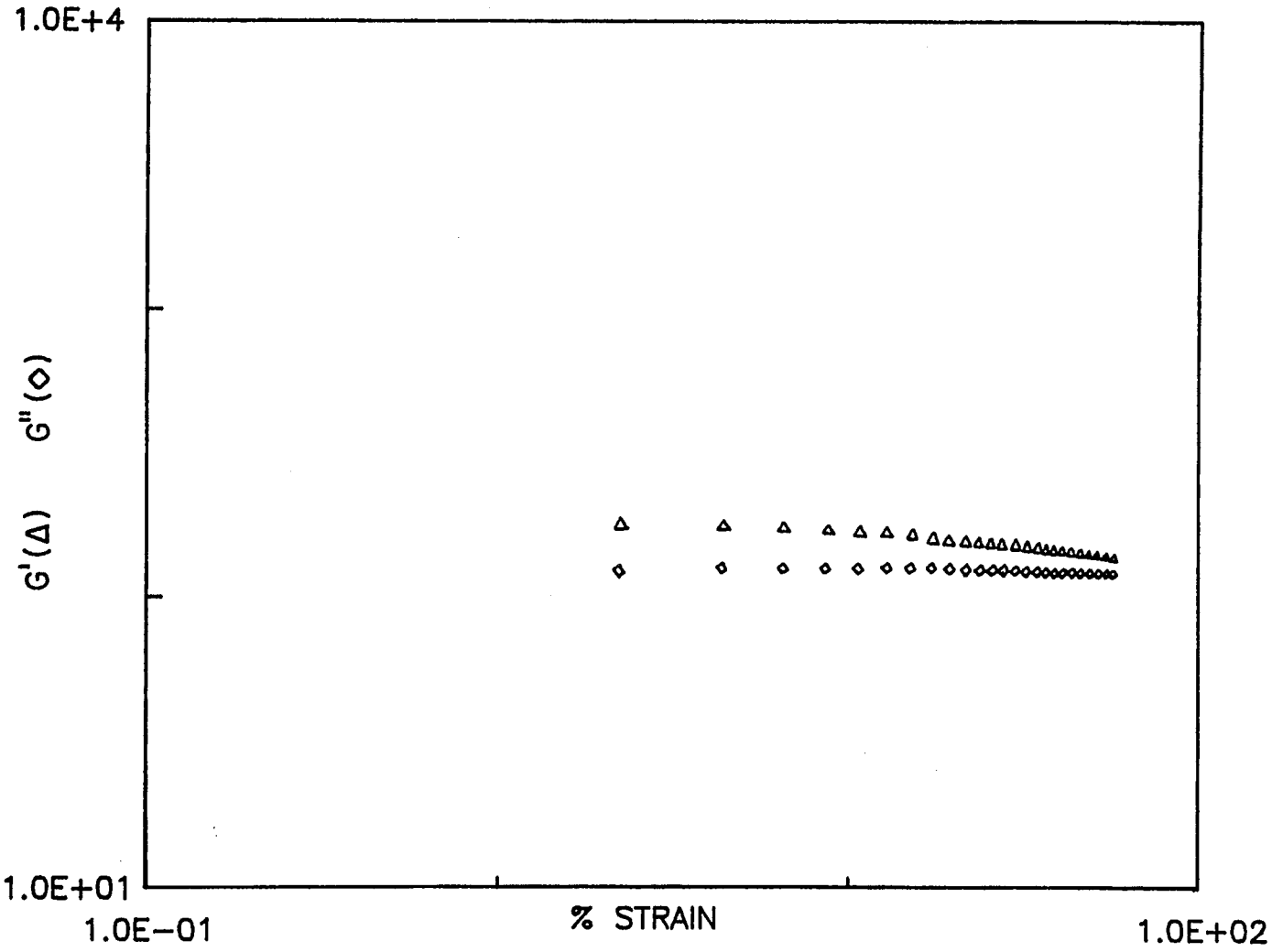
Figure 3:
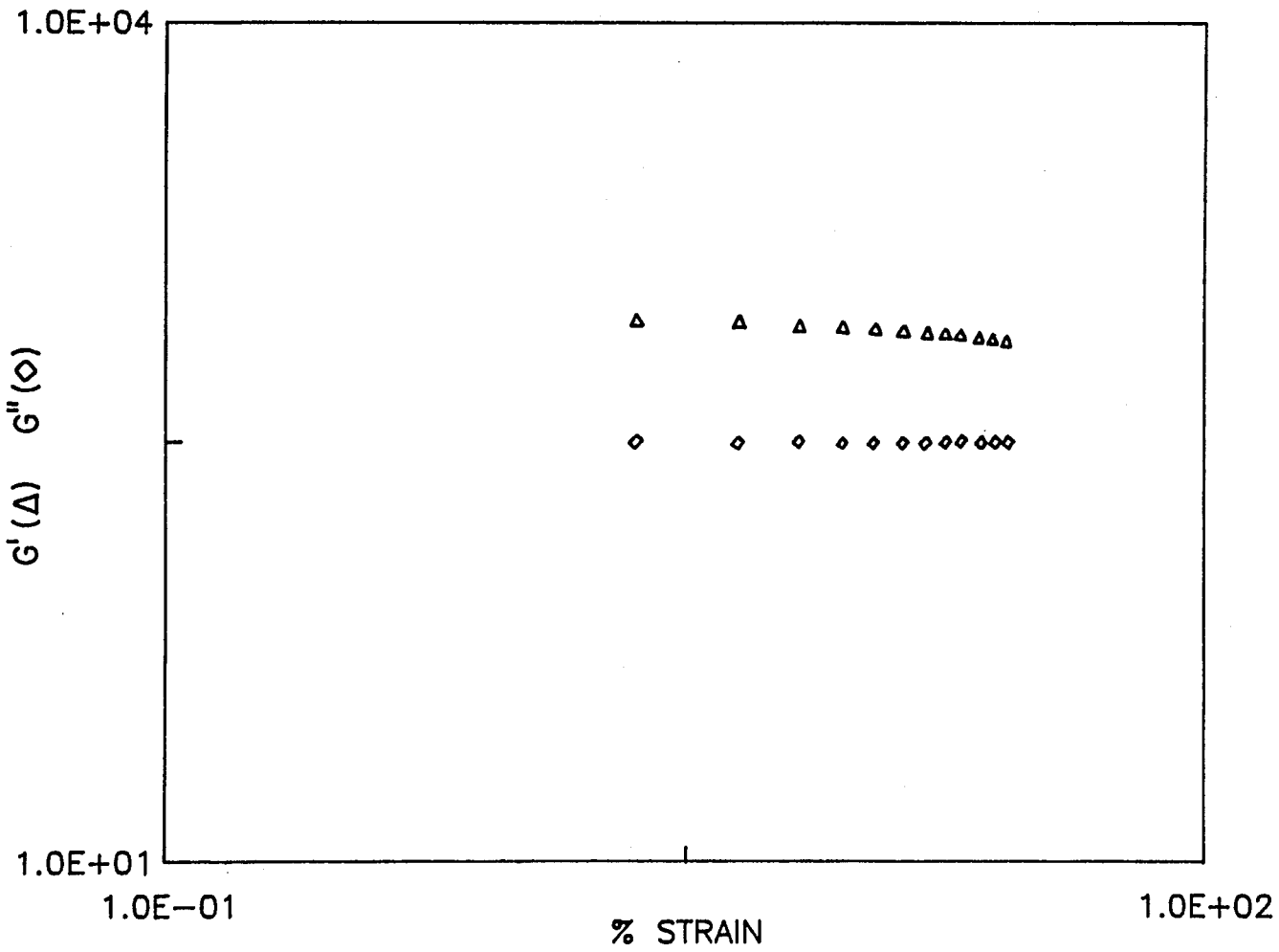
Figure 4:
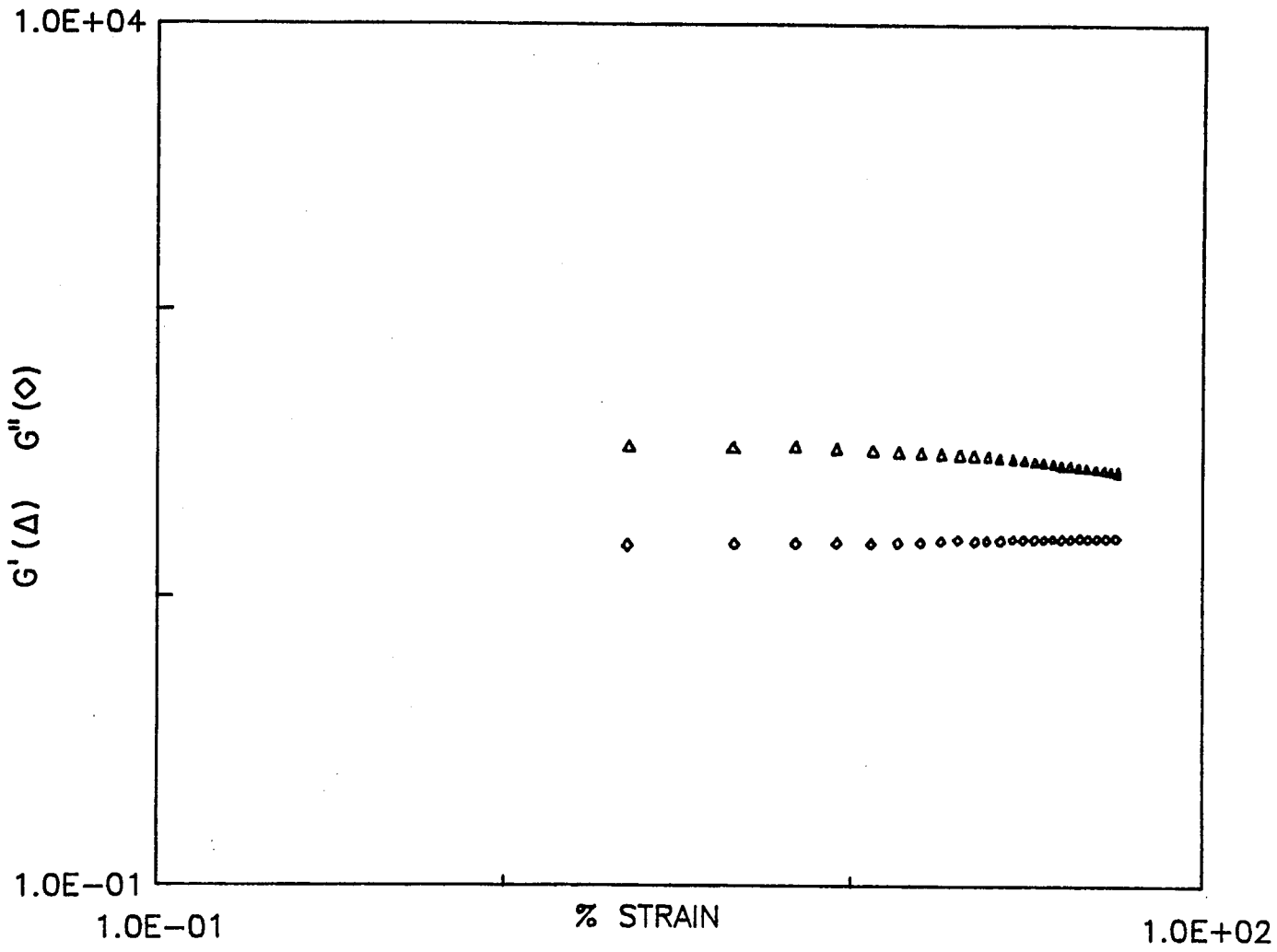
Figure 6:
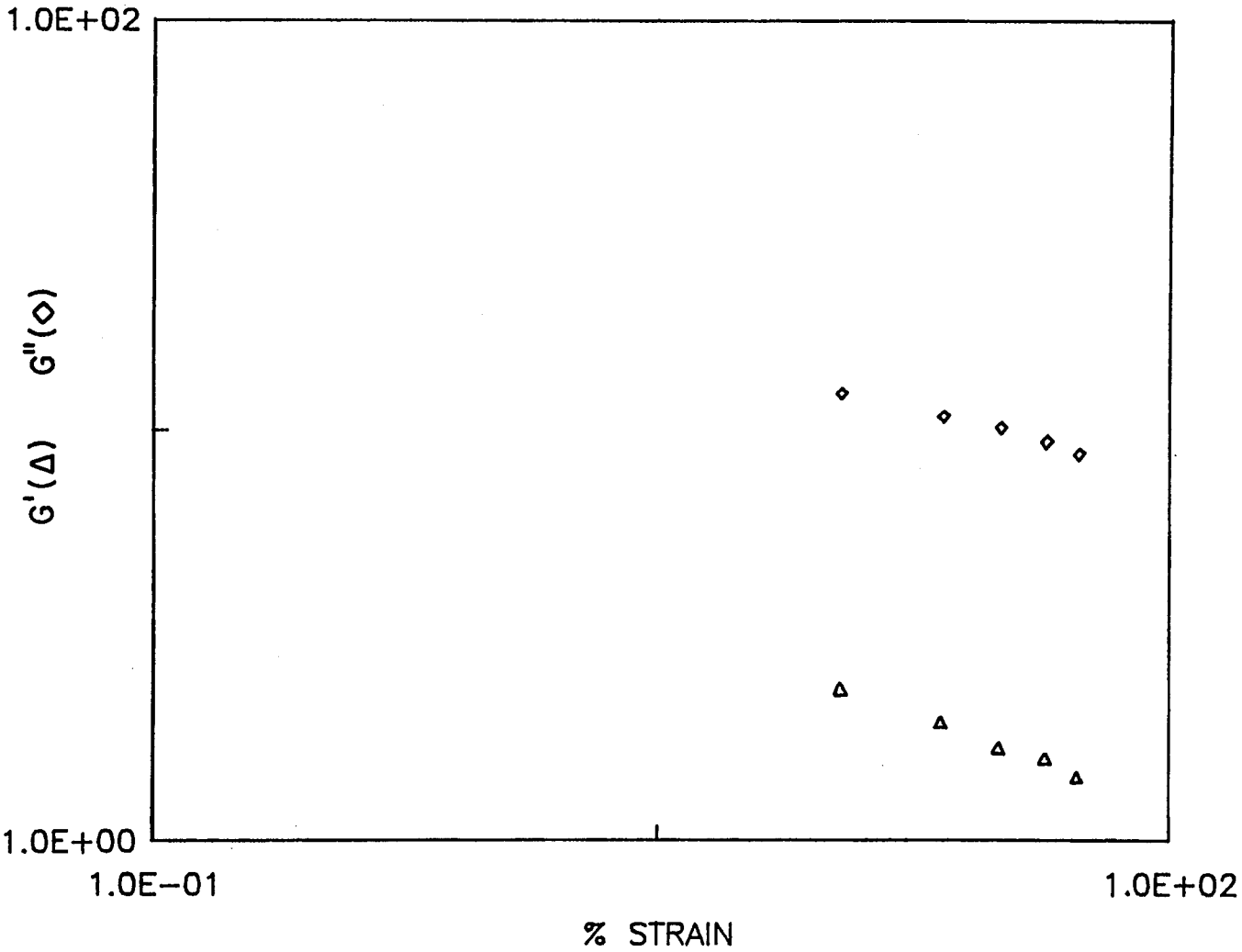
Figure 7:
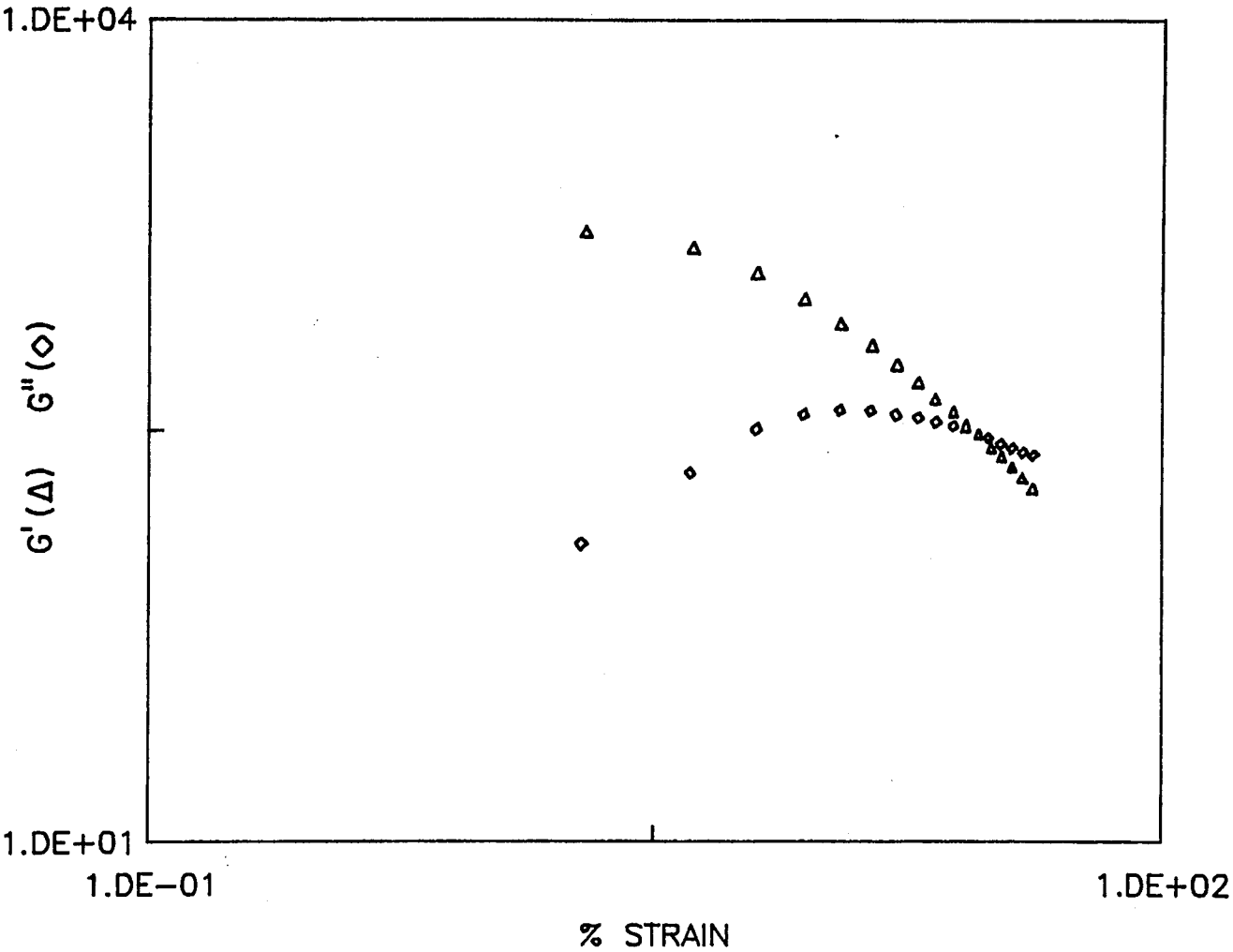

| | | | | | | | |
|---|---|---|---|---|---|---|---|
| KOH (50%) | — | — | — | — | — | — | — |
| TKPP | 15 | 15 | 15 | 20 | 20 | 20 | 28 |
| TPP HEXAHYDRATE, | 13 | 13 | 12 | 7.5 | 7.5 | 7.5 | — |
| Na SILICATE (47.5%) (1:2.3) | 21 | 21 | 21 | 21 | 17 | 17 | 21 |
| K SILICATE (29.1%) (1:2.3) | — | — | — | — | — | — | — |
| LPKN (5%) | 3.2 | 3.2 | 3.2 | 3.2 | — | — | 3.2 |
| DOWFAX 3B2 | 1 | 1 | 1 | 1 | 1 | 1 | 1 |
| FATTY ACID[2] | 0.1 | 0.1 | 0.1 | 0.1 | — | — | 0.1 |
| BLEACH (13.0% CL) | 7.5 | 7.5 | 7.5 | 7.5 | 9.1 | 9.1 | 7.5 |
| AIR[3] (VOL. %) | <2.0 | <2.0 | <2.0 | <2.0 | <2.0 | >2.0 | <2.0 |
| FRAGRANCE | — | 0.17 | — | — | — | — | — |
| K/Na RATIO | 1.12 | 1.12 | 1.16 | 1.89 | 1.95 | 1.95 | 4.16 |
| DENSITY (g/cc) | 1.37 | 1.37 | 1.35 | 1.37 | 1.36 | — | 1.37 |
| RHEOGRAM | FIG. 1 | FIG. 2 | FIG. 3 | FIG. 4 | FIG. 6 | FIG. 7 | |
| STABILITY RESULTS ROOM TEMP. 8 WEEKS (%) | 0.0 | 0.0 | 0.0 | 0.0 | >10.0 | >10.0 | 0.0 |
| STABILITY RESULTS 100° F., 6 WEEKS (%) | 0.0 | 0.0 | 0.0 | 0.0 | >10.0 | >10.0 | 0.0 |

Figure 5:
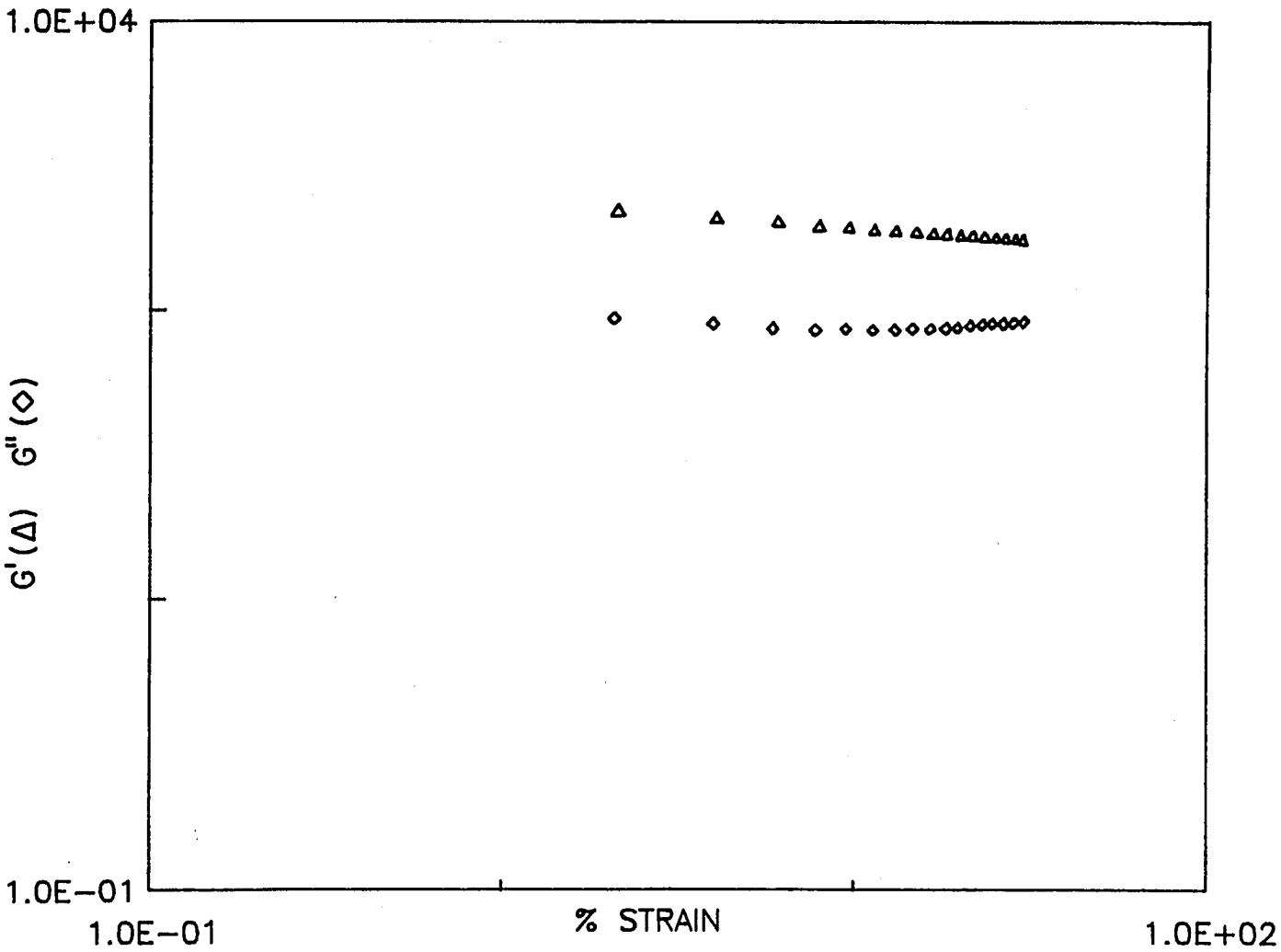
Figure 8:
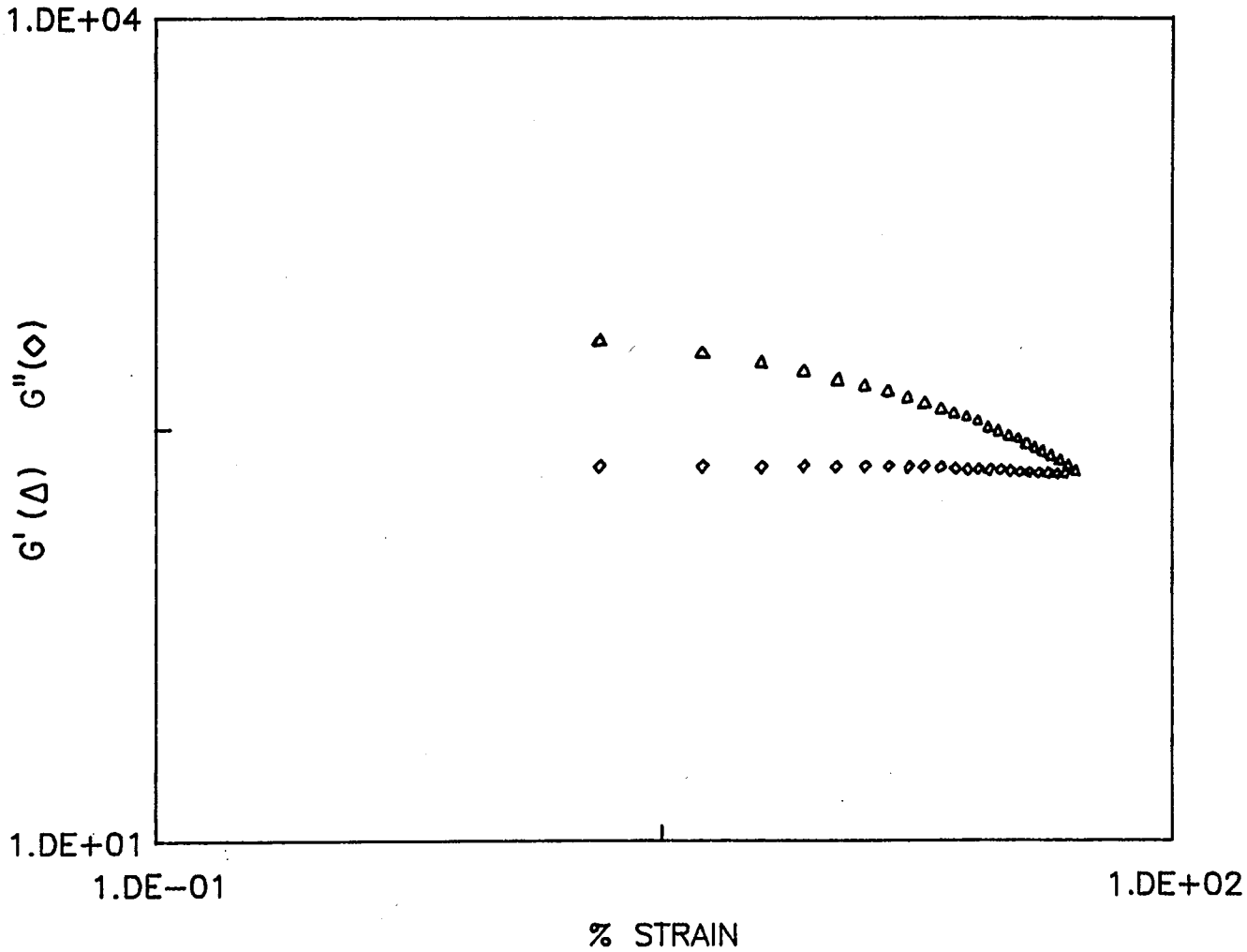

| INGREDIENT/FORMULATION | H | I | J | K |
|---|---|---|---|---|
| DEIONIZED WATER | BALANCE | BALANCE | BALANCE | BALANCE |
| CARBOPOL 941 | 0.9 | — | 1.5 | 0.91 |
| NaOH (50%) | — | 2.4 | 2.4 | 2.4 |
| KOH (50%) | 2.4 | — | — | — |
| TKPP | 28 | 15 | 20 | 15 |
| TPP HEXAHYDRATE, | — | 13 | 7.5 | 13 |
| Na SILICATE (47.5%) (1:2.3) | — | 21 | 21 | 21 |
| K SILICATE (29.1%) (1:2.3) | 34 | — | — | — |
| LPKN (5%) | 3.2 | 3.2 | 3.2 | 3.2 |
| DOWFAX 3B2 | 1 | 1 | 1 | 1 |
| FATTY ACID[2] | 0.1 | 1 | 0.1 | 0.1 |
| BLEACH (13.0% CL) | 7.5 | 7.5 | 7.5 | 9 |
| AIR[3] (VOL. %) | >2.0 | >2.0 | <2.0 | <2.0 |
| FRAGRANCE | — | — | — | — |
| K/Na RATIO | 45.15 | — | 1.89 | — |
| DENSITY (g/cc) | — | — | 1.37 | 1.37 |
| RHEOGRAM | FIG. 6 | FIG. 7 | FIG. 5 | FIG. 8 |
| STABILITY RESULTS ROOM TEMP. 8 WEEKS (%) | >20.0 | >5.0 | 0.0 | 0.0 |
| STABILITY RESULTS 100° F., 6 WEEKS | >20.0 | >5.0 | 0.0 | 0.0 |

1. Carbopol 940
2. Emersol 132 (Mixture of stearic and palmitic acid 1:1 ratio.
3. All the formulations are aerated to a certain degree depending upon the shear condition employed for the preparation, typically the volume of air does not exceed 7-8% by volume, the preferred degree of aeration (2% by volume) resulting in the indicated densities; the air bubbles average between 20 and 60 microns in diameter.

Formulations A, B, C, D, E, G, J, and K are prepared by first forming a uniform dispersion of the Carbopol 941 or 940 thickener in about 97% of the water (balance). The Carbopol is slowly added to deionized water at room temperature using a mixer equipped with a premier blade, with agitation set at a medium shear rate, as recommended by the manufacturer. The dispersion is then neutralized by addition, under mixing, of the caustic soda (50% NaOH or KOH) component to form a thickened product of gel-like consistency.

To the resulting gelled dispersion the silicate, tetrapotassium pyrophosphate (TKPP), sodium tripolyphosphate TP (TPP, Na) and bleach, are added sequentially, in the order stated, with the mixing continued at medium shear.

Separately, an emulsion of the phosphate anti-foaming agent (LPKN), stearic acid/palmitic acid mixture and detergent (Dowfax 3B2) is prepared by adding these ingredients to the remaining 3% of water (balance) and heating the resulting mixture to a temperature in the range of 50° C. to 70° C.

This heated emulsion is then added to the previously prepared gelled dispersion under low shear conditions, such that a vortex is not formed.

The remaining formulations F, H and I are prepared in essentially the same manner as described above except that the heated emulsion of LPKN, stearic acid and Dowfax 3B2 is directly added to the neutralized Carbopol dispersion prior to the addition of the remaining ingredients. As a result, formulations F, H and I, have higher levels of incorporated air and densities below 1.30 g/cc$^3$.

The rheograms for the formulations A, C, D, G and J are shown in FIGS. 1-5, respectively, and rheograms for formulations H, I and K are shown in FIGS. 6, 7 and 8, respectively.

These rheograms are obtained with the System 4 Rheometer from Rheometrics equipped with a Fluid Servo with a 100 grams-centimeter torque transducer and a 50 millimeter parallel plate geometry having an 0.8 millimeter gap between plates. All measurements are made at room temperature (25°+1° C.) in a humidity chamber after a 5 minute or 10 minute holding period of the sample in the gap. The measurements are made by applying a frequency of 10 radians per second.

All of the composition formulations A, B, C, D, G and J according to the preferred embodiment of the invention which include Carbopol 941 and stearic acid exhibit linear viscoelasticity as seen from the rheograms of FIGS. 1–5. Formulation E which includes Carbopol 941 but not stearic acid showed no phase separation at either room temperature or 100° F. after 3 weeks, but exhibited 10% phase separation after 8 weeks at room temperature and after only 6 weeks at 100° F.

Formulation K, containing Carbopol 940 in place of Carbopol 941, as seen from the rheogram in FIG. 8, exhibits substantial linearity over the strain range of from 2% to 50% (G' at 1% strain-G' at 50% strain 500 dynes/sq.cm.) although tan δ at a strain above 50%.

EXAMPLE 26

This example demonstrates the importance of the order of addition of the surface active component premix to the remainder of the composition on product density and stability.

The following formulations are prepared by methods A and B:

| Ingredient | |
|---|---|
| Water, deionized | Balance |
| Carbopol 941 | 0.5 |
| NaOH (50%) | 2.4 |
| Na Silicate (47.5%) | 21 |
| TKPP | 15 |
| TPP, Na | 13 |
| Bleach (1%) | 7.5 |
| LPKN | 0.16 |
| Stearic Acid | 0.1 |
| Dowfax 3B2 | 1 |

Method A

The Carbopol 941 is dispersed, under medium shear rate, using a premier blade mixer, in deionized water at ambient temperature. The NaOH is added, under mixing, to neutralize and gel the Carbopol 941 dispersion. To the thickened mixture the following ingredients are added sequentially while the stirring is continued: sodium silicate, TKPP, TPP, and bleach.

Separately, an emulsion is prepared by adding the Dowfax 3B2, stearic acid and LPKN to water while mixing at moderate shear and heating the mixture to about 65° C. to finely disperse the emulsified surface active ingredients in the water phase. This emulsion premix is then slowly added to the Carbopol dispersion while mixing under low shear conditions without forming a vortex. The results are shown below.

Method B

Method A is repeated except that the heated emulsion premix is added to the neutralized Carbopol 941 dispersion before the sodium silicate, TKPP, TPP, and bleach. The results are also shown below.

Figure 9:
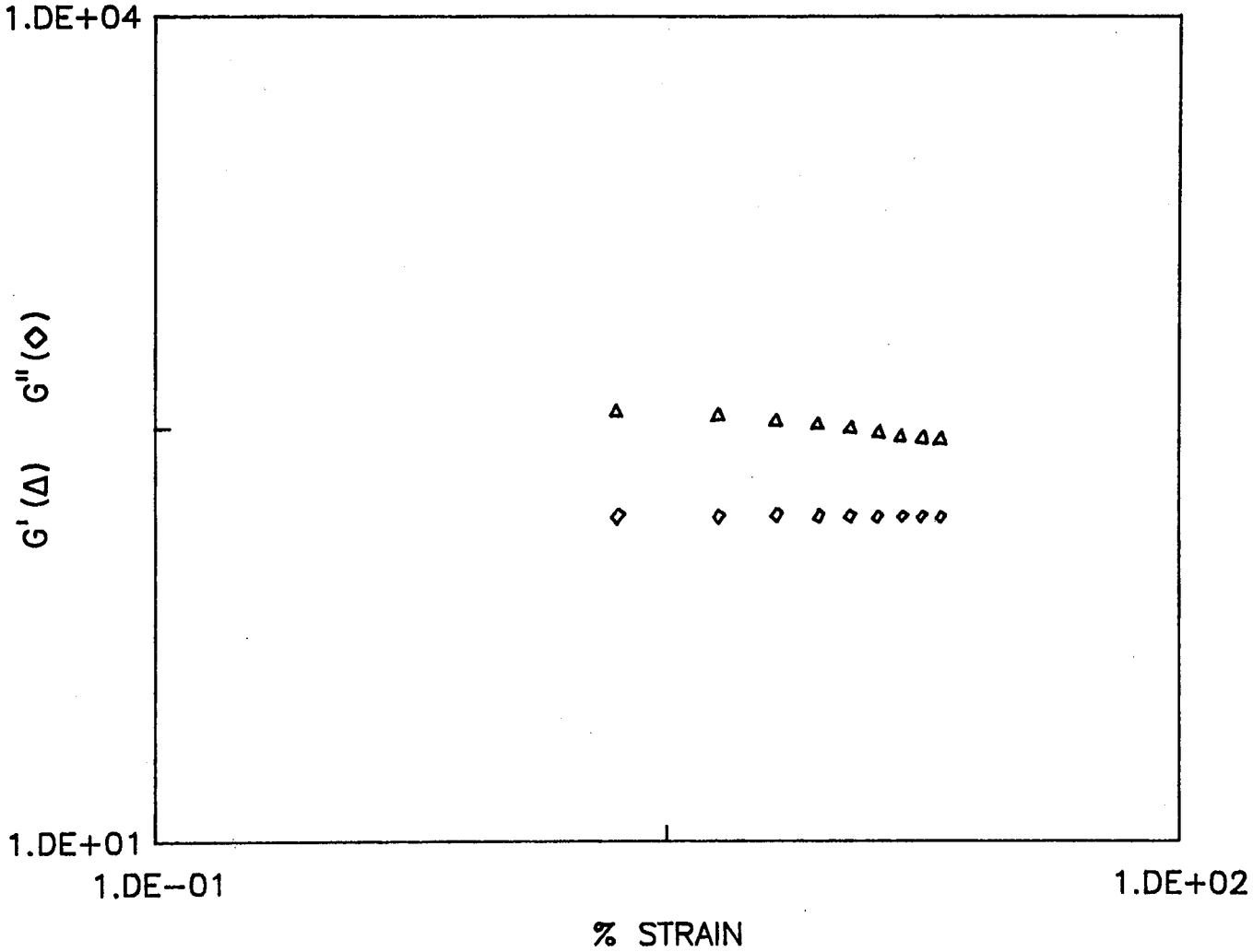
Figure 10:
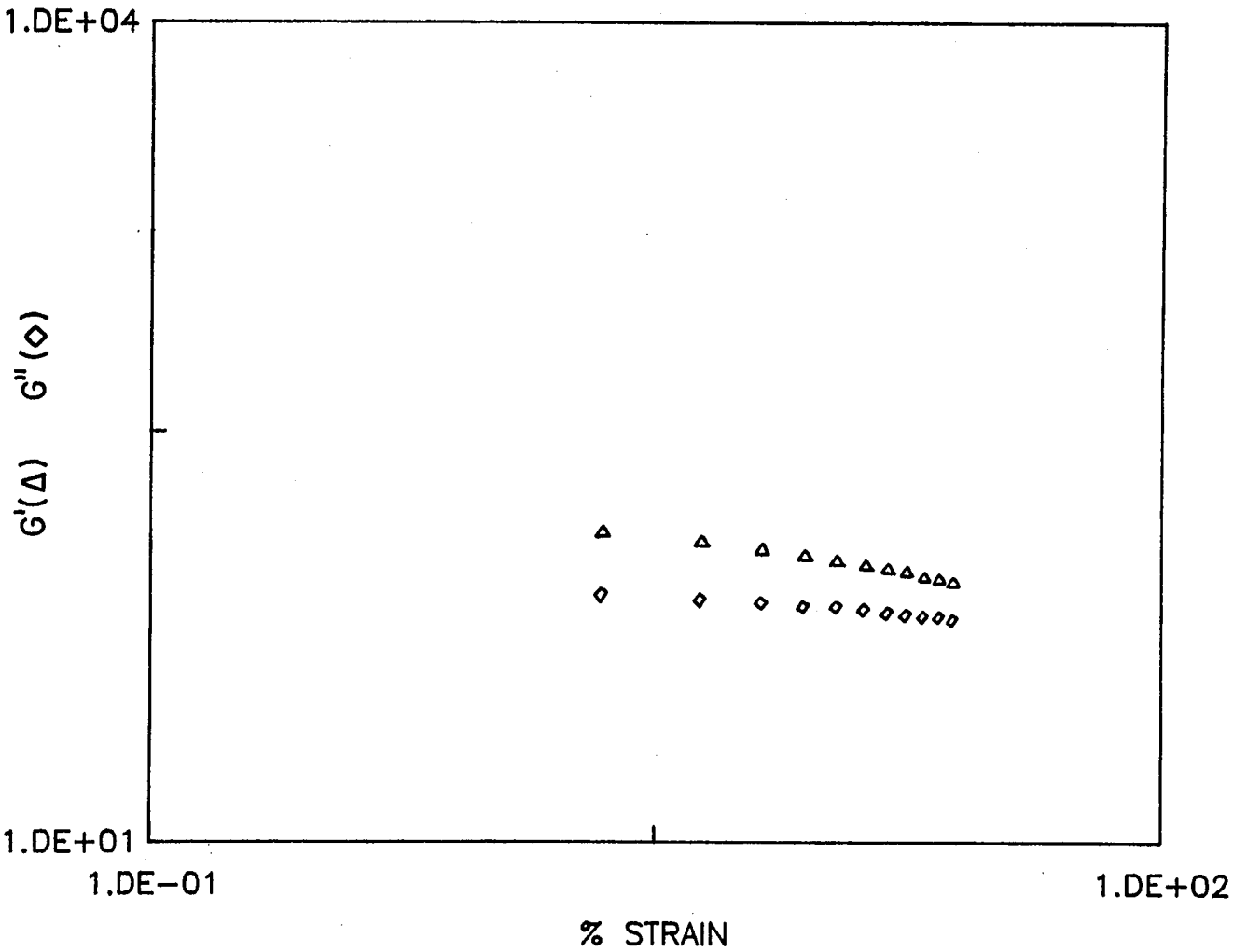

| | METHOD A | METHOD B |
|---|---|---|
| Density (g/cc$^3$) | 1.38 | 1.30 |
| Stability (RT-8 weeks) | 0.00% | 7.00% |
| Rheogram | FIG. 9 | FIG. 10 |

From the rheograms of FIGS. 9 and 10 it is seen that both products are linear viscoelastic although the elastic and viscous module G' and G'' are higher for Method A than for Method B.

From the results it is seen that early addition of the surface active ingredients to the Carbopol gel significantly increases the degree of aeration and lowers the bulk density of the final product. Since the bulk density is lower than the density of the continuous liquid phase, the liquid phase undergoes inverse separation (a clear liquid phase forms on the bottom of the composition). This process of inverse separation appears to be kinetically controlled and will occur faster as the density of the product becomes lower.

EXAMPLE 27

This example shows the importance of the temperature at which the premixed surfactant emulsion is prepared.

Two formulations, L and M, having the same composition as in Example 26 except that the amount of stearic acid was increased from 0.1% to 0.2% are prepared as shown in Method A for formulation L and by the following Method C for formulation M.

Figure 11:
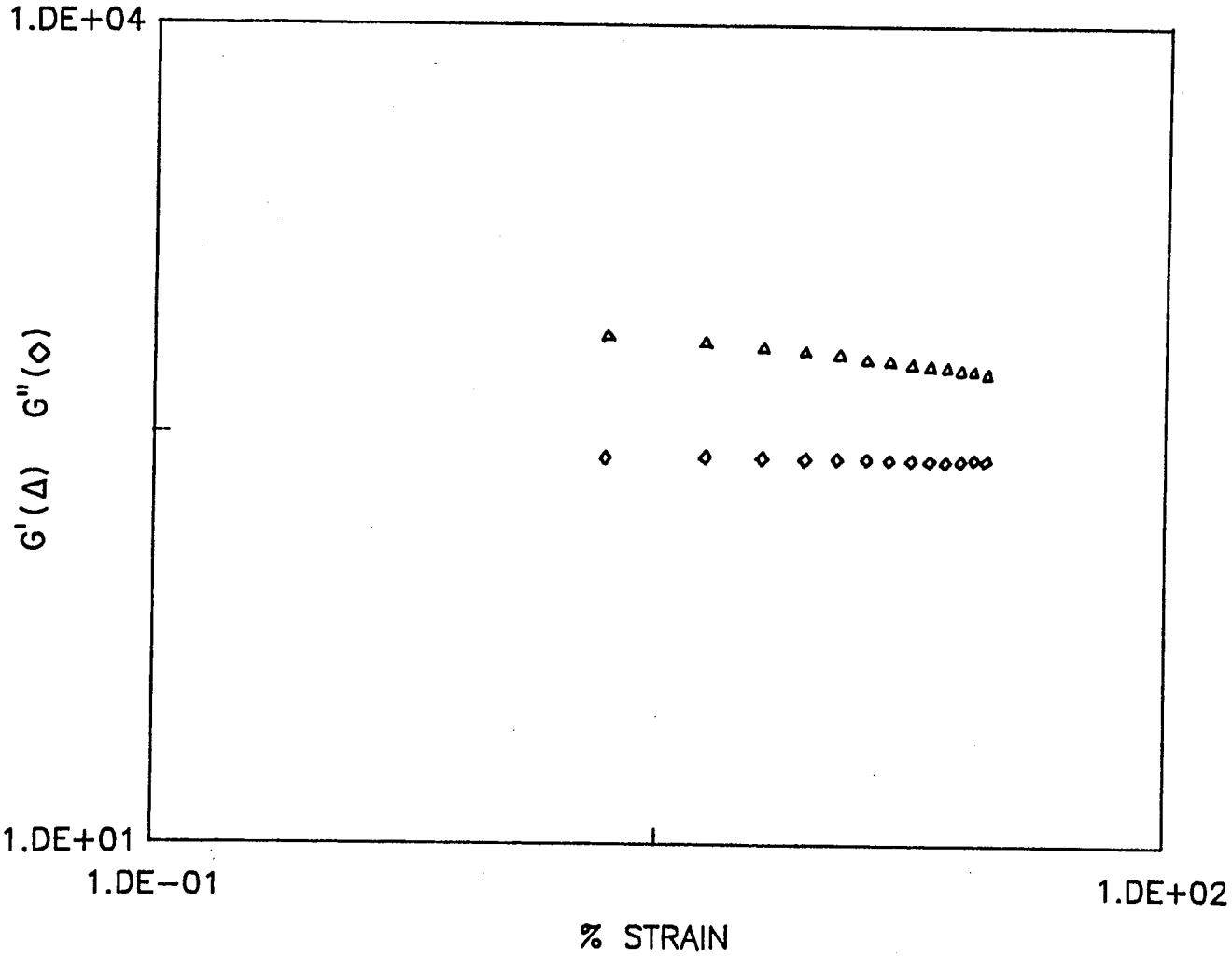
Figure 12:
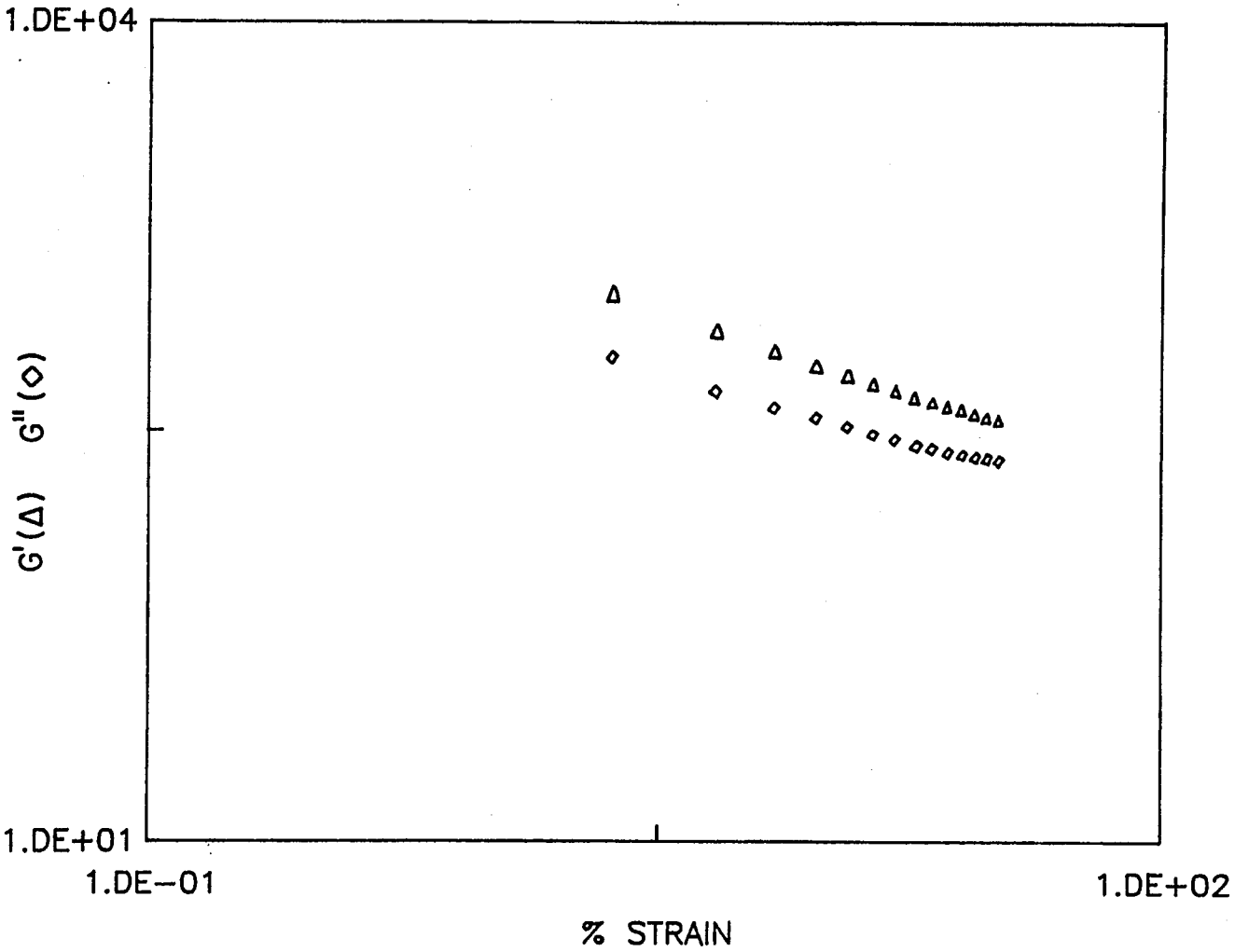

Method C:

The procedure of Method A is repeated in all details except that emulsion premix of the surface active ingredients is prepared at room temperature and is not heated before being post-added to the thickened Carbopol dispersion containing silicate, builders and bleach. The rheograms for formulations L and M are shown in FIGS. 11 and 12, respectively. From these rheograms it is seen that formulation L is linear viscoelastic in both G' and G'' whereas formulation M is non-linear viscoelastic particularly for elastic modulus G' (G' at 1% strain-G' at 30% strain>500 dynes/cm$_2$) and also for G'' (G'' at 1% strain-G'' at 30% strain=300 dynes/cm$_2$).

Formulation L remains stable after storage at RT and 100° F. for at least 6 weeks whereas formulation M undergoes phase separation.

Comparative Example 27

The following formulation is prepared without any potassium salts:

| Weight % | |
|---|---|
| Water | Balance |
| Carbopol 941 | 0.2 |
| NaOH (50%) | 2.4 |
| TPP, Na (50%) | 21.0 |
| Na Silicate (47.5%) | 17.24 |
| Bleach (1%) | 7.13 |
| Stearic Acid | 0.1 |
| LPKN (5%) | 3.2 |
| Dowfax 3B2 | 0.8 |
| Soda Ash | 5.0 |
| Acrysol LMW 45-N | 2.0 |

Figure 13:
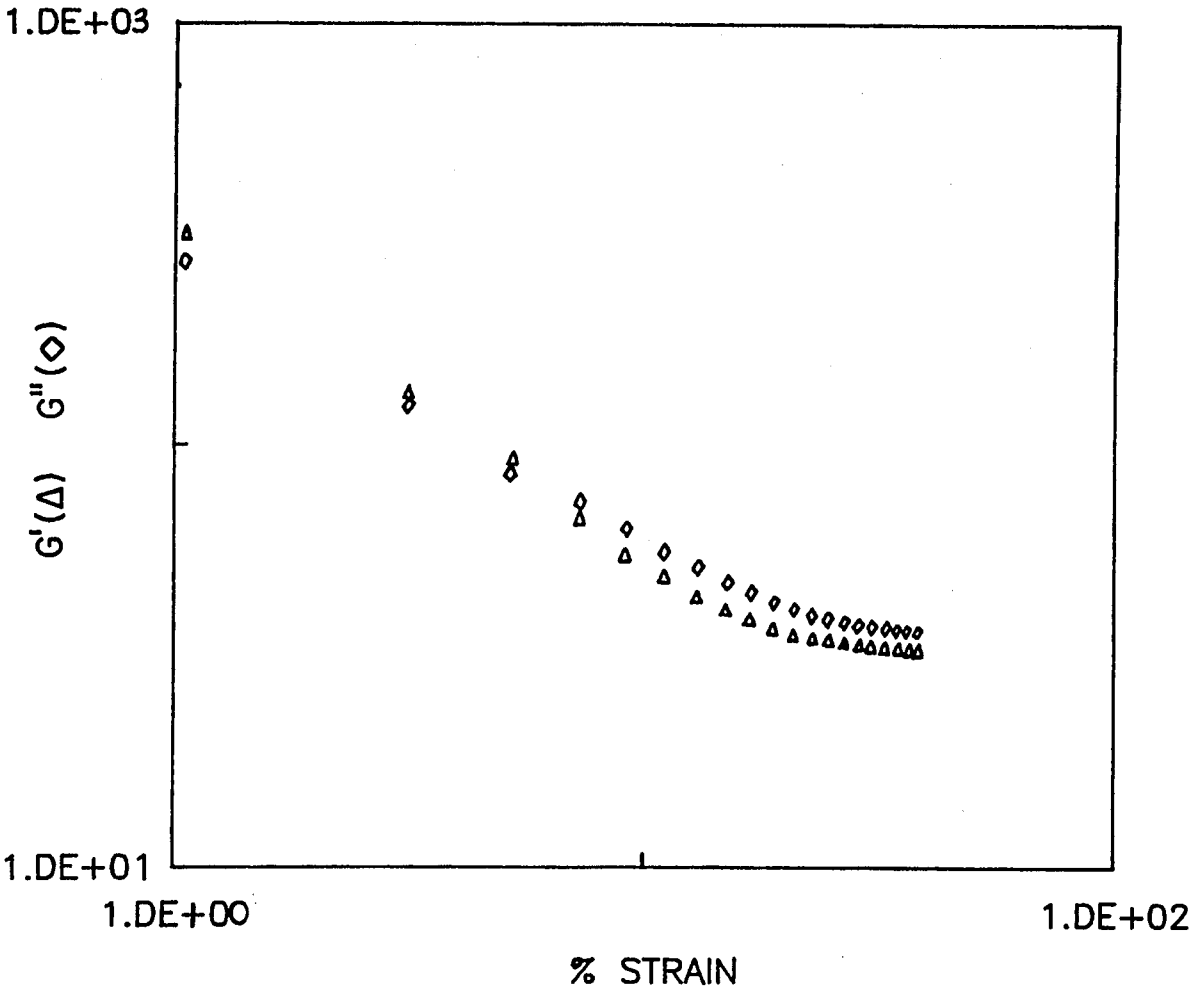
Figure 14:
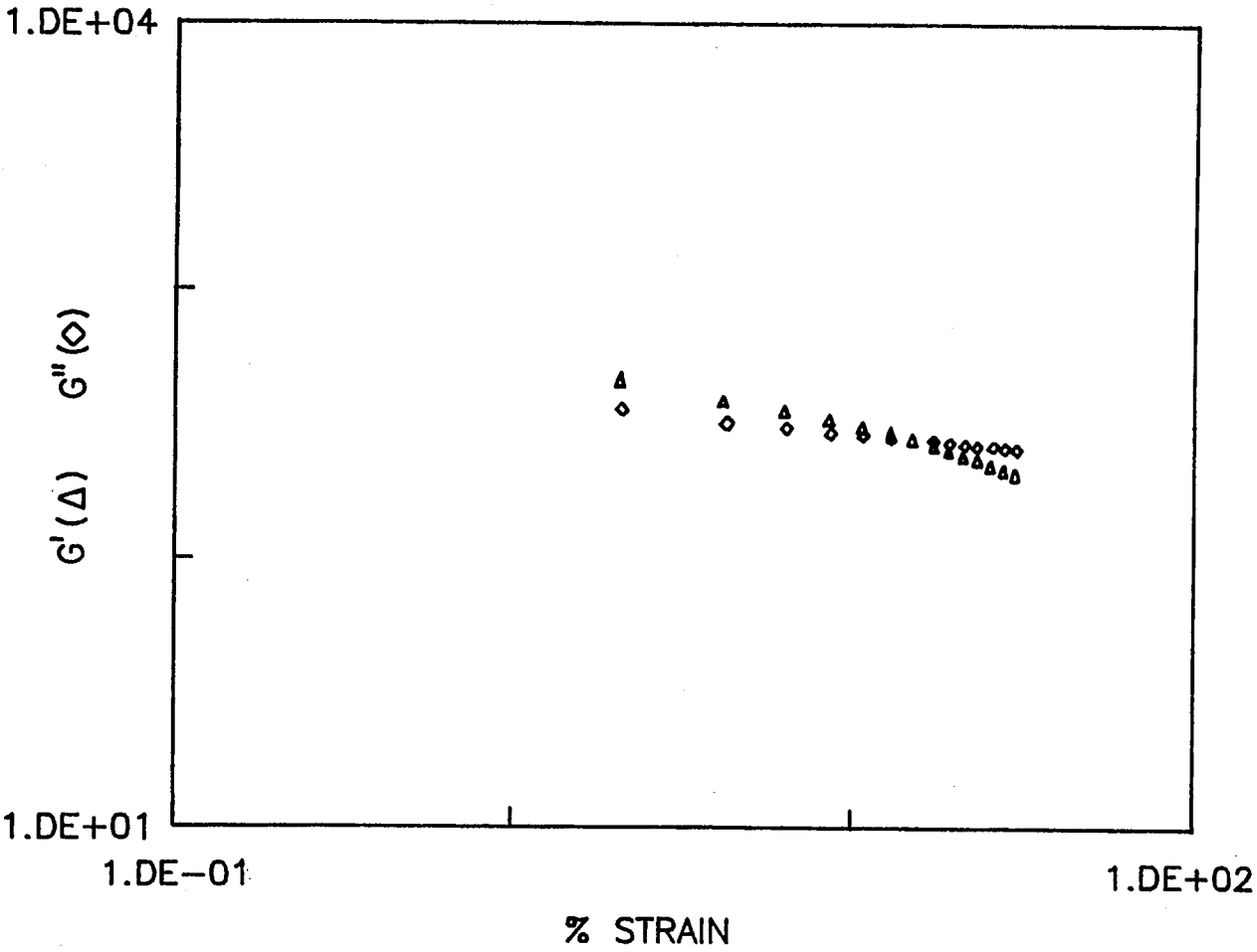
Figure 15:
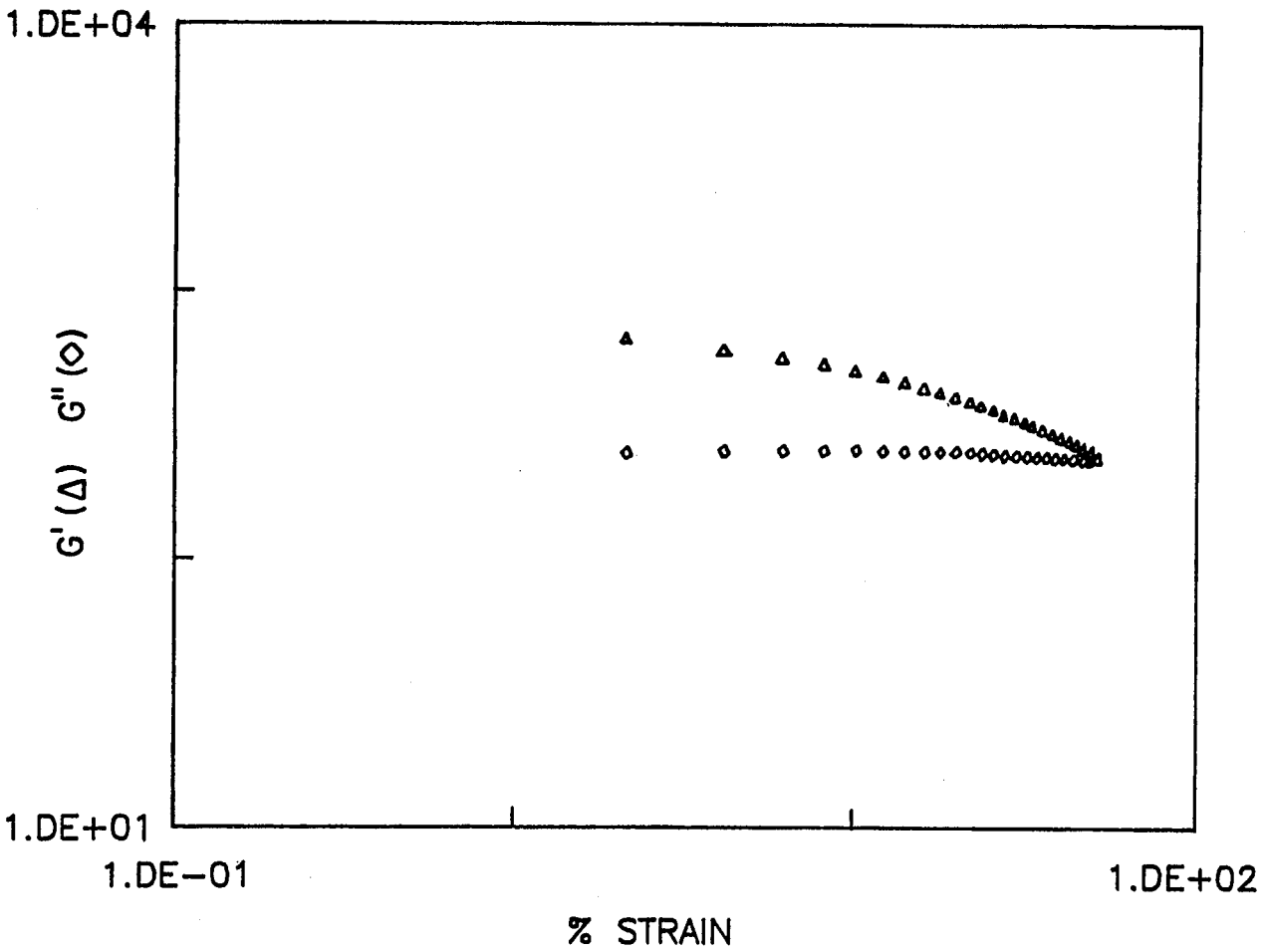
Figure 16:
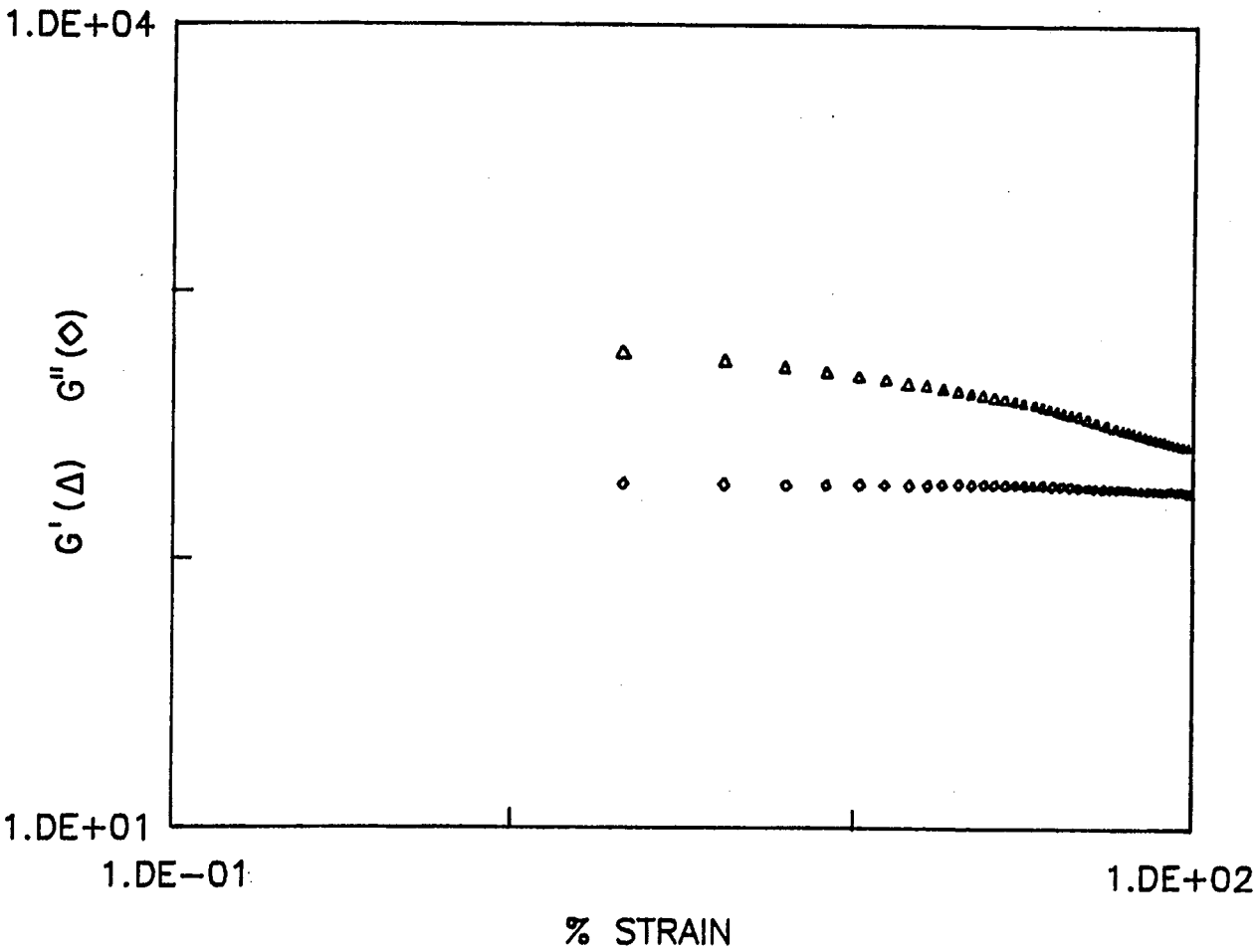
Figure 17:
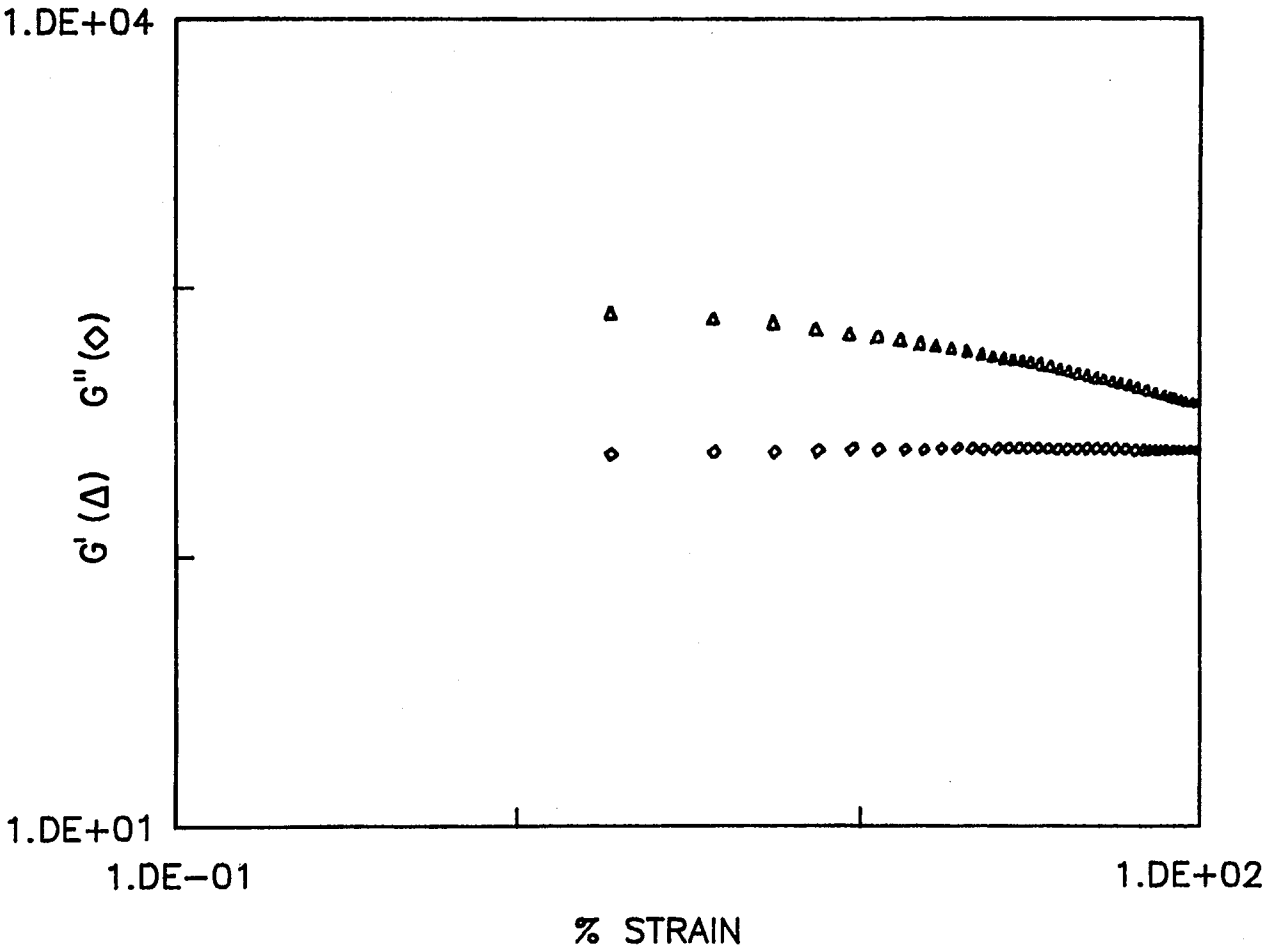
Figure 18:
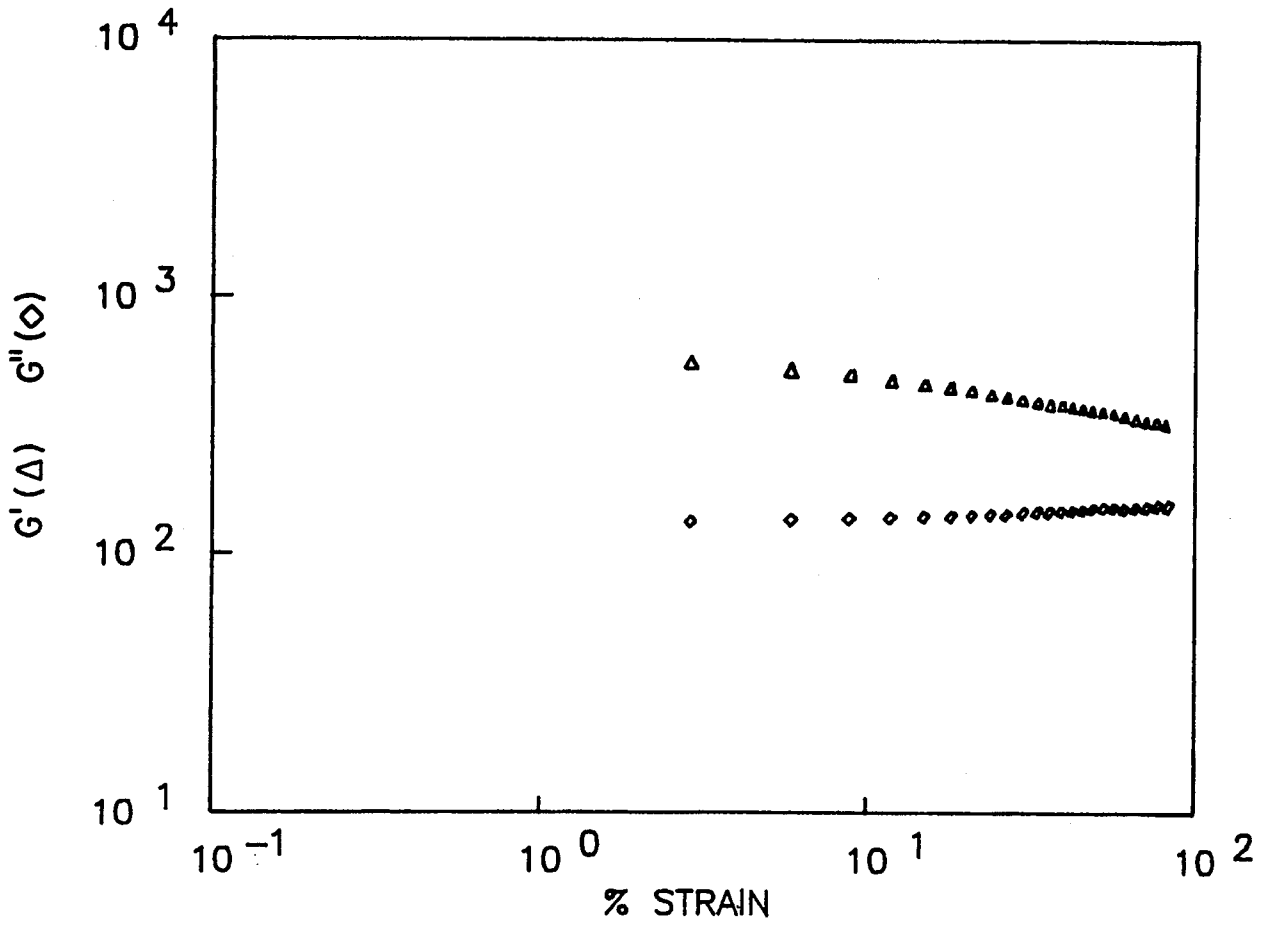
Figure 19:
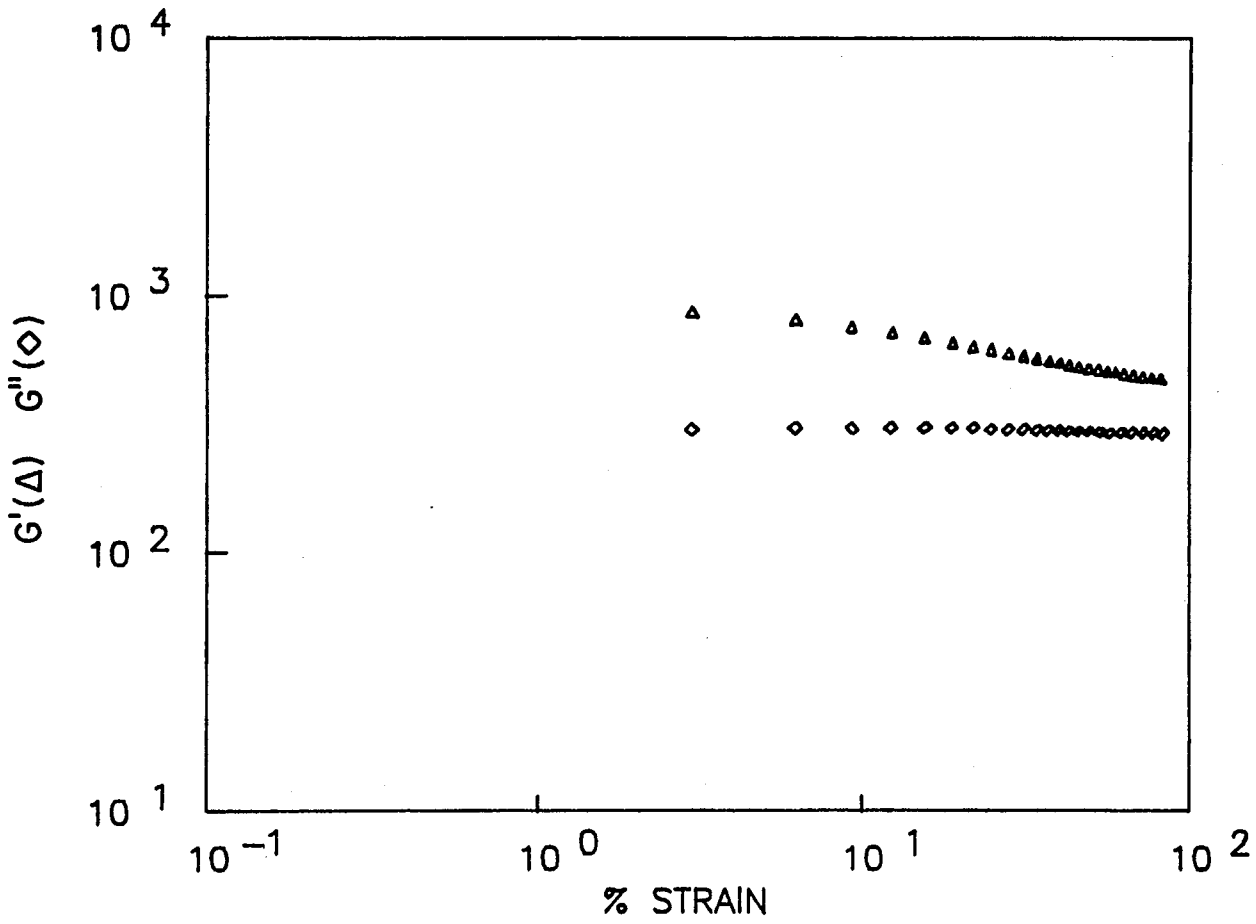
Figure 20:
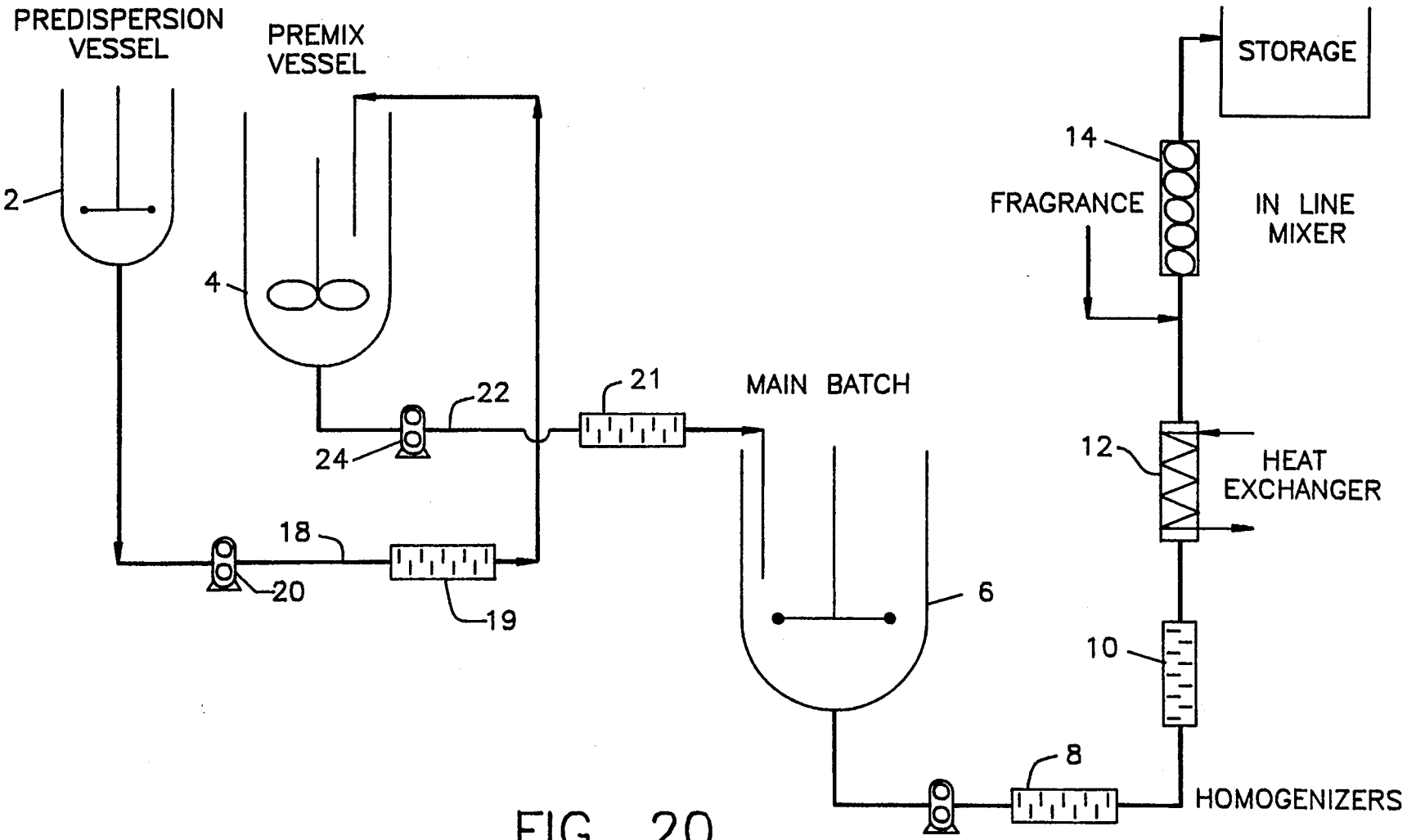
FIG. 20 is an elevation schematic of the preferred process for forming a clay formulation.

The procedure used is analogous to Method A of Example 2 with the soda ash and Acrysol LMW 45-N (low molecular weight polyacrylate polymer) being added before and after, respectively, the silicate, TPP and bleach, to the thickened Carbopol 941 dispersion, followed by addition of the heated surface active emulsion premix. The rheogram is shown in FIG. 13 and is non-linear with G''/G' (tan δ)>1 over the range of strain of from about 5% to 80%.

EXAMPLE 28

Formulations A, B, C, D and K according to this invention and comparative formulations F and a commercial liquid automatic dishwasher detergent product as shown in the Table above were subjected to a bottle residue test using a standard polyethylene 28 ounce bottle as used for current commercial liquid dishwasher detergent bottle.

Six bottles are filled with the respective samples and the product is dispensed, with a minimum of force, in 80 gram dosages, with a 2 minute rest period between dosages, until flow stops. At this point, the bottle was vigorously shaken to try to expel additional product.

The amount of product remaining in the bottle is measured as a percentage of the total product originally filled in the bottle. The results are shown below.

| Bottle Residue | |
|---|---|
| Formulation | Residue |
| A | 8 |
| B | 10 |
| C | 6 |
| D | 5 |
| K | 7 |
| F* | 4 |
| Commercial Product | 20 |

*The sample separates upon aging.

EXAMPLE 29

The following formulations A–F were prepared as described below:

| | FORMULATION | | |
|---|---|---|---|
| INGREDIENT | A | B | C |
| WATER | Q.A | Q.A | Q.A |
| CARBOPOL 941 | 0.9 | — | — |
| CARBOPOL 940 | — | 0.9 | — |
| CARBOPOL 614 | — | — | 0.9 |
| NaOH (50%) | 2.4 | 4.5 | 4.5 |
| Na-SILICATE (47.5%) (1:2.4) | 21 | 21 | 20.83 |
| TKPP | 15 | 15 | — |
| KTPP | — | — | 20.35 |
| NaTPP (ANHYDROUS) | 13 | 13 | 5.26 |
| DOWFAX 3B2 | 1 | 0.8 | 0.8 |
| LPKN (ANTI-FOAMING AGENT) | 0.16 | 0.16 | 0.16 |
| FATTY ACID | 0.10(2) | 0.20(1) | 0.15(3) |
| BLEACH (13.1%) | 8.1 | 11.1 | 10.13 |
| GRAPTHOL GREEN | 0.0025 | 0.003 | 0.003 |
| CI DIRECT YELLOW 28 | — | — | — |
| AIR (Vol. %) APPROX. | <2 | <2 | <2 |
| ACRYSOL LMW 45-N (45.0%) | — | — | — |
| HIGHLIGHTS (FRAGRANCE) | — | — | 0.05 |
| K/Na | 0.98 | 0.98 | 1.61 |
| DENSITY | 1.35 | 1.37 | 1.37 |
| STABILITY AMBIENT | 8 WKS | 8 WKS | 24 WKS |
| STABILITY 100° F. | 2 WKS | 2 WKS | — |
| STABILITY 120° F. | — | — | — |
| STABILITY 140° F. | — | — | — |
| CRYSTAL GROWTH (100° F.) | YES | YES | NO |
| RHEOGRAM | FIG. 1 | FIG. 2 | FIG. 3 |

| | FORMULATION | | |
|---|---|---|---|
| INGREDIENT | D | E | F |
| WATER | Q.A | Q.A | Q.A |
| CARBOPOL 941 | — | — | — |
| CARBOPOL 940 | — | — | — |
| CARBOPOL 614 | 0.9 | 0.9 | 0.9 |
| NaOH (50%) | 4.0 | 4.5 | 4.5 |
| Na-SILICATE (47.5%) (1:2.4) | 20.83 | 20.83 | 20.83 |
| TKPP | — | — | — |

-continued

| | | | |
|---|---|---|---|
| KTPP | 20.35 | 13 | 20.35 |
| NaTPP (ANHYDROUS) | 5.26 | 3 | 5.26 |
| DOWFAX 3B2 | 0.8 | 0.8 | 0.8 |
| LPKN (ANTI-FOAMING AGENT) | 0.16 | 0.16 | 0.16 |
| FATTY ACID | 0.15(2) | 0.15(2) | 0.15(2) |
| BLEACH (13.1%) | 10.13 | 10.13 | 10.13 |
| GRAPTHOL GREEN | 0.003 | 0.003 | — |
| CI DIRECT YELLOW 28 | — | — | 0.003 |
| AIR (Vol. %) APPROX. | <2 | <2 | <2 |
| ACRYSOL LMW 45-N (45.0%) | — | 4.4 | — |
| HIGHLIGHTS (FRAGRANCE) | 0.05 | 0.05 | 0.05 |
| K/Na | 1.61 | 1.17 | 1.61 |
| DENSITY | 1.37 | 1.28 | 1.37 |
| STABILITY AMBIENT | 24 WKS | 12 WKS | 4 WKS |
| STABILITY 100° F. | 20 WKS | 8 WKS | 4 WKS |
| STABILITY 120° F. | 8 WKS | 8 WKS | 4 WKS |
| STABILITY 140° F. | 2 WKS | 2 WKS | 2 WKS |
| CRYSTAL GROWTH (100° F.) | NO | NO | NO |
| RHEOGRAM | FIG. 4 | FIG. 5 | FIG. 6 |

(1) Syncrowax C24–26
(2) Stearic Acid
(3) Syncrowax C18–36

Formulations A, B, C, D, E and F are prepared by first forming a uniform dispersion of the Carbopol 614 or 940 thickener in about 97% of the water of the total formula water. The Carbopol is slowly added by sprinkling it into the vortex of previously colored deionized water preheated to a temperature of 105° F. using a mixer equipped with a premier blade, with agitation set at a medium shear rate, as recommended by the manufacturer. After mixing for about 15 minutes, the dispersion is then neutralized by addition, under the same mixing, of the caustic soda (50% NaOH) component until a thickened product of gel-like consistency is formed (about 10 minutes).

To the resulting gelled dispersion the silicate, sodium tripolyphosphate (NaTPP), tetrapotassium pyrophosphate (TKPP), or potassium tripolyphosphate (KTPP), the surfactant emulsion (described below) and bleach and color, are added sequentially, in the order stated, with the mixing continued at medium shear for several minutes before adding the next ingredient. After the addition of the surfactant emulsion (at 160° F.), the mixture is cooled from 90°–95° F. before the bleach is added.

Separately, the surfactant emulsion of the phosphate anti-foaming agent (LPKN), stearic acid or fatty acid mixture and detergent (Dowfax 3B2) is prepared by adding these ingredients to the remaining 3% of water and heating the resulting mixture to a temperature in the range of 160° F. (71° C.). In formulation E, the Acrysol LMW 45-N may be added at this stage.

The rheograms for the formulations A, B, C, D, E and F are shown in FIGS. 10–15, respectively.

These rheograms are obtained with the System 4 Rheometer from Rheometrics equipped with a Fluid Servo with a 100 grams-centimeter torque transducer and a 50 millimeter parallel plate geometry having an 0.8 millimeter gap between plates. All measurements are made at room temperature (25°+1° C.) in a humidity chamber after a 5 minute or 10 minute holding period of the sample in the gap. The measurements are made by applying a frequency of 10 radians per second.

All of the composition formulations C, D and F exhibit linear viscoelasticity as seen from the rheograms of FIGS. 21–25. No phase separation at from ambient temperature to 140° F. were observed for any of the formulations for at least the minimum number of weeks required to satisfy the criteria stability as shown above.

However, in the control formulations A and B maintained at 100° F., the TKPP crystallized in the aqueous phase and eventually formed sufficiently large size crystals which separated to the bottom of the composition. Also, as seen in FIGS. 1 and 2 formulations A and B are not linear viscoelastic, at least within the preferred criteria as previously described. Formulations C, D, E and F, according to the invention did not undergo any crystal growth.

For the bottle residue test, each formulation is allowed to age for about 1 week at ambient temperature in a standard 32 ounce small necked polyethylene bottle. An amount of product is poured from the bottle to fill a standard sized dispenser cup of an automatic dishwasher. The bottle is then replaced in an upright position and is retained in the upright position for at least 15 minutes. This procedure of filling the dispenser cup, placing the container in the upright position and waiting at least 15 minutes is repeated until no more product flows from the bottle. At this time, the weight of the bottle is measured. Bottle residue is calculated as:

$$\frac{Wf}{Wo} \times 100$$

Wo is the initial weight of the filled bottle and Wf is the final weight of the filled bottle. The bottle residue for each formulation A–F is about 4 to 5%. Formulations C–F have viscosities of from 10,000 to 20,000 measured at 80° F. All of these products are easily pourable from the polyethylene bottle.

EXAMPLE 30

A Carbopol 614 slurry is formed as described in Example 29 except that the coloring agent is first added to the deionized water (about 92% of the total added water) and the amounts of the ingredients are changed as shown below. The premix (surfactant emulsion) of the surface active ingredients is also formed as in Example 29 using stearic acid as the fatty acid stabilizer and the remaining 8% of the total added water.

The ingredients are then mixed together with the Carbopol 614 slurry in the following order: alkali metal silicate, NaTPP (powder), KTPP (powder), surfactant emulsion, bleach and perfume. The resulting composition is obtained with the following ingredients in the following amounts:

| Ingredient | Amount (wt %) |
|---|---|
| Deionized Water | Balance |
| Carbopol 614 | 1.00 |
| NaOH (38% Na2O) | 6.38 |
| Na silicate (1:24) (47.5%) | 20.83 |
| KTPP (anhydrous) powder | 20.35 |
| NaTPP (3% H2O) powder | 5.26 |
| Dowfax 3B2 | 0.80 |
| LPKN | 0.16 |
| Stearic Acid | 0.15 |
| Bleach (Na hypochlorite - 13%) | 9.23 |
| CI Pigment Green 7 (CI 74260) | 0.0024 |
| Highlights (fragrance) | 0.05 |

The composition has a pH of 11.3+0.2 and density (sp.gr.) of 1.39+0.03. The viscosity at 80° F. measured with a Brookfield LVT viscometer at 20 rpm with a #4 spindle is 12,000±2,000.

All of the preferred criteria as set forth in the above are satisfied.

EXAMPLE 31

The following formulation G was prepared according to the procedure of Example 29.

| Component | Weight Percent |
|---|---|
| Water, deionized | 43.0% |
| LPKN (pure) | 0.16% |
| Dowfax 3B2 | 0.8% |
| Stearic Acid | 0.1% |
| Caustic (50%) | 2.4% |
| Soda Ash | 5.0% |
| Na Silicate (47.5%) (1:2.4) | 17.24% |
| Na PP (FMC Hexahydrate) | 12.0% |
| Na TPP (Oxy Anhydrous) | 12.0% |
| Bleach (Na Hypochlorite) | 7.07% |
| Carbopol 940 | 0.3% |
| Density = 1.35 g/ml. | |

EXAMPLE 32

A scented thixotropic liquid automatic dishwashing detergent composition having the formulation described below, was prepared using the preferred process of the present invention.

| STAGE | COMPONENT | | WEIGHT |
|---|---|---|---|
| PREDISPERSION (I) | Water (Softened) | | 41.44 |
| | LPKN 158 TM | | 8.84 |
| | Al stearate | | 5.52 |
| | DOWFAX TM 3B-2 TM | | 44.20 |
| | | Total | 100.00 |
| PREMIX (II) | Water (Softened) | | 82.37 |
| | Predispersion (I) | | 10.43 |
| | Gel White TM H | | 7.20 |
| | | Total | 100.00 |
| MAIN BATCH (III) | Water (Softened) | | 25.69 |
| | Premix (II) | | 17.53 |
| | Sodium hydroxide (50% A.I.) | | 2.42 |
| | Sodium carbonate | | 5.05 |
| | Sodium silicate (43.5% A.I.) | | 17.42 |
| | Thermphos NH TM | | 12.12 |
| | Thermphos NW TM | | 12.12 |
| | Sodium hypochlorite (13% A.I.) | | 7.48 |
| | | Subtotal | 99.83 |
| HOMOGENIZE, COOL & MIX (IV) | Fragrance | | 0.17 |
| | | Total | 100.00 |

According to the preferred process of the invention, a predispersion mix was prepared in a vessel equipped with a high speed dispenser, e.g., Myers HSD TM. The amount of water included in the predispersion vessel was limited so that the mixture remained viscous and susceptible to high-shear dispersing. The high-shear dispersing was carried out for about 5 to 10 minutes at which point the predispersion mix was conveyed through an homogenizer to a premix vessel where the clay thickener and water were added to the predispersion mix under low-shear conditions. A paddle blade type mixer, e.g., baffled crutcher, was used in the premix vessel which mechanically deagglomerated the clay as it was hydrated. The preparation of the premix generally lasts for about 20 minutes depending on the mixer speed. The resultant premix was removed and homogenized, then added with water to the main batch vessel where is was subjected to high-shear dispersing using a Myers HSD TM. During the high-shear mixing, the remaining liquid and solid ingredients were sequentially added to the main batch vessel.

As additional ingredients were added, particularly, the solid ingredients, the mixture became more viscous and the high speed dispenser ground the particles to a fine particle size which, in turn, caused an increase in temperature, i.e. to about 125° F.–150° F. The continuous high-shear dispersing also resulted in entrainment of a substantial portion of air. The high-shear dispersing continued for a total of about 20 minutes during which visible lumps of solid material disappeared and the particle size of the undissolved particles was reduced so that a phase stable dispersion was formed.

Thereafter, the main batch material was fed through a series of coarse and fine homogenizers, where the material was milled at high speeds for relatively short times to further deagglomerate any remaining solids particles. The resultant product was a phase stable thixotropic liquid automatic dishwashing detergent composition.

When it was desired to add a fragrance to the detergent composition, as in the present example, the main batch material was cooled from the main batch temperature which is generally greater than 100° F., typically, 105° F. to 125° F., to a temperature of about 85° F. or less. The cooled main batch material and fragrances were then fed through a series of in-line static mixers and the resultant product was a scented thixotropic liquid automatic dishwashing detergent composition.

It has been found that the addition of fragrance to the composition according to this method does not have an adverse effect on the rheological properties of the composition or on the long-term phase stability of the composition. The specific gravity, viscosity and phase stability, i.e., phase separation, of the scented detergent composition were measured (Example A). For comparison, a sample of the main batch material (Example B) was removed for analysis prior to the fragrance addition. Specific gravity measurements of the bulk and liquid phases were made by conventional techniques known to those skilled in the art. For example, the specific gravity of the bulk composition was determined by weighing a known volume of the bulk composition and an identical volume of water. The ratio of the bulk composition weight to the weight of the water is termed the "bulk specific gravity".

The liquid phase specific gravity was determined by first loading a sample of the liquid automatic dishwashing detergent composition into a conventional centrifuge, e.g. Ivan Sorvall, then spinning the centrifuge at a speed of about 2000 rpm to remove a sufficient amount of supernatant (clear liquid phase) for weighing.

The centrifugation step requires approximately 1–1½ hours to separate a sufficient amount of supernatant for several measurements. Thereafter, the supernatant specific gravity was calculated by dividing the weight of an 8 ml vial of the supernatant by the weight of an identical volume of water, the ratio being defined as the "liquid phase specific gravity."

The viscosity of the compositions were measured using a Brookfield HATDV II Model viscometer with a #4 spindle (Brookfield Labs, Stoughton, Mass.). The viscosity was recorded after the compositions were sheared for 90 seconds at a shear rate of 20 rpm. The results are summarized below.

| | A | B |
|---|---|---|
| Specific gravity (BULK) | 1.28 | 1.28 |
| Specific gravity (LIQUID) | 1.28 | 1.28 |
| Viscosity (cP) - 1 day after preparation | 5060 | 4760 |
| Viscosity (cP) - 12 weeks after preparation | 5150 | 6350 |
| Separation (%) - 12 weeks after preparation | 0 | 0 |

The above data demonstrates that the process of the present invention produces a thixotropic liquid automatic dishwashing detergent composition which is highly stable and not subject to phase separation after long periods of storage.

EXAMPLE 34

The following liquid automatic dishwashing detergent compositions, having the formulations described in the following table, were prepared in a single mixer according to the alternate embodiment of the process of the invention.

TABLE

| Component | Example A | Example B |
|---|---|---|
| Water | 36.90 | 36.15 |
| LPKn 158 TM (5%) | 3.20 | 3.20 |
| DOWFAX TM | 0.80 | 0.80 |
| Stearic acid | 0.10 | 0.10 |
| Gel White TM H | 1.25 | 0. |
| Caustic (50% A.I.) | 2.40 | 2.40 |
| Soda ash | 5.00 | 5.00 |
| Silicate (45% A.I.) | 17.34 | 17.34 |
| Thermphos TM NH | 12.00 | 12.00 |
| Thermphos TM NW | 12.00 | 12.00 |
| Bleach (11% A.I.) | 9.00 | 9.00 |
| Acrysol TM LMW-45N | 0. | 2.00 |
| Air (BALANCE) | 0.01 | 0.01 |
| TOTAL | 100.00 | 100.00 |

All of the above ingredients were mixed in a Premier TM Mill Mixer at room temperature In the examples, a 5% aqueous dispersion of defoamer (LPKn) is initially prepared by heating and mixing the defoamer in water until dispersed. Similarly, the surfactant (DOWFAX TM) and a physical stabilizer (stearic acid), are heated to form an emulsion prior to and during addition to the mixer.

After addition of the surfactant and physical stabilizer, the mixture is allowed to cool and the remaining ingredients were added sequentially as shown in Table I, while subjecting the ingredients to constant high-shear mixing.

Upon adding the final ingredient, typically a bleach compound, the composition is subjected to additional high-shear mixing until air in the amount of about 2% to about 10% is entrained in the thixotropic detergent composition. This highly stable condition is evidenced by the presence of a bulk specific gravity about equal to the liquid phase specific gravity.

As seen in the above examples, a three component air stabilizing system, i.e. a physical stabilizer, foam depressant (defoamer) and surfactant is employed in each composition.

Each of the resulting liquid detergent compositions were measured for specific gravity, degree of aeration and phase stability, i.e., phase separation upon standing.

The degree of aeration is calculated as follows:

$$\% \text{ degree of aeration} = \frac{\text{density of de-aerated product} - \text{density of aerated product}}{\text{density of de-aerated product}} \times 100$$

The density of the de-aerated product is determined by centrifuging the composition to remove all entrained air, then measuring the density of the centrifuged composition by conventional means. The results obtained are summarized below.

EXAMPLE 35

| PROPERTY | A | B |
|---|---|---|
| Specific gravity (bulk) | 1.28 | 1.29 |
| Specific gravity (liquid) | 1.28 | 1.28 |
| Degree of aeration (%) | 7.91 | 7.91 |
| Nature of separation | 0.00* | 0.00* |

*Age 8 wks after Sample Preparation

The above data demonstrates that liquid automatic dishwashing detergent compositions comprising a three component stabilizing system according to the present invention exhibit excellent stability. As shown, the air stabilized composition of Example A has a bulk specific gravity (1.28 g/cc) identical to the liquid phase specific gravity (1.28 g/cc) of the composition. Under these conditions the composition exhibits excellent phase stability.

Substantially identical results were obtained in the composition of Example B in the absence of a thixotropic thickener, e.g. clay, where a bulk specific gravity of 1.29 g/cc was achieved, almost identical to the liquid phase specific gravity of the composition. Example not only demonstrates that clay is not required for producing an acceptable stabilized composition, but is further advantageous in that all of its ingredients are completely water soluble, resulting in superior spotting and filming performance compared to clay based thixotropic detergents.

EXAMPLE 36

A phosphate-free composition having the following formulas were prepared:

| Ingredients | A | B | C | D | E |
|---|---|---|---|---|---|
| NaOH (50%) | 5 | 5 | 5 | 5 | 5 |
| Sodium Carbonate | 4 | 4 | 6 | 4 | 4 |
| Sodium Silicate (44%; $SiO_2$,; $Na_2O$ = 2.1) | 39 | 39 | 39 | 45 | 39 |
| Sokolan PA30 CL (45%) | 17 | 17 | 17 | 17 | 17 |
| Sodium Hypochlorite (13%) | 9 | 9 | 9 | 9 | 9 |
| Dye | .0012 | .0012 | 0.0012 | .0012 | .0012 |
| Dowfax 3B2 | 1 | 1 | 1 | 1 | 1 |
| Aluminum Stearate | 0.3 | 0.5 | 0.5 | 0.5 | 0.3 |
| Vasagel Clay | 0.5 | 0.5 | 0.5 | 0.5 | 0.75 |
| Stearic Acid | — | — | — | — | — |
| Water | 24.7988 | 23.9988 | 21.9988 | 17.9988 | 23.9488 |
| Viscosity[2] Standing[1] (cps) | 400 | 1420 | 1400 | 1960 | 860 |
| Density (g/ml) | 1.34 | 1.34 | 1.37 | 1.36 | 1.33 |

| Ingredients | F | G | H | I | J |
|---|---|---|---|---|---|
| NaOH (50%) | 6 | 6 | 6 | 6 | 6 |
| Sodium Carbonate | 4 | 4 | 4 | 4 | 4 |
| Sodium Silicate (44%; $SiO_2$; $Na_2O$ = 2.1) | 39 | 39 | 39 | 39 | 39 |
| Sokolan PA30 CL (45%) | 17 | 17 | 17 | 17 | 17 |
| Sodium Hypochlorite (13%) | 9 | 9 | 9 | | 9 |
| Dye | .0012 | 0.0012 | 0.0012 | 0.0012 | 0.0012 |
| Dowfax 3B2 | 1 | 1 | 1 | 1 | 1 |
| Aluminum Stearate | 0.3 | 0.3 | 0.3 | 0.4 | 0.3 |
| Vasagel Clay | 1.0 | 1.5 | 1 | 1 | 1.5 |
| Stearic Acid | — | — | 0.05 | 0.05 | 0.05 |
| Water | 22.6988 | 22.1988 | 22.6488 | 22.5488 | 22.1488 |
| Viscosity[2] Standing[1] (cps) | 950 | 1220 | 1150 | 162 | 142 |
| Density (g/ml) | 1.36 | 1.35 | 1.37 | 1.35 | 1.36 |

Formula A to G were prepared by making a premix A with all the formula amounts of water, dye, Dowfax 3B2, aluminum stearate and clay (stainless steel vessel of 30 cm in diameter and 40 cm in with a Cowles dispersing plate of 9 cm in diameter working at 400 rpm 68 RT for 10 minutes; premix batch size=4.5 kg). This premix was ground through an in line homogenizer before to be re-introduced in the same stainless steel vessel after cleaning) and the other ingredients were then added in the order shown in the table with the Cowles dispersing plate working at 800 rpm (batch size=6 kg). All the finished products were ground trough the in line homogenizer just after batching.

Formulae H to J were made by the same procedure as formulae A to G except that a second premix B was made by heating (up to 80° C.) a blend containing the formula amount of stearic acid plus part of the formula amount of water plus part of the formula amount of caustic. This second premix B was then added to the main batch vessel just before the bleach incorporation.

This invention in its broader aspects is not limited to the specially described embodiments or examples and departures may be made therefrom without departing from the principles of the invention and without sacrificing its chief advantages.

We claim:

1. An automatic dishwashing composition comprising approximately by weight:

(a) from 15 to 45% of an alkali metal silicate;

(b) from 2 to 10% of an alkali metal carbonate;

(c) 0 to 10% of an alkali metal hydroxide;

(d) 0 to 5% of a non-soap chlorine bleach stable organic anionic detergent active material;

(e) from 0 to 1.5% of a chlorine bleach stable foam depressant selected from the group consisting of silicones and alkyl or ethoxylated alkyl phosphate esters;

(f) chlorine bleach compound in an amount sufficient to provide about 0.2 to about 4% of available chlorine;

(g) 0.1 to 5.0% of at least one inorganic colloid forming clay thixotropic thickener;

(h) 0.02 to 1.0% of a polyvalent metal salt of a long chain fatty acid having about 8 to about 24 carbon atoms;

(i) 0 to 22% of a low molecular weight, non-cross-linked polyacrylate polymer; and (j) balance being water, wherein said composition is free of abrasives and polishing agents and has a pH of at least 9.5, when the composition is diluted to provided a concentration of 10 grams of the composition in one liter of water and the composition has a thixotropic index of about 2 to about 10.

2. The composition of claim 1, wherein the composition has a density of about 1.25 to about 1.38 grams per cubic centimeter.

3. The composition of claim 1, further including about 0.001 to 0.5 weight percent of a fatty acid having about 8 to 24 carbon atoms.

4. The composition of claim 1, wherein said pH is at least about 11.2.

5. The composition of claim 4, wherein said pH is at least about 11.2.

6. The composition of claim 1 further including about 0.1 to 2.0 wt. percent of a polyacylate polymeric thixotropic thickener.

7. The composition of claim 1, wherein said polyvalent metal salt of said long chain fatty acid is aluminum stearate and said inorganic thixotropic thickener is a clay.

* * * * *